US008293442B2

(12) United States Patent
Watanabe et al.

(10) Patent No.: US 8,293,442 B2
(45) Date of Patent: Oct. 23, 2012

(54) RESIN PARTICLE, TONER, AND IMAGE FORMING METHOD AND PROCESS CARTRIDGE USING THE SAME

(75) Inventors: Masaki Watanabe, Numazu (JP); Naohito Shimota, Numazu (JP); Hiroshi Yamashita, Numazu (JP); Naohiro Watanabe, Shizuoka (JP); Tsuneyasu Nagatomo, Numazu (JP); Tsuyoshi Sugimoto, Mishima (JP); Shinichi Wakamatsu, Numazu (JP); Kenya Itoh, Ichihara (JP); Mikio Yamahiro, Ichihara (JP)

(73) Assignees: Ricoh Company, Ltd., Tokyo (JP); JNC Corporation, Tokyo (JP)

( * ) Notice: Subject to any disclaimer, the term of this patent is extended or adjusted under 35 U.S.C. 154(b) by 265 days.

(21) Appl. No.: 12/564,595

(22) Filed: Sep. 22, 2009

(65) Prior Publication Data

US 2010/0075245 A1 Mar. 25, 2010

(30) Foreign Application Priority Data

Sep. 24, 2008 (JP) ..... 2008-243913

(51) Int. Cl.
*G03G 9/087* (2006.01)

(52) U.S. Cl. ..... 430/108.3; 430/108.1; 430/108.11; 430/109.1; 430/109.4; 430/110.3; 428/402; 524/188; 524/267; 524/272

(58) Field of Classification Search ..... 430/108.1, 430/108.11, 108.3, 109.1, 109.4, 110.3; 428/402; 524/188, 267, 272
See application file for complete search history.

(56) References Cited

U.S. PATENT DOCUMENTS 5,368,972 A 11/1994 Yamashita et al.
(Continued)

FOREIGN PATENT DOCUMENTS

JP 6-250439 9/1994
(Continued)

OTHER PUBLICATIONS

Translation of JP 2008-274011 published Nov. 2008.*

*Primary Examiner* — Peter Vajda
(74) *Attorney, Agent, or Firm* — Oblon, Spivak, McClelland, Maier & Neustadt, L.L.P.

(57) ABSTRACT

Disclosed is a resin particle having a volume average particle diameter of 10 nm to 500 nm, obtained by polymerizing an addition polymerizable monomer containing a silsesquioxane (a) represented by Formula (I) or by copolymerizing the silsesquioxane (a) with an addition polymerizable monomer (b), (I)

where $R^1$ to $R^7$ each independently represent a group selected from the group consisting of hydrogen, alkyl having 1 to 40 carbon atoms, substituted or unsubstituted aryl, and substituted or unsubstituted arylalkyl; any hydrogen in the alkyl group is optionally substituted by fluorine and any —$CH_2$— is optionally substituted by —O—, —CH=CH—, cycloalkylene or cycloalkenylene; any hydrogen in alkylene in the arylalkyl group is optionally substituted by fluorine and any —$CH_2$— is optionally substituted by —O— or —CH=CH—; and $A^1$ represents an addition polymerizable functional group.

19 Claims, 5 Drawing Sheets

U.S. PATENT DOCUMENTS 6,140,000 A 10/2000 Yamashita
6,329,115 B1 12/2001 Yamashita
6,360,068 B1 3/2002 Kinoshita et al.
6,403,275 B1 6/2002 Kuramoto et al.
6,416,914 B1 7/2002 Nakamura et al.
6,432,589 B1 8/2002 Uchinokura et al.
6,503,676 B2 1/2003 Yamashita et al.
6,660,443 B2 12/2003 Sugiyama et al.
6,682,866 B2 1/2004 Sugiyama et al.
6,740,460 B2 5/2004 Tomita et al.
6,756,175 B2 6/2004 Yamada et al.
6,757,507 B2 6/2004 Mochizuki et al.
6,787,280 B2 9/2004 Yamashita et al.
6,824,945 B2 11/2004 Emoto et al.
6,846,604 B2 1/2005 Emoto et al.
6,849,369 B2 2/2005 Yagi et al.
6,852,462 B2 2/2005 Emoto et al.
6,855,468 B1 2/2005 Yamamoto et al.
6,887,636 B2 5/2005 Matsuda et al.
6,898,406 B2 5/2005 Suzuki et al.
6,902,857 B2 6/2005 Yagi et al.
6,924,073 B2 8/2005 Higuchi et al.
6,936,390 B2 8/2005 Nanya et al.
6,946,229 B2 9/2005 Suzuki et al.
6,947,692 B2 9/2005 Kondo et al.
7,005,223 B2 2/2006 Yamashita et al.
7,056,635 B2 6/2006 Tanaka et al.
7,056,636 B2 6/2006 Tomita et al.
7,056,638 B1 6/2006 Tomita et al.
7,074,535 B2 7/2006 Saito et al.
7,074,541 B2 7/2006 Yamashita et al.
7,083,890 B2 8/2006 Emoto et al.
7,129,013 B2 10/2006 Higuchi et al.
7,157,199 B2 1/2007 Emoto et al.
7,157,201 B2 1/2007 Tomita et al.
7,163,775 B2 1/2007 Takada et al.
7,208,256 B2 4/2007 Tanaka et al.
7,241,545 B2 7/2007 Nanya et al.
7,241,548 B2 7/2007 Sugiyama et al.
7,303,847 B2 12/2007 Tomita et al.
7,306,887 B2 12/2007 Tanaka et al.
7,348,117 B2 3/2008 Inoue et al.
7,354,690 B2 4/2008 Ishii et al.
7,374,848 B2 5/2008 Matsuoka et al.
7,374,851 B2 5/2008 Nakayama et al.
7,384,722 B2 6/2008 Ohtani et al.
7,396,627 B2 7/2008 Watanabe et al.
7,429,442 B2 9/2008 Honda et al.
7,435,521 B2 10/2008 Yagi et al.
7,437,111 B2 10/2008 Yamada et al.
7,449,273 B2 11/2008 Ohki et al.
7,455,942 B2 11/2008 Nagatomo et al.
7,459,255 B2 12/2008 Tanaka et al.
7,473,508 B2 1/2009 Higuchi et al.
7,488,564 B2 2/2009 Tanaka et al.
7,504,188 B2 3/2009 Yamada et al.
7,531,279 B2 5/2009 Watanabe et al.
7,541,128 B2 6/2009 Watanabe et al.
7,550,245 B2 6/2009 Inoue et al.
7,560,216 B2 7/2009 Sugiyama et al.
7,587,161 B2 9/2009 Yamada et al.
7,985,523 B2 * 7/2011 Zhou et al. ..... 430/109.3
2002/0039698 A1 4/2002 Sasaki et al.
2003/0027066 A1 2/2003 Yamashita et al.
2003/0055159 A1 3/2003 Yamashita et al.
2003/0096185 A1 5/2003 Yamashita et al.
2003/0219669 A1 11/2003 Yamashita et al.
2004/0115551 A1 6/2004 Sugiyama et al.
2005/0079433 A1 4/2005 Watanabe et al.
2005/0112488 A1 5/2005 Yamada et al.
2005/0164112 A1 7/2005 Ohki et al.
2005/0196691 A1 9/2005 Ohtani et al.
2005/0277045 A1 12/2005 Saito et al.
2006/0057488 A1 3/2006 Inoue et al.
2006/0068312 A1 3/2006 Yamashita et al.
2006/0177756 A1 8/2006 Sugimoto et al.
2006/0210903 A1 9/2006 Ohki et al.
2007/0015077 A1 1/2007 Yamashita et al.
2007/0054210 A1 3/2007 Ohki et al.
2007/0059626 A1 3/2007 Inoue et al.
2007/0141500 A1 6/2007 Sugimoto et al.
2007/0218380 A1 9/2007 Uchinokura et al.
2007/0218381 A1 9/2007 Uchinokura et al.
2007/0218382 A1 9/2007 Emoto et al.
2007/0218383 A1 9/2007 Seshita et al.
2007/0218385 A1 9/2007 Kojima et al.
2007/0218386 A1 9/2007 Suzuki et al.
2007/0218387 A1 9/2007 Ishii et al.
2007/0218392 A1 9/2007 Yamada et al.
2007/0275315 A1 11/2007 Nagatomo et al.
2008/0069606 A1 3/2008 Yamashita et al.
2008/0069616 A1 3/2008 Kojima et al.
2008/0070144 A1 3/2008 Nagatomo et al.
2008/0070151 A1 3/2008 Sugimoto et al.
2008/0227002 A1 9/2008 Moriya et al.
2008/0227015 A1 9/2008 Nagatomo et al.
2008/0233496 A1 9/2008 Kotsugai et al.
2008/0233505 A1 9/2008 Nagatomo et al.
2008/0280218 A1 11/2008 Sabu et al.
2008/0280219 A1 11/2008 Nakayama et al.
2008/0292985 A1 11/2008 Suzuki et al.
2008/0318144 A1 12/2008 Watanabe et al.
2008/0318148 A1 12/2008 Sugimoto et al.
2009/0003885 A1 1/2009 Sabu et al.
2009/0067876 A1 3/2009 Seshita et al.
2009/0074467 A1 3/2009 Seshita et al.
2009/0092917 A1 4/2009 Sugimoto et al.
2009/0104555 A1 4/2009 Wakamatsu et al.
2009/0142093 A1 6/2009 Sawada et al.
2009/0142094 A1 6/2009 Sawada et al.
2009/0142680 A1 6/2009 Shimota et al.
2009/0142685 A1 6/2009 Nagatomo et al.
2009/0142686 A1 6/2009 Kojima et al.
2009/0155709 A1 6/2009 Watanabe et al.

FOREIGN PATENT DOCUMENTS

JP 7-209952 8/1995
JP 2000-75551 3/2000
JP 2001-66820 3/2001
JP 3640918 1/2005
JP 3692829 7/2005
JP 2008-274011 * 11/2008

* cited by examiner

RESIN PARTICLE, TONER, AND IMAGE FORMING METHOD AND PROCESS CARTRIDGE USING THE SAME

BACKGROUND OF THE INVENTION

1. Field of the Invention

The present invention relates to a resin particle, a toner, and an image forming method and a process cartridge using the toner.

2. Description of the Related Art

In recent years, in the field of an image forming technology utilizing electrophotography, there is an ever-increasing competition in the development of an apparatus for color image formation that can realize high-speed image formation and, at the same time, can yield color images having a high image quality. For this reason, in order to form full color images at a high speed, the so-called tandem system has become extensively adopted in methods for image formation. In the tandem system, a plurality of electrophotographic photoconductors (otherwise referred to as photoconductor or photoconductors, simply) are arranged in series. Images for respective color components are formed in respective electrophotographic photoconductors. The formed images are superimposed on top of each other, and the superimposed images are transferred at a time on a recording medium (for example, Japanese Patent Application Laid-Open (JP-A) No. 07-209952 and JP-A No. 2000-075551). The use of an intermediate transfer member is effective in preventing the transfer of smear directly onto a recording medium such as paper when smear has occurred on the electrophotographic photoconductors during development. Since, however, in the system using the intermediate transfer member, two transfer steps, that is, a step of transfer from the electrophotographic photoconductor to the intermediate transfer member (primary transfer) and a step of transfer from the intermediate transfer member to a recording medium to give a final image (secondary transfer), are performed, the transfer efficiency is lowered.

On the other hand, in addition to the above problem, there is a demand for the formation of high-quality full color images. To meet this demand, a developing agent design for an image quality improvement has been made. In order to cope with the demand for the improved image quality, particularly in full color images, there is an increasing tendency toward the production of toners having smaller particle diameters, and studies have been made on faithful reproduction of latent images. Regarding the reduction in particle diameter, a process for producing a toner by a polymerization process has been proposed as a method that can regulate the toner so as to have desired shape and surface structure (for example, Japanese Patent No. (JP-B) 3640918, Japanese Patent Application Laid-Open (JP-A) No. 06-250439). In the toner produced by the polymerization process, in addition to the control of the diameter of toner particles, the shape of toner particles can also be controlled. A combination of this technique with a particle size reduction can improve the reproducibility of dots and hairlines, and can reduce pile height (image layer thickness), whereby an improvement in image quality can be expected.

When a small-diameter toner is used, however, non-electrostatic adhesion between the toner particle and the electrophotographic photoconductor or between the toner particle and the intermediate transfer member is increased. Accordingly, the transfer efficiency is likely to be further lowered. This leads to such an unfavorable phenomenon that, when the small-diameter toner is used in a high-speed full-color image forming apparatus, the transfer efficiency, particularly in the secondary transfer is significantly lowered. The reason for this is that the degree of difficulty of transfer is increased because, due to the reduction in particle diameter of the toner, the non-electrostatic adhesion to the intermediate transfer member per toner particle is increased, a plurality of color toners are present in a superimposed state in the secondary transfer, and, due to an increase in speed, the period of time, for which the toner particle undergoes a transfer electric field in a nip portion in the secondary transfer, is decreased.

Further increasing the transfer electric field in the secondary transfer is considered effective in overcoming the above problem. When the transfer electric field is excessively increased, however, the transfer efficiency is disadvantageously lowered. Accordingly, there is a limitation on this technique. Prolonging the period of time for which the toner particle undergoes the transfer electric field by increasing the width of the nip portion in the second transfer is also considered. In a contact-type voltage application system using a bias roller and the like, in order to increase the nip width, only any one of a method in which the abutting pressure of the bias roller is increased, or a method in which the roller diameter of the bias roller is increased, can be adopted. Increasing the abutting pressure has a limitation from the viewpoints of image quality, and increasing the roller diameter has a limitation from the viewpoint of a reduction in size of the apparatus. In a non-contact-type voltage application system using a charger or the like, the nip width in the secondary transfer should be increased, for example, by increasing the number of chargers. Accordingly, this also has a limitation. For the above reason, it can be said that, particularly in high-speed machines, increasing the nip width until transfer efficiency higher than that in the present stage is provided practically impossible.

On the other hand, a method has been proposed in which the type and addition amount of additives are regulated (particularly, additives having a large particle diameter is added) as a method that reduces the non-electrostatic adhesion between the toner particle and the electrophotographic photoconductor or between the toner particle and the intermediate transfer member (for example, JP-A No. 2001-066820 and JP-B No. 3692829). According to this method, by virtue of the non-electrostatic adhesion reduction effect, the toner particle can realize an improved transfer efficiency. Further, in this method, additional effects such as stable development and improved cleaning effect can be attained.

BRIEF SUMMARY OF THE INVENTION

In an early stage of use of the toner, the toner can improve the transfer efficiency of the image forming apparatus. However, when the toner undergoes a mechanical stress by stirring or the like for a long period of time within a developing device in the image forming apparatus, an additive is embedded in the base particle. As a result, the adhesion reduction effect cannot be attained by the additive, disadvantageously resulting in lowered transfer efficiency of the image forming apparatus. In particular, in a high-speed machine, since stirring within the developing device is violent, the mechanical stress is so high that embedding of the additive in the toner base particle is likely to be accelerated. Therefore, this is considered to lead to a lowering in transfer efficiency in a relatively early stage.

To overcome this problem, from the viewpoint of stably maintaining a high transfer efficiency in a high-speed machine for a long period of time, the surface property (mechanical strength) should be regulated so that, even upon exposure to mechanical stress, the additive is present on the surface of the base particle without being embedded in the base particle. In this case, it should be noted that excessively increasing the surface property (mechanical strength) or the hardness is disadvantageous in that melting of the toner during fixation is inhibited and, when the toner contains a releasing agent such as wax, oozing of the releasing agent on the fixation roller during fixation is unsatisfactory, resulting in deteriorated fixability.

In view of the above problems of the prior art, an object of the present invention is to provide a resin particle useful for addition to the toner for imparting these properties; a process for producing a toner that, in a high-speed full color image forming method, can improve transfer efficiency, can eliminate image defects during transfer of each toner, and can output images having good reproducibility for a long period of time and a full-color image forming method and a process cartridge using the toner.

The object can be attained by the following inventions.

<1> A resin particle having a volume average particle diameter of 10 nm to 500 nm, obtained by polymerizing an addition polymerizable monomer containing a silsesquioxane (a) represented by Formula (I) or by copolymerizing the silsesquioxane (a) with an addition polymerizable monomer (b), (I)

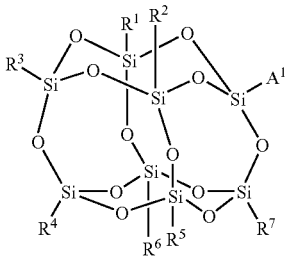

where $R^1$ to $R^7$ each independently represent a group selected from the group consisting of hydrogen, alkyl having 1 to 40 carbon atoms, substituted or unsubstituted aryl, and substituted or unsubstituted arylalkyl; any hydrogen in the alkyl group is optionally substituted by fluorine and any —$CH_2$— is optionally substituted by —O—, —CH═CH—, cycloalkylene or cycloalkenylene; any hydrogen in alkylene in the arylalkyl group is optionally substituted by fluorine and any —$CH_2$— is optionally substituted by —O— or —CH═CH—; and $A^1$ represents an addition polymerizable functional group.

<2> The resin particle according to <1>, wherein in Formula (I), $R^1$ to $R^7$ each independently represent fluoroalkyl having 1 to 20 carbon atoms in which any methylene group is optionally substituted by oxygen; fluoroaryl having 6 to 20 carbon atoms in which at least one hydrogen is substituted by fluorine or trifluoromethyl; or fluoroarylalkyl having 7 to 20 carbon atoms in which at least one hydrogen in the aryl group is substituted by fluorine or trifluoromethyl.

<3> The resin particle according to <1> or <2>, wherein in Formula (I), $R^1$ to $R^7$ each independently represent ethyl, isobutyl, isooctyl, phenyl, cyclopentyl, cyclohexyl, 3,3,3-trifluoropropyl, 3,3,4,4,4-pentafluorobutyl, 3,3,4,4,5,5,6,6,6-nonafluorohexyl, tridecafluoro-1,1,2,2-tetrahydrooctyl, heptadecafluoro-1,1,2,2-tetrahydrodecyl, henicosafluoro-1,1,2,2-tetrahydrododecyl, pentacosafluoro-1,1,2,2-tetrahydrotetradecyl, (3-heptafluoroisopropoxy)propyl, pentafluorophenylpropyl, pentafluorophenyl, or α,α,α-trifluoromethylphenyl.

<4> The resin particle according to any one of claims <1> to <3>, wherein in Formula (I), $A^1$ represents a radical polymerizable functional group.

<5> The resin particle according to any one of claims <1> to <4>, wherein in Formula (I), $A^1$ includes (meth)acryl or styryl.

<6> The resin particle according to <5>, wherein in Formula (I), $A^1$ represents a group represented by any one of Formula (II) or (III):

(II)

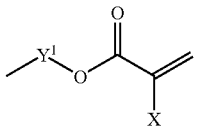

(III)

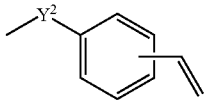

wherein in Formula (II), $Y^1$ represents alkylene having 2 to 10 carbon atoms and X represents hydrogen, alkyl having 1 to 5 carbon atoms or aryl having 6 to 10 carbon atoms, and in Formula (III), $Y^2$ represents a single bond or alkylene having 1 to 10 carbon atoms.

<7> The resin particle according to <6>, wherein in Formula (II), $Y^1$ represents alkylene having 2 to 6 carbon atoms and X represents hydrogen or alkyl having 1 to 3 carbon atoms, and in Formula (III), $Y^2$ represents a single bond or alkylene having 1 to 6 carbon atoms.

<8> The resin particle according to <7>, wherein in Formula (II), $Y^1$ represents propylene and X represents hydrogen or methyl, and in Formula (III), $Y^2$ represents a single bond or ethylene.

<9> The resin particle according to any one of <1> to <8>, wherein the addition polymerizable monomer (b) is a (meth)acrylic acid compound or a styrene compound.

<10> The resin particle according to any one of <1> to <9>, wherein the resin particle is a fine particle of a crosslinked resin containing a styrene polymer, an acrylic acid ester polymer, or a methacrylic acid ester polymer.

<11> A toner obtained by dissolving and/or dispersing a toner material containing at least a binder resin and a colorant in an organic solvent to prepare a solution and/or dispersion liquid of the toner material; adding the solution and/or dispersion liquid of the toner material to an aqueous medium for emulsification and/or dispersion to prepare an emulsion and/or dispersion liquid; and removing the organic solvent from the emulsion and/or dispersion liquid, wherein the resin particle according to any one of <1> to <10> is added in the aqueous medium in the preparation of the emulsion and/or dispersion liquid or removal of the organic solvent from the emulsion and/or dispersion liquid.

<12> A toner obtained by dissolving and/or dispersing a toner material containing at least a binder resin and a colorant in a polymerizable monomer to prepare a solution and/or dispersion liquid of the toner material; emulsifying and/or dispersing the solution and/or dispersion liquid of the toner material in an aqueous medium to prepare an emulsion and/or dispersion liquid; and polymerizing the emulsion and/or dispersion liquid, wherein the resin particle according to any one of <1> to <10> is added in the aqueous medium in the preparation of the emulsion and/or dispersion liquid or polymerization of the emulsion and/or dispersion liquid.

<13>A toner obtained by dispersing a toner material containing at least a binder resin and a colorant in an aqueous medium to prepare a dispersion liquid of the toner material; coagulating the dispersion liquid in the aqueous medium to obtain coagulates; and heat-fusing the coagulates to one another, wherein the resin particle according to any one of <1> to <10> is added in the aqueous medium in the coagulation or heat-fusion of the coagulates.

<14> The toner according to any one of <11> to <13>, wherein the toner has an average circularity of 0.950 to 0.990.

<15> The toner according to any one of <11> to <14>, wherein the toner has a specific surface area of 0.5 $m^2/g$ to 4.0 $m^2/g$.

<16> The toner according to any one of <11> to <15>, wherein the binder resin contains a polyester resin.

<17> The toner according to any one of <11> to <16>, wherein the toner material contains an active hydrogen group-containing compound and a modified polyester resin reactive with the active hydrogen group-containing compound.

<18>A full-color image forming method including: charging a surface of an electrophotographic photoconductor by a charging unit; exposing the charged surface of the electrophotographic photoconductor by an exposing unit to form a latent electrostatic image on the electrophotographic photoconductor; developing the latent electrostatic image, which has been formed on the electrophotographic photoconductor, by a developing unit including therein a toner to form a toner image; primarily transferring the toner image, which has been formed on the electrophotographic photoconductor, onto an intermediate transfer member by a primary transfer unit; secondarily transferring the toner image, which has been transferred onto the intermediate transfer member, onto a recording medium by a secondary transfer unit; fixing the toner image, which has been transferred onto the recording medium, by action of heat and a fixing unit including a pressure fixing member; and removing, by cleaning unit, toner remaining untransferred and adhered onto the surface of the electrophotographic photoconductor, from which the toner image has been transferred onto the intermediate transfer member by the primary transfer unit, wherein the toner present in the development is the toner according to any one of <11> to <17>.

<19> The full-color image forming method according to <18>, wherein in the secondary transfer, the linear velocity of transfer of the toner image onto the recording medium is 300 mm/sec to 1,000 mm/sec, and the time during the transfer in a nip portion of the secondary transfer unit is 0.5 msec to 20 msec.

<20> The full-color image forming method according to <18> or <19>, employing a tandem-type electrophotographic image forming process.

<21>A process cartridge adapted for use in an image forming apparatus, the process cartridge including at least an electrophotographic photoconductor, and a developing unit, the image forming apparatus including at least the electrophotographic photoconductor; a charging unit configured to charge a surface of an electrophotographic photoconductor; an exposing unit configured to expose the charged surface of the electrophotographic photoconductor to form a latent electrostatic image on the electrophotographic photoconductor; the developing unit configured to develop the latent electrostatic image formed on the surface of the electrophotographic photoconductor using a toner to form a toner image; a transfer unit configured to transfer the toner image formed on the electrophotographic photoconductor, directly or via an intermediate transfer member, onto a recording medium; a fixing unit configured to fix the transferred toner image on the recording medium by action of heat and a pressure fixing member; and a cleaning unit configured to remove toner remaining untransferred and adhered onto the surface of the electrophotographic photoconductor, from which the toner image has been transferred onto the intermediate transfer member or the recording medium by the primary transfer unit, wherein the developing unit includes therein a toner, and the electrophotographic photoconductor and the developing unit are integrally supported on the main body of the image forming apparatus in a detachable manner, wherein the toner is the toner according to any one of <11> to <17>.

<22> The process cartridge according to <21>, further including at least one unit selected from the charging unit, the transfer unit, and the cleaning unit.

The present invention can provide a process for producing a toner that, in a high-speed full color image forming method, can improve transfer efficiency, can eliminate image defects during transfer of each toner, and can output images having good reproducibility for a long period of time; a resin particle to be added to the toner for imparting these properties; and a full-color image forming method and a process cartridge using the toner.

DETAILED DESCRIPTION OF THE INVENTION

Figure 1:
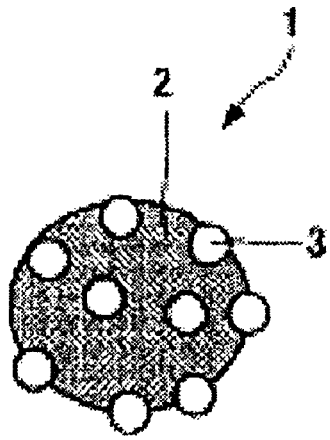
FIG. 1 is a typical view for explaining an embodiment of the shape of a toner according to the present invention.

The best mode for carrying out the present invention will be described optionally with reference to the accompanying drawings. The aspects of the present invention can be easily properly altered or modified by the so-called person having ordinary skill in the art to constitute other embodiments, and these alterations and modifications are included in the present invention. The following descriptions are examples of preferred embodiments of the invention and do not limit the present invention.

<Resin Particle>

The resin particle of the present invention is a resin particle that is produced by polymerizing an addition polymerizable monomer containing an addition polymerizable functional group-containing silsesquioxane (a) or by copolymerizing an addition polymerizable functional group-containing silsesquioxane (a) with an addition polymerizable monomer (b) and has a volume average particle diameter of 10 nm to 500 nm.

<Silsesquioxane (a)>

(I)

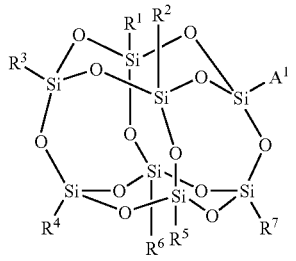

The addition polymerizable functional group-containing silsesquioxane (a) represented by Formula (I) has a silsesquioxane skeleton in its molecular structure. The silsesquioxane is a generic name of polysiloxanes represented by $[(R—SiO_{1.5})_n]$ wherein R represents any substituent and, in Formula (I), represents $R^1$, $R^2$, $R^3$, $R^4$, $R^5$, $R^6$, $R^7$, or $A^1$. Structures of the silsesquioxanes are generally classified according to Si—O—Si skeleton into random structures, ladder structures, and cage structures. Further, the cage structures are classified, for example, into $T_8$, $T_{10}$, and $T_{12}$ types. Among them, the silsesquioxane (a) used in the present invention preferably has a cage structure of $T_8$-type $[(R—SiO_{1.5})_8]$.

The silsesquioxane (a) is characterized by having at least one addition polymerizable functional group. That is, one of Rs in the silsesquioxane $[(R—SiO_{1.5})_n]$ is an addition polymerizable functional group $A^1$.

Examples of such addition polymerizable functional groups include groups containing a terminal olefin-type or internal olefin-type radical polymerizable functional group; groups containing a cation polymerizable functional group such as vinyl ether or propenyl ether; and groups containing an anion polymerizable functional group such as vinylcarboxyl or cyanoacryloyl. Preferred are radical polymerizable functional group.

The radical polymerizable functional group may be any radical polymerizable group without particular limitation, and examples thereof include methacryloyl, acryloyl, allyl, styryl, α-methylstyryl, vinyl, vinyl ether, vinyl ester, acrylamide, methacrylamide, N-vinylamide, maleate, fumarate, N-substituted maleimide. Among them, for example, (meth) acryl- or styryl-containing groups are preferred. The (meth) acryl is a generic name of acryl and methacryl and refers to acryl and/or methacryl. This applies hereinafter.

Examples of (meth)acryl-containing radical polymerizable functional groups include groups represented by Formula (II). In Formula (II), $Y^1$ represents alkylene having 2 to 10 carbon atoms, preferably alkylene having 2 to 6 carbon atoms, still more preferably alkylene having 3 carbon atoms, i.e., propylene. X represents hydrogen or alkyl having 1 to 3 carbon atoms, preferably hydrogen or methyl.

Examples of styryl-containing radical polymerizable functional groups include groups represented by Formula (III). In Formula (III), $Y^2$ represents a single bond or alkylene having 1 to 10 carbon atoms, preferably a single bond or alkylene having 1 to 6 carbon atoms, more preferably a single bond or alkylene having 2 carbon atoms, i.e., ethylene. Vinyl is bonded to any carbon in the benzene ring and is preferably bonded to carbon located at the p-position relative to $Y^2$.

(II)

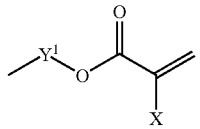

(III)

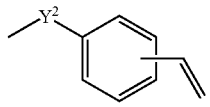

The silsesquioxane (a) contains groups that are each independently selected from the group consisting of hydrogen, alkyl, substituted or unsubstituted aryl, and substituted or unsubstituted arylalkyl.

When $R^1$ to $R^7$ represent alkyl, the number of carbon atoms is 1 to 40. The number of carbon atoms is preferably 1 to 30, more preferably 1 to 8. Any hydrogen in the alkyl group is optionally substituted by fluorine, and any $—CH_2—$ is optionally substituted by —O—, —CH═CH—, cycloalkylene or cycloalkenylene. Examples of preferred alkyl include unsubstituted alkyl having 1 to 30 carbon atoms, alkoxyalkyl having 2 to 30 carbon atoms, groups obtained by substituting one $—CH_2—$ in alkyl having 1 to 8 carbon atoms by cycloalkylene, alkenyl having 2 to 20 carbon atoms, alkenyloxyalkyl having 2 to 20 carbon atoms, alkyloxyalkenyl having 2 to 20 carbon atoms, groups obtained by substituting one $—CH_2—$ in alkyl having 1 to 8 carbon atoms by cycloalkenylene, and groups obtained by substituting any hydrogen in these groups by fluorine. The number of carbon atoms of cycloalkylene and cycloalkenylene is preferably 3 to 8.

When $R^1$ to $R^7$ represent substituted or unsubstituted aryl, examples thereof include phenyl in which any hydrogen is substituted by a halogen or alkyl having 1 to 10 carbon atoms and unsubstituted naphthyl. Examples of preferred halogens include fluorine, chlorine, and bromine. In alkyl having 1 to 10 carbon atoms, any hydrogen is optionally substituted by fluorine, and any $—CH_2—$ is optionally substituted by —O—, —CH═CH— or phenylene. Specifically, when $R^1$ to $R^7$ represent substituted or unsubstituted aryl, preferred examples thereof include unsubstituted phenyl, unsubstituted naphthyl, alkylphenyl, alkyloxyphenyl, alkenylphenyl, phenyl that contains groups obtained by substituting any $—CH_2—$ in alkyl having 1 to 10 carbon atoms, by phenylene, as a substituent and groups obtained by substituting any hydrogen in these groups by a halogen.

Examples of substituted or unsubstituted arylalkyl represented by $R^1$ to $R^7$ will be described. In alkylene in the arylalkyl group, any hydrogen is optionally substituted by fluorine, and any $—CH_2—$ is optionally substituted by —O— or —CH═CH—. Phenylalkyl is a preferred examples of arylalkyl. In this case, the number of carbon atoms of alkylene is preferably 1 to 12, more preferably 1 to 8.

Preferably, $R^1$ to $R^7$ have at least one fluoroalkyl, fluoroarylalkyl, or fluoroaryl. Specifically, one or more of Rs in silsesquioxane $[(R—SiO_{1.5})_n]$, more preferably all of Rs except for the addition polymerizable functional group represent fluoroalkyl, fluoroarylalkyl and/or fluoroaryl.

The fluoroalkyl may be of straight chain type or branched chain type. The fluoroalkyl has 1 to 20 carbon atoms, preferably 3 to 14 carbon atoms. Any methylene in fluoroalkyl is optionally substituted by oxygen. Here methylene includes —$CH_2$—, —CFH—, or —$CF_2$—. That is, the expression "any methylene is optionally substituted by oxygen" means that —$CH_2$—, —CFH—, or —$CF_2$— is optionally substituted by —O—. In this case, however, in fluoroalkyl, two oxygen atoms are not in a mutually bonded state (—O—O—). That is, fluoroalkyl may have an ether bond. Further, in preferred fluoroalkyl, methylene adjacent to Si is not substituted by oxygen. The end opposite to Si is $CF_3$. Further, the substitution of —$CF_2$— by oxygen is more preferred than the substitution of —$CH_2$— or —CFH— by oxygen. Specific examples of preferred fluoroalkyl include 3,3,3-trifluoropropyl, 3,3,4,4,4-pentafluorobutyl, 3,3,4,4,5,5,6,6,6-nonafluorohexyl, tridecafluoro-1,1,2,2-tetrahydrooctyl, heptadecafluoro-1,1,2,2-tetrahydrododecyl, henicosafluoro-1,1,2,2-tetrahydrododecyl, pentacosalluoro-1,1,2,2-tetrahydrotetradecyl, and (3-heptafluoroisopropoxy)propyl. Among them, perfluoroalkylethyl is preferred.

Preferably, the fluoroarylalkyl is alkyl including fluorine-containing aryl and has 7 to 20 carbon atoms, more preferably 7 to 10 carbon atoms. Preferably, fluorine contained in fluoroarylalkyl is such that any one or at least two hydrogen atoms in aryl are substituted as fluorine or trifluoromethyl. Examples of aryl moiety include phenyl and naphthyl and, further, heteroaryl, and examples of alkyl moiety include methyl, ethyl, and propyl.

The fluoroaryl is such that any one or at least two hydrogen atoms in aryl are substituted by fluorine or trifluoromethyl. Preferably, the fluoroaryl has 6 to 20 carbon atoms, more preferably 6. Examples of such aryl include phenyl and naphthyl and, further, heteroaryl. Specifically, fluorophenyl such as pentafluorophenyl and trifluoromethylphenyl may be mentioned as the aryl.

Among the fluoroalkyl, fluoroarylalkyl, or fluoroaryl contained in the silsesquioxane (a), fluoroalkyl is preferred, perfluoroalkylethyl is more preferred, and 3,3,3-trifluoropropyl or 3,3,4,4,5,5,6,6,6-nonafluorohexyl is still more preferred.

As described above, the preferred silsesquioxane (a) has a $T_8$-type structure, contains one addition polymerizable functional group, contains one or at least two fluoroalkyl, fluoroarylalkyl and/or fluoroaryl, and is represented by structural Formula (I).

In Formula (I), preferably, $A^1$ represents the radical polymerizable functional group, and $R^1$ to $R^7$ each independently represent the fluoroalkyl, fluoroarylalkyl, or fluoroaryl. $R^1$ to $R^7$ may be the same or different.

Silsesquioxanes represented by Formula (I) wherein $R^1$ to $R^7$ represent a group other than fluoroalkyl, fluoroarylalkyl, or fluoroaryl include methacrylisobutyl POSS (MA0702, manufactured by Hybrid Plastics Inc.), methacrylethyl POSS (MA0717, manufactured by Hybrid Plastics Inc.), methacrylate cyclohexyl POSS (MA0703, manufactured by Hybrid Plastics Inc.), methacrylisooctyl POSS (MA0719, manufactured by Hybrid Plastics Inc.), methacrylphenyl POSS (MA0734, manufactured by Hybrid Plastics Inc.), and methacryloxypropyl heptacyclopentyl-$T_8$-silsesquioxane (SIM6486.6, manufactured by Gelest, Inc.).

<Addition Polymerizable Monomer (b)>

In the resin particle, the silsesquioxane (a) may be if necessary used in combination with the addition polymerizable monomer (b).

Example of such addition polymerizable monomers (b) include (meth)acrylic acid derivatives having one addition polymerizable double bond and styrene derivatives having one addition polymerizable double bond.

Specific examples of such (meth)acrylic acid compounds include alkyl (meth)acrylates such as methyl (meth)acrylate, ethyl (meth)acrylate, n-propyl (meth)acrylate, isopropyl (meth)acrylate, butyl (meth)acrylate, isobutyl (meth)acrylate, t-butyl (meth)acrylate, n-pentyl (meth)acrylate, n-hexyl (meth)acrylate, cyclohexyl (meth)acrylate, n-heptyl (meth) acrylate, n-octyl (meth)acrylate, 2-ethylhexyl (meth)acrylate, nonyl (meth)acrylate, decyl (meth)acrylate, dodecyl (meth)acrylate, and stearyl (meth)acrylate; aryl (meth)acrylates such as phenyl (meth)acrylate and toluoyl (meth)acrylate; arylalkyl (meth)acrylates such as benzyl (meth)acrylate; alkoxyalkyl (meth)acrylates such as 2-methoxyethyl (meth) acrylate, 3-methoxypropyl (meth)acrylate, and 3-methoxybutyl (meth)acrylate; and ethylene oxide addition products of (meth)acrylic acid.

Further, examples of (meth)acrylic acid compounds having one addition polymerizable double bond include (meth) acrylic acid compounds having a silsesquioxane skeleton. Examples of such (meth)acrylic acid compounds having a silsesquioxane skeleton include 3-(3,5,7,9,11,13,15-heptaethylpentacyclo[9.5.1.$1^{3,9}$.$1^{5,15}$.$1^{7,13}$]octasiloxan-1-yl)propyl (meth)acrylate, 3-(3,5,7,9,11,13,15-heptaisobutyl-pentacyclo[9.5.1.$1^{3,9}$.$1^{5,15}$.$1^{7,13}$]octasiloxan-1-yl)propyl (meth) acrylate, 3-(3,5,7,9,11,13,15-heptaisooctylpentacyclo [9.5.1.$1^{3,9}$.$1^{5,15}$.$1^{7,13}$]octasiloxan-1-yl)propyl (meth) acrylate, 3-(3,5,7,9,11,13,15-heptacyclopentylpentacyclo [9.5.1.$1^{3,9}$.$1^{5,15}$.$1^{7,13}$]octasiloxan-1-yl)propyl (meth) acrylate, 3-(3,5,7,9,11,13,15-heptaphenylpentacyclo-[9.5.1.$1^{3,9}$.$1^{5,15}$.$1^{7,13}$]octasiloxan-1-yl)propyl (meth) acrylate, 3-[(3,5,7,9,11,13,15-heptaethylpentacyclo [9.5.1.$1^{3,9}$.$1^{5,15}$.$1^{7,13}$]octasiloxan-1-yloxy)dimethylsilyl] propyl (meth)acrylate, 3-[(3,5,7,9,11,13,15-heptaisobutylpentacyclo[9.5.1.$1^{3,9}$.$1^{5,15}$.$1^{7,13}$]-octasiloxan-1-yloxy)dimethylsilyl]propyl (meth)acrylate, 3-[(3,5,7,9,11,13,15-heptaisooctylpentacyclo[9.5.1.$1^{3,9}$.$1^{5,15}$.$1^{7,13}$]-octasiloxan-1-yloxy)dimethylsilyl]propyl (meth)acrylate, 3-[(3,5,7,9,11,13,15-heptacyclopentylpentacyclo[9.5.1.$1^{3,9}$.$1^{5,15}$.$1^{7,13}$]-octasiloxan-1-yloxy)dimethylsilyl]propyl (meth)acrylate, and 3-[(3,5,7,9,11,13,15-heptaphenylpentacyclo[9.5.1.$1^{3,9}$.$1^{5,15}$.$1^{7,13}$]-octasiloxan-1-yloxy)dimethylsilyl]propyl (meth)acrylate.

The (meth)acrylic acid compounds may contain fluorine. Examples of fluorine atom-containing monomers include fluoroalkyl (meth)acrylates and fluorine-containing polyether compounds. Examples of such fluorine atom-containing addition polymerizable monomers include monomers disclosed, for example, in JP-A No. 10-251352, JP-A No. 2004-043671, JP-A No. 2004-155847, JP-A No. 2005-029743, JP-A No. 2006-117742, JP-A No. 2006-299016, and JP-A No. 2005-350560.

Examples of monomers which may contain fluorine include 2,2,2-trifluoroethyl (meth)acrylate, 2,2,3,3-tetrafluoro-n-propyl (meth)acrylate, 2,2,3,3-tetrafluoro-t-pentyl (meth)acrylate, 2,2,3,4,4,4-hexafluorobutyl (meth)acrylate, 2,2,3,4,4,4-hexafluoro-t-hexyl (meth)acrylate, 2,3,4,5,5,5-hexafluoro-2,4-bis(trifluoromethyl)pentyl (meth)acrylate, 2,2,3,3,4,4-hexafluorobutyl (meth)acrylate, 2,2,2,2',2',2'-hexafluoroisopropyl (meth)acrylate, 2,2,3,3,4,4,4-heptafluorobutyl (meth)acrylate, 2,2,3,3,4,4,5,5-octafluoropentyl (meth)acrylate, 2,2,3,3,4,4,5,5,5-nonafluoropentyl (meth) acrylate, 2,2,3,3,4,4,5,5,6,6,7,7-dodecafluoroheptyl (meth) acrylate, 3,3,4,4,5,5,6,6,7,7,8,8-dodecafluorooctyl (meth) acrylate, 3,3,4,4,5,5,6,6,7,7,8,8,8-tridecafluorooctyl (meth)

acrylate, 2,2,3,3,4,4,5,5,6,6,7,7,7-tridecafluoroheptyl (meth) acrylate, 3,3,4,4,5,5,6,6,7,7,8,8,9,9,10,10-hexadecafluorodecyl (meth)acrylate, 3,3,4,4,5,5,6,6,7,7,8,8,9,9,10,10,10-heptadecafluorodecyl (meth)acrylate, 3,3,4,4,5,5,6,6,7,7,8,8,9,9,10,10,11,11-octadecafluoroundecyl (meth) acrylate, 3,3,4,4,5,5,6,6,7,7,8,8,9,9,10,10,11,11,11-nonadecafluoroundecyl (meth)acrylate, and 3,3,4,4,5,5,6,6,7,7,8,8,9,9,10,10,11,11,12,12-eicosafluorododecyl (meth) acrylate.

Specific examples of fluorine-containing polyether compounds include 1H,1H-perfluoro-3,6-dioxaheptyl (meth) acrylate, 1H,1H-perfluoro-3,6-dioxaoctyl (meth)acrylate, 1H, 1H-perfluoro-3,6-dioxadecanyl (meth)acrylate, 1H,1H-perfluoro-3,6,9-trioxadecanyl (meth)acrylate, 1H, 1H-perfluoro-3,6,9-trioxaundecanyl (meth)acrylate, 1H,1H-perfluoro-3,6,9-trioxatridecanyl (meth)acrylate, 1H,1H-perfluoro-3,6,9,12-tetraoxatridecanyl (meth)acrylate, 1H,1H-perfluoro-3,6,9,12-tetraoxatetradecanyl (meth)acrylate, 1H,1H-perfluoro-3,6,9,12-tetraoxahexadecanyl (meth) acrylate, 1H,1H-perfluoro-3,6,9,12,15-pentaoxahexadecanyl (meth)acrylate, 1H,1H-perfluoro-3,6,9,12,15-pentaoxaheptadecanyl (meth)acrylate, 1H,1H-perfluoro-3,6,9,12,15-pentaoxanonadecanyl (meth)acrylate, 1H,1H-perfluoro-3,6,9,12,15,18-hexaoxaicosanyl (meth)acrylate, 1H,1H-perfluoro-3,6,9,12,15,18-hexaoxadocosanyl (meth)acrylate, 1H,1H-perfluoro-3,6,9,12,15,18,21-heptaoxatricosanyl (meth) acrylate, and 1H,1H-perfluoro-3,6,9,12,15,18,21-heptaoxapentacosanyl (meth)acrylate.

The fluorine atom-containing addition polymerizable monomer can be synthesized, for example, by reacting a fluorine compound containing a hydroxyl group with an acyl halide containing an addition polymerizable functional group. Examples of fluorine compounds containing a hydroxyl group include $(HO)C(CF_3)_2CH_3$, $(HO)C(CF_3)_2CH_2CH_3$, compounds containing group $(HO)C(CF)_2CH_2O—CH_2—$, and $(HO)C(CF_3)_2CH_2CH_2O—CH_3$. These fluorine compounds containing a hydroxyl group may be products synthesized, for example, by a process described in JP-A No. 10-147639.

Further, the addition polymerizable monomer containing a fluorine atom is commercially available from Exfluor Research Corporation and may also be purchased.

The (meth)acrylic acid compound as the monomer may be an addition polymerizable monomer containing a crosslinkable functional group. The addition polymerizable monomer containing a crosslinkable functional group may be a compound having one or at least two addition polymerizable double bonds, for example, any of a vinyl compound, a vinylidene compound, or vinylene compound. Specific examples thereof include (meth)acrylic acid derivatives or styrene derivatives. Examples of (meth)acrylic acid derivatives include (meth)acrylic acid and (meth)acrylic acid ester and, further, (meth)amideacrylate and (meth)acrylonitrile.

The crosslinkable functional group may be selected from functional groups that, when a composition including the polymer of the present invention and other components is prepared, are crosslinkable with the other components. The monomer may contain one or at least two crosslinkable functional groups. Examples of such crosslinkable functional groups include monovalent functional groups including epoxy such as glycidyl and epoxycyclohexyl and cycloethers such as oxetanyl, isocyanates, acid anhydrides, carboxyl, amines, alkyl halides, thiol, siloxy, and hydroxyl.

Examples of monomers containing a crosslinkable functional group include (meth)acrylic acid and hydroxyalkyl (meth)acrylates such as 2-hydroxyethyl(meth)acrylate and 2-hydroxypropyl(meth)acrylate; epoxy-containing (meth) acrylates such as glycidyl (meth)acrylate; alicyclic epoxy-containing (meth)acrylates such as 3,4-epoxycyclohexylmethyl (meth)acrylate; oxetanyl-containing (meth)acrylates such as 3-ethyl-3-(meth)acryloyloxymethyloxetane; 2-(meth)acryloyloxyethylisocyanate; γ-(methacryloyloxypropy)trimethoxysilane; 2-aminoethyl (meth)acrylate, 2-(2-bromopropionyloxy)ethyl (meth)acrylate, and 2-(2-bromoisobutyryloxy)ethyl (meth)acrylate; and 1-(meth)acryloxy-2-phenyl-2-(2,2,6,6-tetramethyl-1-piperidinyloxy) ethane, 1-(4-((4-(meth)acryloxy)ethoxyethyl)phenylethoxy) piperidine, 1,2,2,6,6-pentamethyl-4-piperidyl (meth) acrylate, and 2,2,6,6-pentamethyl-4-piperidyl (meth) acrylate.

One example of styrene derivatives is a styrene derivative having one addition polymerizable double bond. Specific examples of such styrene compounds include styrene, vinyltoluene, α-methylstyrene, and p-chlorstyrene.

Further examples of styrene compounds having one addition polymerizable double bond include silsesquioxane-containing styrene compounds. Examples of such silsesquioxane-containing styrene derivatives include 4-vinylphenyl group-containing octasiloxanes ($T_8$-type silsesquioxanes) such as 1-(4-vinylphenyl)-3,5,7,9,11,13,15-heptaethylpentacyclo[$9.5.1.1^{3,9}.1^{5,15}.1^{7,13}$]octasiloxane, 1-(4-vinylphenyl)-3,5,7,3,11,13,15-heptaisobutylpentacyclo-[$9.5.1.1^{3,9}.1^{5,15}.1^{7,13}$]octasiloxane, 1-(4-vinylphenyl)-3,5,7,9,11,13,15-heptaisooctylpentacyclo[$9.5.1.1^{3,9}.1^{5,15}.1^{7,13}$]octasiloxane, 1-(4-vinylphenyl)-3,5,7,9,11,13,15-heptacyclopentylpentacyclo-[$9.5.1.1^{3,9}.1^{5,15}.1^{7,13}$]octasiloxane, and 1-(4-vinylphenyl)-3,5,7,9,11,13,15-heptaphenylpentacyclo-[$9.5.1.1^{3,9}.1^{5,15}.1^{7,13}$]octasiloxane; and 4-vinylphenylethyl-containing octasiloxanes ($T_8$-type silsesquioxanes) such as 3-(3,5,7,9,11,13,15-heptaethylpentacyclo[$9.5.1.1^{3,9}.1^{5,15}.1^{7,13}$]octasiloxan-1-yl)ethylstyrene, 3-(3,5,7,9,11,13,15-heptaisobutylpentacyclo[$9.5.1.1^{3,9}.1^{5,15}.1^{7,13}$]-octasiloxan-1-yl) ethylstyrene, 3-(3,5,7,9,11,13,15-heptaisooctylpentacyclo [$9.5.1.1^{3,9}.1^{5,15}.1^{7,13}$]octasiloxan-1-yl)ethylstyrene, 3-(3,5,7,9,11,13,15-heptacyclopentylpentacyclo-[$9.5.1.1^{3,9}.1^{5,15}.1^{7,13}$]octaoctasiloxan-1-yl)ethylstyrene, 3-(3,5,7,9,11,13,15-heptaphenylpentacyclo[$9.5.1.1^{3,9}.1^{5,15}.1^{7,13}$]-octasiloxan-1-yl)ethylstyrene, 3-((3,5,7,9,11,13,15-heptaethylpentacyclo[$9.5.1.1^{3,9}.1^{5,15}.1^{7,13}$]octasiloxan-1-yloxy) dimethylsilyl)ethylstyrene, 3-((3,5,7,9,11,13,15-heptaisobutylpentacyclo[$9.5.1.1^{3,9}.1^{5,15}.1^{7,13}$]octasiloxan-1-yloxy)dimethylsilyl)ethylstyrene, 3-((3,5,7,9,11,13,15-heptaisooctylpentacyclo[$9.5.1.1^{3,9}.1^{5,15}.1^{7,13}$]octasiloxan-1-yloxy)dimethylsilyl)ethylstyrene, 3-((3,5,7,9,11,13,15-heptacyclopentylpentacyclo[$9.5.1.1^{3,9}.1^{5,15}.1^{7,13}$] octasiloxan-1-yloxy)dimethylsilyl)ethylstyrene, and 3-((3,5,7,9,11,13,15-heptaphenylpentacyclo[$9.5.1.1^{3,90}.1^{5,15}.1^{7,13}$] octasiloxan-1-yloxy)dimethylsilyl)ethylstyrene.

The styrene compound as the monomer may contain fluorine. Examples of fluorine atom-containing monomers include fluorostyrene. Examples of such fluorine atom-containing addition polymerizable monomers include monomers disclosed, for example, in JP-A No. 10-251352, JP-A No. 2004.155847, and JP-A No. 2006-299016.

Examples of monomers which may contain fluorine include fluoroalkylstyrenes such as p-trifluoromethylstyrene, p-heptafluoropropylstyrene, and p-pentafluoroethylstyrene.

The fluorine atom-containing addition polymerizable monomer may be synthesized as described above in connection with the (meth)acrylic acid compound as the monomer, or alternatively may be obtained from the market.

As with the (meth)acrylic acid compound as the monomer, the styrene compound as the monomer may be an addition polymerizable monomer containing a crosslinkable functional group.

Examples of monomers containing a crosslinkable functional group include o-aminostyrene, p-styrenechlorosulfonic acid, styrenesulfonic acid and its salts, vinylphenylmethyl dithiocarbamate, 2-(2-bromopropionyloxy)styrene, 2-(2-bromoisobutyryloxy)styrene, and 1-(2-((4-vinylphenyl) methoxy)-1-phenylethoxy)-2,2,6,6-tetramethylpiperidine. Further, styrene derivatives include compounds represented by the following formula.

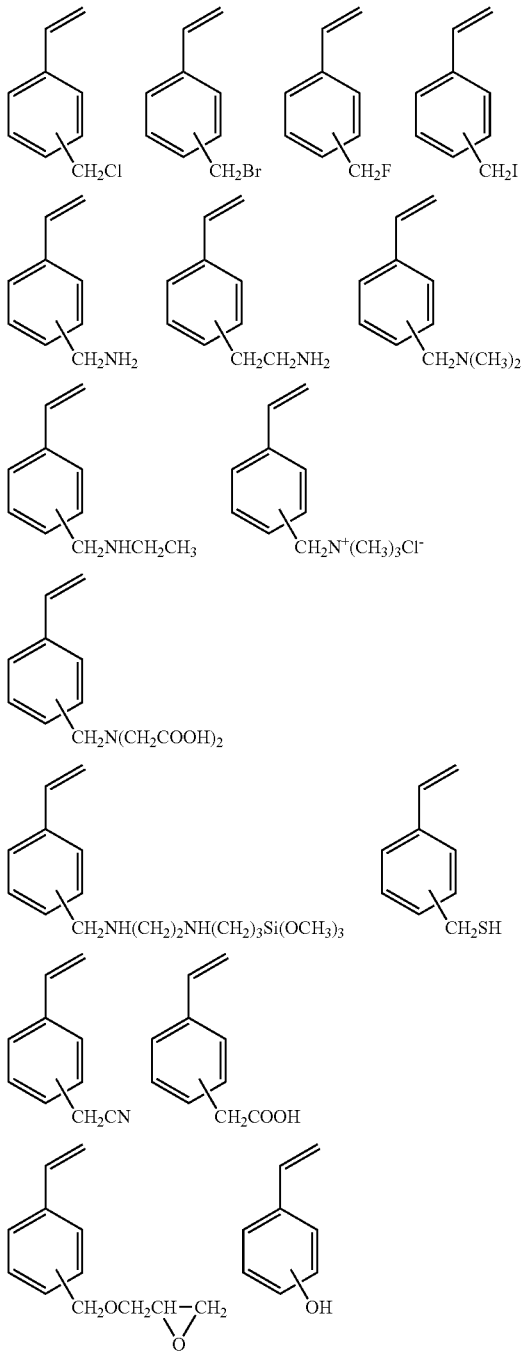

-continued

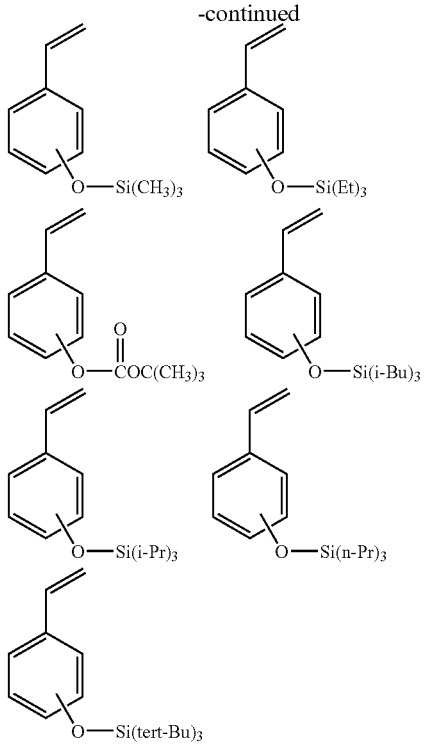

Further examples of the addition polymerizable monomer (b) include macromonomers that have a main chain derived from styrene, (meth)acrylic acid ester, siloxane, and alkylene oxide, for example, from ethylene oxide or propylene oxide and have one polymerizable double bond. Examples of addition polymerizable monomers (b) preferable in the present invention include organopolysiloxanes such as SILAPLANE FM0711 (manufactured by Chisso Corporation), SILAPLANE FM0721 (manufactured by Chisso Corporation), and SILAPLANE FM0725 (manufactured by Chisso Corporation).

Examples of addition polymerizable monomers (b) include compounds having two addition polymerizable double bonds. Examples of compounds having two addition polymerizable double bonds include 1,3-butanediol=di(meth)acrylate, 1,4-butanediol=di(meth)acrylate, 1,6-hexanediol=di(meth)acrylate, polyethylene glycol=di(meth)acrylate, diethylene glycol=di(meth)acrylate, neopentyl glycol=di(meth)acrylate, triethylene glycol=di(meth)acrylate, tripropylene glycol=di(meth)acrylate, neopentyl glycol hydroxypivalate=di(meth)acrylate, trimethylol propane=di(meth)acrylate, bis[(meth)acryloyloxyethoxy]bisphenol A, bis[(meth)acryloyloxyethoxy]tetrabromobisphenol A, bis[(meth)acryloxypolyethoxy]bisphenol A, 1,3-bis(hydroxyethyl)-5,5-dimethylhydantoin, 3-methylpentanediol=di(meth)acrylate, di(meth)acrylate monomers such as di(meth)acrylate of neopentyl glycol hydroxypivalate compound and bis[(meth)acryloyloxypropyl]tetramethyldisiloxane, and divinylbenzene.

Examples of addition polymerizable monomers (b) included compounds having three or more addition polymerizable double bonds. Examples of compounds having three addition polymerizable double bonds include trimethylolpropane=tri(meth)acrylate, pentaerythritol=tri(meth)acrylate, pentaerythritol=tetra(meth)acrylate, dipentaerythritol=monohydroxypenta(meth)acrylate, tris(2-hydroxyethylisocyanate)=tri(meth)acrylate, tris(diethylene glycol)trimerate=tri(meth)acrylate, 3,7,14-tris[(((meth)acryloyloxypropyl)dimethylsiloxy)]-1,3,5,7,9,11,14-heptaethyltricyclo[7.3.3.1$^{5,11}$]heptasiloxane, 3,7,14-tris[(((meth)acryloyloxypropyl)dimethylsiloxy)]-1,3,5,7,9,11,14-heptaisobutyltricyclo[7.3.3.1$^{5,11}$]heptasiloxane, 3,7,14-tris[(((meth)acryloyloxypropyl)dimethylsiloxy)]-1,3,5,7,9,11,14-heptaisooctyltricyclo[7.3.3.1$^{5,11}$]heptasiloxane, 3,7,14-tris[(((meth)acryloyloxypropyl)dimethylsiloxy)]-1,3,5,7,9,11,14-heptacyclopentyltricyclo[7.3.3.1$^{5,11}$]heptasiloxane, 3,7,14-tris[(((meth)acryloyloxypropyl)dimethylsiloxy)]-1,3,5,7,9,11,14-heptaphenyltricyclo[7.3.3.1$^{5,11}$]heptasiloxane, octakis(3-(meth)acryloyloxypropyldimethylsiloxy)octasilsesquioxane, and octakis(3-(meth)acryloyloxypropyl)octasilsesquioxane.

The addition polymerizable monomer (b) is preferably an (meth)acrylic acid compound, more preferably an (meth) acrylic acid ester, still more preferably a lower alkyl (for example, having 1 to 3 carbon atoms) ester or cross linkable functional group-containing ester of (meth)acrylic acid.

One type of the addition polymerizable monomer (b) may be used solely. Alternatively, a plurality of addition polymerizable monomers (b) may be used in combination. When the plurality of addition polymerizable monomers (b) are used in combination, various composition ratios may be properly regulated according to the properties of the contemplated copolymer.

<Polymerization Method>

The resin particle may be produced by a process such as an emulsion polymerization process, a suspension polymerization process, a bulk polymerization process, a bulk-suspension polymerization process, a dispersion polymerization, a soap-free emulsion polymerization process, a seed emulsion polymerization process, a microemulsion polymerization process, a miniemulsion polymerization process, or a polymerization process using supercritical $CO_2$ or the like.

Specifically, for example, the resin particle can be produced by subjecting the silsesquioxane (a) and optionally the addition polymerizable monomer (b) to emulsion polymerization in an aqueous solvent. For some monomers, the resin particle can also be produced by soap-free polymerization that does not use an emulsifier.

Examples of emulsifiers usable in the emulsion polymerization include anionic surfactants such as straight chain or branched sodium alkylbenzenesulfonates, sodium alkyl sulfates, sodium alkyl ether sulfates, sodium α-sulfofatty acid esters, or sodium α-olefin sulfonates; and nonionic surfactants such as fatty acid alkanolamides, alkylamine oxides, polyoxyethylene alkyl ether, polyoxyethylene nonylphenyloxide, polyoxyethylene alkyl ether, or polyoxyethylene nonylphenyl ether.

Examples of polymerization initiators usable in the emulsion polymerization include radical polymerization initiators such as hydrogen peroxide, ammonium persulfate, potassium persulfate, 1-butyl hydroperoxide, 2,2'-azobisisobutyronitrile, 2,2'-azobis(2,4-dimethylvaleronitrile), 2,2'-azobis(2-butyronitrile), dimethyl-2,2'-azobisisobutyrate, 1,1'-azobis(cyclohexane-1-carbonitrile), 2,2'-azobis(2-methylpropionamide)dihydroxychloride, and 2,2'-azobis[2-(2-imidazolin-2-yl)propane]dihydroxychloride.

Solvents usable in the emulsion polymerization include water, a mixed liquid composed of water and a water soluble organic solvent, and other solvents Specific examples of water soluble solvents include alcohols such as methanol, ethanol, isopropanol, and n-propanol; amide compounds such as formamide and dimethylformamide; and polar solvents such as dioxane, acetonitrile and dimethyl sulfoxide.

The emulsion polymerization reaction may be carried out under temperature and reaction time conditions depending upon the monomer used and the type of the radical polymerization initiator used and other conditions. The polymerization can be carried out, for example, under conditions of polymerization reaction temperature 50° C. to 90° C. and polymerization reaction time 1 hr to 24 hr. The polymerization may also be carried out in an inert gas atmosphere such as nitrogen gas or argon gas.

The dispersion treatment of the resin particle may be carried out with any dispergator without particular limitation, and examples thereof include stirring devices with a rotor that is rotated at a high speed, microfluidization devices, ultrasonic dispergators, and mechanical, and pressure homogenizers.

The resin particle may be in an emulsion form, or alternatively may be in a powder form. The powder may be prepared, for example, by drying resin particles prepared by the above process.

The toner of the present invention is a toner produced by a process including the step of dissolving and/or dispersing a toner material containing at least a binder resin in an organic solvent to prepare a solution and/or dispersion liquid of the toner material, the step of adding the solution and/or dispersion liquid of the toner material to an aqueous medium for emulsification and/or dispersion to prepare an emulsion and/or dispersion liquid, and the step of removing the organic solvent from the emulsion and/or dispersion liquid. The toner is characterized in that, in the step of preparing the emulsion and/or dispersion liquid or the step of removing the organic solvent from the emulsion and/or dispersion liquid, a resin particle produced by polymerizing a silsesquioxane-containing addition polymerizable monomer is added to in an aqueous medium. Preferably, the resin particle is added at proper timing after the step of preparing the emulsion and/or dispersion liquid after the formation of particles having a size corresponding to a contemplated toner particle diameter.

Further, the toner of the present invention is a toner produced by a process including dissolving and/or dispersing a toner material including at least a binder resin and a colorant in a polymerizable monomer, emulsifying and/or dispersing the dissolved material or the dispersed material in an aqueous medium, and polymerizing the emulsion and/or dispersion liquid. The toner is characterized in that the resin particle is allowed to exist in the aqueous medium during the step of emulsification and/or dispersion or during the polymerization step. Preferably, the resin particle is added at proper timing after the dissolved material or dispersed material is emulsified and/or dispersed in the aqueous medium after the formation of particles having a size corresponding to a contemplated toner particle diameter.

Furthermore, the toner of the present invention is a toner produced by a process including dispersing a toner material including at least a binder resin and a colorant in an aqueous medium, coagulating the dispersed material in the aqueous medium, and heat-fusing the coagulates to one another. The toner is characterized in that resin particle is allowed to exist in the aqueous medium during the step of coagulation or during the step of heat fusing. Preferably, the resin particle is added at proper timing after the dispersed material is coagulated in the aqueous medium after the formation of particles having a size corresponding to a contemplated toner particle diameter.

In the step of preparing the emulsion and/or dispersion liquid, resin particles having an average particle diameter of 10 nm to 500 nm are added in the aqueous medium. Preferably, resin particles having an average particle diameter of 50 nm to 200 nm are added. Preferably, the resin particle is used preferably as an acrylic emulsion, contains silicon (Si) as a characteristic element and further contains fluorine (F). The resin particle may be added so that the resin particle is adhered onto the surface of the toner particle body in which the toner material constitutes the nucleus of the toner particle body. The timing for the addition of the resin particle may be as described above.

FIG. 1 is a typical diagram showing the state of the surface of the toner according to the present invention. Resin particles (3) are adhered onto the surface of a toner particle body (2) in a toner (1).

In the toner thus obtained, fine particles of a resin may be previously allowed to exist, in the aqueous medium, as a dispersion stabilizer having a smaller particle diameter than the resin particle. In the resultant toner, fine particles of the resin and resin particles are adhered on the surface of the toner particle body in which the toner material including the colorant and the binder resin constitutes the nucleus of the toner particle body. The fine particles of the resin, however, have a small particle diameter and thus are embedded in the toner particle body or are adhered to a portion between the toner particle body and the resin particle. Accordingly, when the toner is not observed microscopically, the toner looks as if resin particles are adhered on the surface of the toner particle body. The average particle diameter of the toner is regulated by selecting proper emulsification and/or dispersion conditions such as stirring of the aqueous medium in the step of emulsification.

In general, in an electrophotographic image forming apparatus, when a toner having a small particle diameter is used, non-electrostatic adhesion between the toner particle and the electrophotographic photoconductor or between the toner particle and the intermediate transfer member is increased and, thus, the transfer efficiency is further lowered. In particular, when the toner having a small particle diameter is used in a high-speed machine, it is known that, in addition to an increase in non-electrostatic adhesion between the toner particle and the intermediate transfer member due to the reduced particle diameter of the toner, due to speeding-up, the period of time for which the toner particle is exposed to a transfer electric field in a nip part in transfer, particularly in the nip part in the secondary transfer, is shortened, and, thus, the transfer efficiency in the secondary transfer is significantly lowered. In the toner produced by the production process according to the present invention, however, due to the fact that fine particles (resin particles) having a relatively large particle diameter are adhered on the surface of the toner and the fine particles having a large particle diameter have a certain hardness, the non-electrostatic adhesion of the toner particle is lowered and, thus, even when the transfer time is shortened as in the high-speed machine, satisfactory transfer efficiency can be realized without sacrificing the fixability. Further, since the fine particles having a large particle diameter have a satisfactory hardness, even when a temporal mechanical stress is large as in the high-speed machine, the fine particles having a large particle diameter adhered on the toner surface can exist without being embedded in the toner. Accordingly, a satisfactory transfer efficiency can be maintained for a long period of time. At the same time, the embedding of an external additive adhered on the toner surface can also be prevented.

When the resin particles are added before emulsification or after emulsification, in this timing, the organic solvent is present in liquid droplets of the toner composition. Accordingly, a desired form can be realized in which, after the adherence of the resin particle on the surface of a liquid droplet, the resin particle enters the liquid droplet from the surface thereof to some extent and, after the removal of the organic solvent, the resin particle is adhered and fixed on the surface of the toner.

The fine particle of the resin is adhered on the surface of the toner is and fused to and integrated with the surface of the toner to form a relatively hard surface. Accordingly, the embedding and movement of the adhered and fixed resin particle by the mechanical stress can be prevented. In many cases, polarity is imparted to the fine particle of the resin, and, thus, the fine particle of the resin can be adsorbed on the liquid droplet containing the toner material to suppress coalescence between the liquid droplets. This is important for regulating the particle size distribution of the toner. Further, the fine particle of the resin can impart a negative charging property to the toner. In order to attain these effects, the anionic fine particle of the resin has a smaller diameter than the resin particle and has an average particle diameter of 5 nm to 50 nm.

In order to attain the object of the present invention, preferably, the particle diameter of the toner is regulated so that the mass average particle diameter is 1 μm to 6 μm. In particular, the mass average particle diameter of the toner is more preferably 2 μm to 5 μm. When the mass average particle diameter of the toner is less than 1 μm, toner dust is likely to be produced in the primary transfer and the secondary transfer. On the other hand, when the mass average particle diameter of the toner is more than 6 μm, the dot reproducibility is unsatisfactory and the granularity of a halftone part is also deteriorated, making it impossible to form a high-definition image.

At least large fine particles (resin particles) having a volume average particle diameter of 10 nm to 500 nm should be adhered and fixed onto the surface of the toner. In particular, the adhesion and fixation of fine particles having a large particle diameter of 50 nm to 200 nm are preferred. By virtue of this, the non-electrostatic adhesion of the toner particles can be reduced by a spacer effect. Further, even when the temporal mechanical stress is large as in the high-speed machine, an increase in non-electrostatic adhesion by the embedding of the fine particles in the surface of the toner can be suppressed and, consequently, satisfactory transfer efficiency can be maintained for a long period of time. In particular, when an image forming process includes two transfer steps of a primary transfer step in an intermediate transfer system and a secondary transfer step, the toner produced by the production process of the present invention is very useful. The effect is particularly significant in a relatively high-speed image forming process (transfer linear velocity 300 mm/sec to 1,000 mm/sec, the time during transfer in secondary nip part 0.5 msec to 20 msec). In a process in which the linear velocity is lower or the secondary transfer time is shorter, the difference of the present invention and the toner with the resin particles not disposed on the surface thereof is not large. On the other hand, in higher-speed machines, degradation in transfer efficiency cannot be prevented without difficulties.

When the volume average particle diameter of the resin particle is smaller than 10 nm, the spacer effect is unsatisfactory and, consequently, the non-electrostatic adhesion of the toner particle cannot be reduced. Further, the temporal mechanical stress is large as in the high-speed machine, the resin particle or the external additive is likely to be embedded in the surface of the toner. In this case, there is a possibility that satisfactory transfer efficiency cannot be maintained for a long period of time. On the other hand, when the primary average particle diameter of the resin particle is larger than 500 nm, the fluidity of the toner is deteriorated and the even transferability is sometimes inhibited.

In general, in the toner filled into a developing machine, the fine particles of the resin on the surface of the toner are embedded within the toner by the mechanical stress mainly within the developing machine or are moved in concaves on the surface of the toner particle body and, consequently, the adhesion reduction effect is lost. Further, the external additive is exposed to a similar stress and is consequently embedded within the toner, and, thus, the adhesion of the toner is increased.

By contrast, the toner produced by the production process according to the present invention has a relatively large resin particle, and thus is less likely to be embedded in the toner particle body. In particular, the resin particle is preferably a fine particle of a crosslinked resin containing a styrene polymer, an acrylic acid ester polymer, or a methacrylic acid ester polymer. This resin particle is in a crosslinked state and thus is relatively hard. Accordingly, the resin particle is not deformed on the surface of the toner particle by the mechanical stress within the developing machine and can maintain the spacer effect. Thus, the embedding of the external additive can be prevented, and the resin particle is further suitable for maintaining the adhesion.

The binder resin is preferably a polyester resin. It is important that the binder resin is incompatible with the resin particle. The polyester resin is hardly compatible particularly when the resin particle is a fine particle of a crosslinked resin containing a styrene polymer, an acrylic acid ester polymer, or a methacrylic acid ester polymer. In the step of emulsification, when the resin particle is added before emulsification or after emulsification, the organic solvent or the polymerizable monomer is present within the liquid droplets of the toner material. Accordingly, disadvantageously, the resin particle is sometimes dissolved after the adhesion of the resin particle on the surface of the liquid droplets. When the resin component constituting the toner is polyester resin and the resin particle is a fine particle of a crosslinked resin containing a styrene polymer, an acrylic acid ester polymer, or a methacrylic acid ester polymer, the compatibility between the resins is so low that the resin particle is not compatible with liquid droplets of the toner material and is present in an adhered state on the liquid droplets. Accordingly, a desired form can be realized in which the resin particle enters the liquid droplets from the surface thereof to some extent and, after the removal of the organic solvent or the progress of the polymerization, the resin particle is adhered and fixed on the toner surface.

The resin particle may have a property of producing coagulates in an aqueous medium containing an ionic surfactant. In the production process of the present invention, when the resin particle is added before emulsification or after emulsification in the step of emulsification, the presence of the resin particle stably and independently without adherence onto liquid droplets of the toner material is unfavorable. When the resin particle has the property of producing coagulates in the aqueous medium containing an ionic surfactant, the resin particle present on the aqueous phase side during or after the emulsification can be moved onto the surface of the particle of the toner material and can easily be adhered onto the surface of the particle of the toner material. Specifically, in general, the resin particle is unstable and is coagulated in an aqueous medium containing an ionic surfactant. The presence of particles of the toner material results in the formation of a composite of dissimilar particles when the attraction force between the toner material and the liquid droplet is strong.

The resultant composite as such exhibits a high level of adhesion. The composite can be fixed more strongly on the surface of the toner by performing the step of heating after the movement of the resin particle to the surface of the toner material particle to allow the resin particle to be adhered onto the surface of the toner material particles after the emulsification. Preferably, the fixing temperature is above the glass transition temperature of the resin used in the toner.

The toner material preferably contains, as a binder resin precursor, an active hydrogen group-containing compound and a modified polyester resin reactive with the compound. When the active hydrogen group-containing compound and the modified polyester resin reactive with the compound are present in the liquid droplets of the toner material, the mechanical strength of the toner is enhanced and the embedding of the resin particle and the external additive can be suppressed. When the active hydrogen group-containing compound has a cationic polarity, the resin particle can be electrostatically attracted. Further, the fluidity of the toner in the heat fixation can be regulated, and the fixing temperature width can also be broadened.

The amount of the resin particle added is preferably 0.5% by mass to 5% by mass, particularly preferably 1% by mass to 4% by mass, based on 100% by mass of the toner. When the amount of the resin particle added is smaller than 0.5% by mass, the spacer effect is unsatisfactory and, consequently, the non-electrostatic adhesion of the toner particle cannot be reduced. On the other hand, when the amount of the resin particle added is larger than 5% by mass, the fluidity of the toner is deteriorated. As a result, the even transferability is inhibited, or the fine particle cannot be satisfactorily fixed to the toner and is likely to be separated. Therefore, there is a possibility that the fine particle is adhered on the carrier and the photoconductor or the like, possibly resulting in contamination of the photoconductor.

Preferably, regarding the toner, the hardness of the surface of a particle of a toner 1 as measured by a nanoindentation method is 1 GPa to 3 GPa, particularly 1.2 GPa to 2.6 GPa, and the hardness of the surface of a particle of a toner 1 as measured by a microindentation method is 40 $N/mm^2$ to 120 $N/mm^2$, particularly 60 $N/mm^2$ to 110 $N/mm^2$. The nanoindentation method measures micro hardness. Accordingly, the hardness as measured by the nanoindentation method expresses the hardness of the outermost surface of the toner. On the other hand, the microindentation method measures macro hardness. Accordingly, the hardness as measured by the microindentation method expresses the hardness of the whole toner. Therefore, the hardness of the particle surface of the toner 1 as measured by the nanoindentation method can be used as an index that expresses the level of difficulty of embedding of fine particles added to the surface of the toner.

When the hardness of the surface of the particle of the toner 1 as measured by the nanoindentation method is smaller than 1 GPa, fine particles added to the toner surface are likely to be embedded in the toner upon exposure to mechanical stress. When the hardness of the surface of the particle of the toner 1 as measured by the nanoindentation method is larger than 3 GPa, fine particles added to the toner surface is less likely to be embedded even upon exposure of the toner to mechanical stress. In this case, however, the toner surface is so hard that the toner cannot be satisfactorily melted in the fixation. Consequently, the fixability is likely to be deteriorated. Further, when the hardness of the surface of the particle of the toner 1 as measured by the nanoindentation method is 1 GPa to 3 GPa, the non-electrostatic adhesion of the toner particle is likely to be reduced even though the fine particles having a large particle diameter are not added. Whether the reason why the non-electrostatic adhesion is reduced in this case is a suitable level of adhesive property of the surface of the particle of the toner 1 or a suitable level of elasticity has not been elucidated yet. The combination of this property with the spacer effect attained by the fine particles having a large particle diameter can contribute to a further reduction in non-electrostatic adhesion of the toner particle. When the hardness of the surface of the particle of the toner 1 as measured by the nanoindentation method is not 1 GPa to 3 GPa, the tendency toward the reduction in nonelectrostattic adhesion of the toner particle is not observed when the fine particles having a large particle diameter are not added.

The hardness of the surface of the particle of the toner 1 as measured by the microindentation method can be used as an index that expresses the level of the difficulty in melting the toner in the fixation. When the hardness of the surface of the particle of the toner 1 as measured by the microindentation method is smaller than 40 $N/mm^2$, the whole particle of the toner 1 is soft. Accordingly, the fixability is good. However, for example, due to stirring in the developing part or the transfer pressure in the transfer part, the toner is likely to be deformed. As a result, the image quality becomes uneven. Further, when the toner particle contains a releasing agent such as wax, the releasing agent is precipitated and is spent in the carrier or the photoconductor and, consequently, contamination of the carrier or the photoconductor possibly occurs. When the hardness of the surface of the particle of the toner 1 as measured by the microindentation method is larger than 120 $N/mm^2$, the whole particle of the toner 1 is hard. Accordingly, even when the toner undergoes a mechanical stress, the fine particles added to the surface of the toner are less likely to be embedded in the toner. In this case, however, the toner surface is so hard that, in the fixation, the toner cannot be satisfactorily melted, possibly resulting in deteriorated fixability.

In order to suppress embedding of the resin particle and the external additive added to the toner surface by the mechanical stress and to suppress the deterioration in fixability, preferably, the toner is regulated so as to satisfy both the surface hardness range of the particle of the toner 1 as measured by the nanoindentation method and the surface hardness range of the particle of the toner 1 as measured by the microindentation method. In order to actually satisfy both the value ranges, preferably, the toner has such a structure that a spacer part by the resin particle is provided on the outermost surface, and the toner particle body is relatively soft, whereby separated function can be realized.

The average circularity of the toner produced by the production process according to the present invention is preferably 0.950 to 0.990. When the average circularity of the toner is less than 0.950, evenness of an image in the development is deteriorated, or the efficiency of transfer of the toner from the electrophotographic photoconductor to the intermediate transfer member or from the intermediate transfer member to the recording medium is lowered. Consequently, even transfer cannot be realized. According to the production process of the present invention, the toner is produced by emulsification treatment in an aqueous medium. This process is effective in reducing the particle diameter of the color toner and in realizing a toner shape having an average circularity in the above-defined range.

The ratio between the mass average particle diameter (Dw) and the number average particle diameter (Dn), i.e., Dw/Dn, in the toner produced by the production process according to the present invention is, for example, preferably 1.30 or less, more preferably 1.00 to 1.30. When the ratio between the mass average particle diameter (Dw) and the number average particle diameter (Dn), i.e., Dw/Dn, is less than 1.00, the following problems occur. Specifically, for a two-component developing agent, in stirring for a long period of time in a developing device, the toner is fused to the surface of the carrier, possibly leading to lowered charging ability of the carrier and deteriorated cleaning properties. For a one-component developing agent, filming of the toner on the development roller and the fusion of the toner on a member such as a blade, which is used for reducing the layer thickness of the toner, are sometimes likely to occur. On the other hand, when Dw/Dn exceeds 1.30, high-quality images with a high resolution cannot be formed without difficulties. In this case, when toner is introduced and discharged, that is, circulated, in a developing agent, a fluctuation in particle diameter of the toner is sometimes increased.

When a ratio between the mass average particle diameter (Dw) and the number average particle diameter (Dn), i.e., Dw/Dn, of the toner is 1.00 to 1.30, the resultant toner is excellent in all of storage stability, low-temperature fixability, and hot offset resistance. In particular, when the toner is used in a full color copying machine, the gloss of images is excellent. In the two-component developing agent, even when the toner is introduced and discharged for a long period of time, no significant fluctuation in toner particle diameter within the developing agent occurs and, consequently, good and stable developability can be realized even upon exposure to stirring for a long period of time in the developing device. For the one-component developing agent, even when the toner is introduced and discharged, a fluctuation in particle diameter of the toner can be reduced. Further, filming of the toner on the development roller and the fusion of the toner on a member such as a blade, which is used for reducing the layer thickness of the toner, do not occur. Accordingly, when the developing device is used (for stirring) for a long period of time, good and stable developability can be realized and, consequently, high-quality images can be provided, The particle diameter of the carrier used together with the toner produced by the production process according to the present invention is preferably 15 μm to 40 μm in terms of mass average particle diameter. When the particle diameter is smaller than 15 μm, carrier adherence, which is a phenomenon that the carrier is also disadvantageously transferred in the step of transfer, is likely to occur.

On the other hand, when the particle diameter is larger than 40 μm, the carrier adherence is less likely to occur. In this case, however, when the toner density is increased to provide a high image density, there is a possibility that smear is likely to occur. Further, when the dot diameter of the latent image is small, a variation in dot reproducibility is so large that the granularity in a highlight part is likely to be deteriorated.

The full-color image forming method according to the present invention includes a charging step of charging an electrophotographic photoconductor by a charging unit, an exposure step of forming a latent electrostatic image by an exposing unit on the charged electrophotographic photoconductor, a development step of forming a toner image on the electrophotographic photoconductor with the latent electrostatic image formed thereon by a developing unit including a toner, a primary transfer step of transferring the toner image formed on the electrophotographic photoconductor onto an intermediate transfer member by a primary transfer unit, a secondary transfer step of transferring the toner image, which has been transferred onto the intermediate transfer member, onto a recording medium by a secondary transfer unit, a fixation step of fixing the toner image, transferred onto the recording medium, onto the recording medium by a fixing unit including heating and pressure fixation member, and a cleaning step of removing, by cleaning using a cleaning unit, toner remaining untransferred and adhered onto the surface of the electrophotographic photoconductor, from which the toner image has been transferred onto the intermediate transfer member by the primary transfer unit. The toner present in the development step is the toner according to the present invention. In this full-color image forming method, preferably, the linear velocity of transfer of the toner image onto the recording medium in the secondary transfer step, that is, the so-called printing speed, is 300 mm/sec to 1,000 mm/sec, and the time during the transfer in the nip part in the secondary transfer unit is 0.5 msec to 20 msec.

Further, the full-color image forming method according to the present invention is preferably of a tandem type including a plurality of sets of an electrophotographic photoconductor, a charging unit, an exposing unit, a developing unit, a primary transfer unit, and a cleaning unit. In the so-called tandem type in which a plurality of electrophotographic photoconductors are provided, and development is carried out one color by one color upon each rotation, a latent image formation step and a development/transfer step are carried out for each color to form each color toner image. Accordingly, the difference in speed between single color image formation and full color image formation is so small that the tandem type can advantageously cope with high-speed printing. In this case, the color toner images are formed on respective separate electrophotographic photoconductors, and the color toner layers are stacked (color superimposition) to form a full color image. Accordingly, when a variation in properties, for example, a difference, for example, in charging characteristics between color toner particles exists, a difference in amount of the development toner occurs between the individual color toner particles. As a result, a change in hue of secondary color by color superimposition is increased, and the color reproducibility is lowered.

The toner used in the image forming method by the tandem type should satisfy the requirements that the amount of the development toner for regulating the balance of the colors is stabilized (no variation in development toner amount between individual color toner particles), and the adherence to the electrophotographic photoconductor and to the recording medium is even between the individual color toner particles. From this viewpoint, the toner according to the present invention is suitable.

Preferably, the charging unit applies at least a direct current voltage obtained by superimposing alternating voltages. The application of the direct current voltage obtained by superimposing the alternating voltages can stabilize the surface voltage of the electrophotographic photoconductor to a desired value as compared with the application of only a direct current voltage. Accordingly, further even charge can be realized. Further, preferably, the charging unit performs charging by bringing a charging member into contact with the electrophotographic photoconductor and applying the voltage to the charging member. When charging is carried out by bringing the charging member into contact with the electrophotographic photoconductor and applying the voltage to the charging member, particularly the effect of even charging properties attained by applying the direct current voltage obtained by superimposing alternating voltages can be further improved.

The fixing unit includes a heating roller that is formed of a magnetic metal and is heated by electromagnetic induction, a fixation roller disposed parallel to the heating roller, an endless belt-like toner heating medium (a heating belt) that is taken across the heating roller and the fixation roller, is heated by a heating roller, and is rotated by these rollers, and a pressure roller that is brought into pressure contact with the fixation roller through the heating belt and is rotated in a forward direction relative to the heating belt to form a fixation nip part. This construction can realize a temperature rise in the fixation belt in a short time and can realize stable temperature control. Further, even when a recording medium having a rough surface is used, during the fixation, the fixation belt acts in conformity to the surface of the transfer paper to some extent and, consequently, satisfactory fixability can be realized.

The fixing unit is preferably an oilless type or a minimal oil-coated type. To this end, preferably, the toner particle to be fixed contains a releasing agent (wax) in a finely dispersed state in the toner particle. In the toner in which a releasing agent is finely dispersed in the toner particle, the releasing agent is likely to ooze out during fixation. Accordingly, in the oilless fixing device or even when an oil coating effect has becomes unsatisfactory in the minimal oil-coated fixing device, the transfer of the toner to the belt side can be suppressed. In order that the releasing agent is present in a dispersed state in the toner particle, preferably, the releasing agent and the binder resin are not compatible with each other. The releasing agent can be finely dispersed in the toner particle, for example, by taking advantage of the shear force of kneading in the production of the toner. Whether the releasing agent is in a dispersed state can be determined by observing a thin film section of the toner particle under TEM. The dispersion diameter of the releasing agent is preferably small. However, when the dispersion diameter is excessively small, oozing during the fixation is sometimes unsatisfactory. Accordingly, when the releasing agent can be observed at a magnification of 10,000 times, it can be determined that the releasing agent is present in a dispersed state. When the releasing agent is so small that the releasing agent cannot be observed at a magnification of 10,000 times, oozing of the releasing agent during the fixation is sometimes unsatisfactory even when the releasing agent is finely dispersed in the toner particle.

[Method for Measuring Toner Properties]

<Mass Average Particle Diameter Dw, Volume Average Particle Diameter Dv and Number Average Particle Diameter Dn>

The mass average particle diameter (Dw), the volume average particle diameter (Dv) and the number average particle diameter (Dn) of the toner are measured using a particle size analyzer (Multisizer III, product of Beckman Coulter Co.) with the aperture diameter being set to 100 μm, and the obtained measurements are analyzed with an analysis software (Beckman Coulter Multisizer 3 Version 3.51.). Specifically, a 10% by mass surfactant (alkylbenzene sulfonate, Neogen SC-A, product of Daiichi Kogyo Seiyaku Co.) (0.5 mL) is added to a 100 mL-glass beaker, and a toner sample (0.5 g) is added thereto, followed by stirring with a microspartel. Subsequently, ion-exchange water (80 mL) is added to the beaker, and the obtained dispersion is dispersed with an ultrasonic wave disperser (W-113MK-II, product of Honda Electronics Co.) for 10 min. The resultant dispersion is measured using the above Multisizer III and Isoton III (product of Beckman Coulter Co.) serving as a solution for measurement. The dispersion containing the toner sample is dropped so that the concentration indicated by the meter falls within a range of 8% by mass ±2% by mass. Notably, in this method, it is important that the concentration is adjusted to 8% by mass ±2% by mass, considering attaining measurement reproducibility with respect to the particle diameter. No measurement error is observed, as long as the concentration falls within the above range.

<Average Circularity>

The average circularity of the toner is defined by the following equation.

Average circularity SR=Circumferential length of a circle having the same area as projected particle area/Circumferential length of projected particle image×100

The average circularity of the toner is measured using a flow-type particle image analyzer FPIA-2100 (product of Sysmex Corp.), and analyzed using an analysis software (FPIA-2100 Data Processing Program For FPIA Version00-10). Specifically, into a 100 mL glass beaker, 0.1 mL to 0.5 mL of a 10% by mass surfactant (NEOGEN SC-A, which is an alkylbenzene sulfonate, produced by Dai-ichi Kogyo Seiyaku Co., Ltd.) is added, 0.1 g to 0.5 g of the toner is added, the ingredients are stirred using a microspatula, then 80 mL of ion-exchanged water is added. The obtained dispersion liquid is subjected to a dispersion treatment for 3 min using an ultrasonic wave dispersing device (manufactured by HONDA ELECTRONICS). Using FPIA-2100 mentioned above, the shape and distribution of toner particles are measured until the dispersion liquid has a concentration of 5,000 (number per μl) to 15,000 (number per μl). In this measuring method, it is important in terms of reproducibility in measuring the average circularity that the above-mentioned dispersion liquid concentration be kept in the range of 5,000 number per μl to 15,000 number per μl. To obtain the above-mentioned dispersion liquid concentration, it is necessary to change the conditions of the dispersion liquid, namely the amount of the surfactant added and the amount of the toner. As in the above-mentioned measurement of the particle diameter of the toner, the required amount of the surfactant varies depending upon the hydrophobicity of the toner; when the surfactant is added in large amounts, noise is caused by foaming, and when the surfactant is added in small amounts, the toner cannot be sufficiently wetted, thereby leading to insufficient dispersion. Also, the amount of the toner added varies depending upon its particle diameter; when the toner has a small particle diameter, it needs to be added in small amounts, and when the toner has a large particle diameter, it needs to be added in large amounts. In the case where the toner particle diameter is 3 μm to 7 μm, the dispersion liquid concentration can be adjusted to the range of 5,000 (number per μl) to 15,000 (number per μl) by adding 0.1 g to 0.5 g of the toner.

<Nanoindentation Method>

When the hardness of the surface of the particle of the toner 1 is measured by the nanoindentation method, a TRIBOINDENTER manufactured by HYSITRON INC. is used. Detailed conditions are as follows.

Indenter used: Berkovich (triangular pyramid)

Maximum indentation depth: 20 nm

Under the above conditions, the indenter is indented from the surface of the particle of the toner 1, and the hardness H [GPa] is measured from the size of the dent at the maximum indentation. In actual measurement, the hardness was measured for 100 toner particles in a product form (for one particle, the hardness was measured at N=10 with varied measurement sites followed by averaging of the measured values), and the data were averaged to determine the hardness of the particle of the toner 1 as measured by the nanoindentation method.

<Microindentation Method>

When the hardness of the surface of the particle of the toner 1 is measured by the microindentation method, FISCHERSCOPE H100 (a microhardness testing system, manufactured by Fischer Instruments K.K. is used. Detailed conditions are as follows.

Indenter used: Vickers indenter

Maximum indentation depth: 2 μm

Maximum indentation load: 9.8 mN

Creep time: 5 sec

Loading (unloading) time: 30 sec

Under the above conditions, the Vickers indenter is indented from the surface of the particle of the toner 1 to measure Martens hardness [N/mm$^2$]. In actual measurement, the hardness was measured for 100 toner particles in a product form and the data were averaged to determine the hardness of the particle of the toner 1 as measured by the microindentation method.

[Method for Measuring Carrier Properties]

<Mass Average Particle Diameter Dw>

The mass average particle diameter Dw of the carrier is found on the basis of the particle size distribution of the particles measured on a number basis i.e. the relation between the number based frequency and the particle diameter. In this case, the mass average particle diameter Dw is represented by Equation (1):

$$Dw=\{1/\Sigma(nD^3)\}\times\{\Sigma(nD^4)\} \quad \text{Equation (1)}$$

where D represents a typical particle diameter (μm) of particles residing in each channel, and "n" represents the number of particles residing in each channel. It should be noted that each channel is a length for equally dividing the range of particle diameters in the particle size distribution chart, and 2 μm can be employed for each channel in the present invention. For the typical particle diameter of particles residing in each channel, the lower limit value of particle diameters of the respective channels can be employed.

In addition, the number average particle diameters Dp of the carrier or the core material particles are determined according to the particle diameter distribution measured on a number standard. The number average particle diameter Dp is determined by Equation (2):

$$Dp=(1/\Sigma N)\times\{\Sigma nD\} \quad \text{Equation (2)}$$

where N represents the total number of particles measured, "n" represents the total number of particles present in each channel and D represents the minimum particle diameter of the particles present in each channel (2 μm).

For a particle size analyzer used for measuring the particle size distribution in the present invention, a micro track particle size analyzer (Model HRA9320-X100, manufactured by Honewell Corp.) is used. The evaluation conditions are as follows.

(I) Scope of particle diameters: 100 μm to 8 μm (II) Channel length (width): 2 μm (III) Number of channels: 46

(IV) Refraction index: 2.42

The BET specific surface area of the toner was measured with an automatic specific surface area/pore distribution measuring device TRISTAR 3000 (SHIMADZU CORPORATION). 1 g of the toner was placed in a dedicated cell, and the inside of the dedicated cell was degassed using a degassing dedicated unit for TRISTAR, VACUPREP 061 (SHIMADZU CORPORATION). The degassing treatment was carried out at room temperature at least for 20 hr under the condition of reduced pressure at equal to or less than 100 mtorr. The dedicated cell subjected to the degassing treatment can be automatically subjected to the BET specific surface area measurement with TRISTAR 3000. Nitrogen gas was used as absorbing gas.

The saturated charge amount of the toner is measured with a V blow-off device (RICOH SOZO KAIHATU K.K.). The toner and the carrier are allowed to stand as a developing agent having a toner concentration of 7% by mass in a predetermined environment (temperature and humidity) for 2 hr. The developing agent is then placed in a metallic gauge and mixed by stirring in a stirring device at 285 rpm for 600 sec. 1 g of the developing agent was weighed from 6 g of the initial agent, and the charge amount distribution of the toner is measured by a single mode method with a V blow-off device (RICOH SOZO KAIHATU K.K.). At the time of blow, an opening of 635 mesh is used. In the single mode method, the V blow-off device (RICOH SOZO KAIHATU K.K.) is provided, a single mode is selected according to an instruction manual, and measurement is performed under conditions of height 5 mm, suction 100, and blow twice.

Embodiment of the production process of a toner according to the present invention will be described in more detail. However, it should be noted that the present invention is not limited to the production process of the toner exemplified here.

[Production Process of Toner]

A coagulation process, a dissolution suspension process, and a suspension polymerization process may be mentioned as the production process of a toner according to the present invention. These processes will be described.

(Coagulation Process)

A water soluble polymerization initiator and a polymerizable monomer are emulsified in water with a surfactant, and a latex is synthesized, for example, by a conventional emulsion polymerization process or resin dispersion production process. Separately, a dispersion containing a colorant, a releasing agent and the like dispersed in an aqueous medium is provided. After mixing, coagulation is performed to form coagulates having a size corresponding to a contemplated toner size followed by heat fusing to give a toner.

The toner according to the present invention is a toner produced by dispersing a toner material including at least a binder resin and a colorant in an aqueous medium and coagulating the dispersion liquid in an aqueous medium, and heat-fusing the coagulates to one another. The toner is characterized in that a resin particle is allowed to exist in the aqueous medium during the coagulation step or the heat fusion step. Preferably, the resin particle may be added at timing after coagulation of the dispersion in the aqueous medium after the formation of particles having a size corresponding to a contemplated toner particle diameter.

The toner according to the present invention is produced, for example, by mixing the produced resin particle dispersion with a colorant particle dispersion and a releasing agent particle dispersion, further adding a coagulating agent to cause hetero coagulation and thus to form coagulated particles having a diameter corresponding to a contemplated toner diameter, then raising the temperature to a temperature at or above the glass transition point of the resin particle or to a temperature at or above the melting point to fuse and unite the coagulated particles, and washing and drying the fused and united particles. Shapes ranging from irregular shapes to spherical shapes are preferred as the shape of the toner. Suitable coagulating agents include surfactants and, further, inorganic salts, divalent or higher metallic salts. The use of a metal salt is particularly preferred from the viewpoints of the regulation of coagulation properties and toner charging properties.

In the coagulation step, a method may also be adopted in which the resin particle dispersion according to the present invention and the colorant particle dispersion are previously coagulated to form first coagulated particles, and the resin particle dispersion according to the present invention or a different resin particle dispersion are then further added to form a second shell layer on the surface of the first particles.

In the present invention, the coagulated particles may be formed by any method without particular limitation. For example, a conventional coagulation process commonly used in an emulsion polymerization coagulation process for electrostatic charge image development and a toner may be used. For example, a method may be adopted in which the stability of the emulsion is reduced, for example, by temperature raising, pH change, or salt addition followed by stirring, for example, with a diperser. Further, after coagulation treatment, the surface of the particles may be crosslinked, for example, by heat treatment from the viewpoint of suppressing oozing of the colorant from the surface of the particles. The surfactant and the like used may if necessary be removed, for example, by washing with water, acid washing, or alkali washing.

If necessary, charge controlling agents used in this type of toner may be used in the production process of the electrostatic image development toner according to the present invention. In this case, the charge controlling agent may be used as an aqueous dispersion, for example, when the production of the monomer particle emulsion is initiated, when the polymerization is initiated, or when the coagulation of the resin particle is initiated. The amount of the charge controlling agent added is preferably 1 part by mass to 25 parts by mass, more preferably 5 parts by mass to 15 parts by mass, based on 100 parts by mass of the monomer or the polymer.

(Dissolution Suspension Process)

The polymer suspension process is a process including dissolving and/or dispersing a toner material composed mainly of a binder resin or a binder resin precursor and a colorant in an organic solvent to form a solution and/or dispersion, optionally emulsifying and/or dispersing the solution and/or dispersion in an aqueous medium containing fine particles of a resin to prepare an emulsion and/or dispersion liquid, granulating the emulsion and/or dispersion liquid, and making resin particles adhere onto the toner precursor containing the emulsified and/or dispersed toner material to produce a desired toner. Preferably, a desired toner is produced by emulsifying and/or dispersing a solution and/or dispersion liquid of a toner material containing an active hydrogen group-containing compound and a polymer reactive with the active hydrogen group-containing compound in an aqueous medium, reacting the active hydrogen group-containing compound with the polymer reactive with the active hydrogen group-containing compound in the aqueous medium to give toner precursor particles containing an adhesive base material, and adhering resin particles on the toner precursor particles.

The toner of the present invention is a toner produced by a process including the step of dissolving and/or dispersing a toner material containing at least a binder resin in an organic solvent to prepare a solution and/or dispersion liquid of the toner material, the step of adding the solution and/or dispersion liquid of the toner material to an aqueous medium for emulsification and/or dispersion to prepare an emulsion and/or dispersion liquid, and the step of removing the organic solvent from the emulsion and/or dispersion liquid. The toner is characterized in that, in the step of preparing the emulsion and/or dispersion liquid or the step of removing the organic solvent from the emulsion and/or dispersion liquid, a resin particle produced by polymerizing a silsesquioxane-containing addition polymerizable monomer is added to in an aqueous medium. Preferably, the resin particle is added at proper timing after the step of preparing the emulsion and/or dispersion liquid after the formation of particles having a size corresponding to a contemplated toner particle diameter.

(Suspension Polymerization Process)

The suspension polymerization process is that, in the polymer suspension process described above, in addition to the binder resin, an oil soluble polymerization initiator is used, a colorant, a releasing agent and the like are dispersed in a polymerizable monomer, emulsion and/or dispersion is performed in an aqueous medium containing a surfactant and other solid dispersant or the like by an emulsification and/or dispersion method which will be described later, and a polymerization reaction is then allowed to proceed to prepare particles. Also in this method, the resin particle can be adhered onto the surface of the toner.

The toner of the present invention is a toner produced by a process including dissolving and/or dispersing a toner material containing at least a binder resin and a colorant in a polymerizable monomer, emulsifying and/or dispersing the solution and/or dispersion liquid in an aqueous medium, removing the organic solvent from the emulsion and/or dispersion liquid, and polymerizing the emulsion and/or dispersion liquid, wherein resin particles are allowed to exist in the aqueous medium during the emulsification and/or dispersion step or during the polymerization. Preferably, the resin particle is added at proper timing after emulsification and/or dispersion of the solution and/or dispersion liquid in the aqueous medium after the formation of particles having a size corresponding to a contemplated toner particle diameter.

(Solution and/or Dispersion Liquid of Toner Material)

A solution and/or dispersion liquid of a toner material is produced by dissolving and/or dispersing a toner material in a solvent. Materials contained in the toner are not particularly limited as long as they can form toner and may be suitably selected according to the purpose. For example, the toner material includes a binder resin or an active hydrogen group-containing compound, a polymer (prepolymer) reactive with the active hydrogen group-containing compound and a colorant, and may further include other components such as a releasing agent, a charge controlling agent, and the like according to need. The solution and/or a dispersion liquid of the toner material is preferably prepared by dissolving the toner material in an organic solvent, and/or dispersing the toner material in a polymerizable monomer. The organic solvent is removed during or after formation of toner particles.

(Organic Solvent)

The organic solvent is not particularly limited as long as the organic solvent allows the toner material to be dissolved or dispersed therein, and may be suitably selected according to the purpose. It is preferable that the organic solvent be a solvent having a boiling point of less than 150° C. in terms of easy removal during or after formation of toner particles. Specific examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methylacetate, ethylacetate, methyl ethyl ketone, methyl isobutyl ketone, and the like. Among these solvents, ester solvents are preferable, and ethyl acetate is particularly preferable. These solvents may be used alone or in combination. The amount of organic solvent is not particularly limited and may be selected suitably selected according to the purpose; preferably, the amount is 40 parts by mass to 300 parts by mass, more preferably 60 parts by mass to 140 parts by mass, and particularly preferably 80 parts by mass to 120 parts by mass based on 100 parts by mass of the toner material. The solution and/or a dispersion liquid of the toner material can be prepared by dissolving and/or dispersing in the organic solvent the toner materials such as the active hydrogen group-containing compound, polymer reactive with the active hydrogen group-containing compound, a non-modified polyester resin the colorant, the releasing agent, and the charge controlling agent. The toner materials except for the polymer reactive with the active hydrogen group-containing compound (prepolymer) can be added and mixed to the aqueous medium when the resin fine particles are dispersed in the aqueous medium to prepare the aqueous medium described later, or can be added to the aqueous medium together with the solution and/or dispersion liquid when the solution and/or a dispersion liquid of the toner material is added to the aqueous medium.

(Aqueous Medium)

The aqueous medium is not particularly limited and may be suitably selected from known ones, and is exemplified by water, water-miscible solvents, and combinations thereof. Among these, water is particularly preferable. The water-miscible solvent is not particularly limited, as long as being miscible with water; examples thereof include alcohols, dimethylformamide, tetrahydrofuran, cellosolves, lower ketones, and the like. Examples of alcohols include methanol, isopropanol, ethylene glycol, and the like. Examples of lower ketones include acetone, methyl ethyl ketone, and the like. These may be used alone or in combination.

The aqueous medium may be prepared, e.g., trough dispersing resin fine particles in the aqueous medium in the presence of an anionic surfactant. The amounts of the resin fine particles and anionic surfactant added to the aqueous medium are not particularly limited and may be suitably adjusted according to the purpose; preferably, each of the amounts is 0.5% by mass to 10% by mass. Then, the resin fine particles are added in the aqueous medium. When the rein fine particles have coagulation property with the anionic surfactant, the aqueous medium is preferably dispersed using a high-speed shear disperser before emulsification.

(Emulsification and/or Dispersion)

The solution and/or a dispersion liquid of the toner material is preferably emulsified and/or dispersed in an aqueous medium by dispersing the solution and/or dispersion liquid of the toner material in the aqueous medium while stirring. A dispersion method is not particularly limited and may be suitably selected according to the purpose. For example, known dispersers may be used for dispersion. Examples of dispersers include low-speed shear dispersers and high-speed shear dispersers. In the toner production method, the active hydrogen group-containing compound and the polymer reactive with the active hydrogen group-containing compound are subjected to elongation reaction and/or crosslinking reaction upon emulsification and/or dispersion, so as to form an adhesive base material. The resin particles may be added in the aqueous medium during or after emulsification and/or dispersion. The resin particles are added either by dispersing using the high-speed shear disperser or after emulsification and/or dispersion by the low-speed shear disperser switched from the high-speed shear disperser, while observing adhesion or fixation state of the resin particles to the toner.

(Binder Resin)

A binder resin preferably exhibits adhesiveness to a recording medium such as paper, and contains an adhesive polymer obtained by reaction of the active hydrogen group-containing compound with the polymer reactive with the active hydrogen group-containing compound in an aqueous medium. The weight average molecular weight of the binder resin is not particularly limited and may be suitably selected according to the purpose. It is preferably 3,000 or more, more preferably 5,000 to 1,000,000, particularly preferably 7,000 to 500,000.

Because the weight average molecular weight is less than 3,000, the hot offset resistance may deteriorate.

The glass transition temperature of the binder resin (Tg) is not particularly limited and may be suitably selected according to the purpose. The glass transition temperature of the binder resin is preferably 30° C. to 70° C., more preferably 40° C. to 65° C. The reason for this is that, when the glass transition temperature (Tg) is in the above-defined glass transition temperature range, satisfactory low-temperature fixability can be realized without causing a deterioration in heat-resistant storage stability of the toner. In the electrophotographic toner in this embodiment, a polyester resin subjected to a crosslinking reaction and an elongation reaction coexist. Accordingly, even when the glass transition temperature is below the glass transition temperature of the conventional toner better storage stability can be realized as compared with the conventional polyester toner.

The glass transition temperature (Tg) as used herein is determined in the following manner using TA-60WS and DSC-60 (Shimadzu Corp.) as a measuring device under the conditions described below.

Measurement Conditions

Sample container: aluminum sample pan (with a lid)
Sample amount: 5 mg
Reference: aluminum sample pan (10 mg of alumina)
Atmosphere: nitrogen (flow rate: 50 ml/min)
Temperature condition:
Start temperature: 20° C.
Heating rate: 10° C./min
Finish temperature: 150° C.
Hold time: 0
Cooling rate: 10° C./min
Finish temperature: 20° C.
Hold time: 0
Heating rate: 10° C./min
Finish temperature: 150° C.

The measured results are analyzed using the above-mentioned data analysis software (TA-60, version 1.52) available from Shimadzu Corporation.

The analysis is performed by appointing a range of ±5° C. around a point showing the maximum peak in the lowest temperature side of DrDSC curve, which was the differential curve of the DSC curve in the second heating, and determining the peak temperature using a peak analysis function of the analysis software. Then, the maximum endotherm temperature of the DSC curve was determined in the range of the above peak temperature +5° C. and −5° C. in the DSC curve using a peak analysis function of the analysis software. The temperature shown here corresponds to Tg of the toner.

The binder resin contained in the toner is not particularly limited and may be suitably selected according to the purpose. Suitable examples thereof include polyester resins. The polyester resin is not particularly limited and may be suitably selected according to the purpose. Suitable examples thereof include urea-modified polyester resins, and non-modified polyester resins. The urea-modified polyester resin is obtained by reacting amines (B) as the active hydrogen group-containing compound and an isocyanate group containing polyester prepolymer (A) as the polymer reactive with the active hydrogen group-containing compound, in the aqueous medium. The urea-modified polyester resin may contain a urethane bonding, as well as a urea bonding. In this case, a molar ratio (urea bonding/urethane bonding) of the urea bonding to the urethane bonding is not particularly limited and may be suitably selected according to the purpose. It is preferably 100/0 to 10/90, more preferably 80/20 to 20/80, particularly preferably 60/40 to 30/70. In the case where the molar ratio of the urea bonding is less than 10, the hot offset resistance may be deteriorated.

Examples of the urea-modified polyester resin and the non-modified polyester resin include as follows.

(1) a mixture of a polycondensation product of bisphenol A ethyleneoxide (2 mol) adduct and isophthalic acid; and a compound obtained by urea-modifying a polyester prepolymer with isophorone diamine, wherein the polyester prepolymer is obtained by reacting a polycondensation product of bisphenol A ethyleneoxide (2 mol) adduct and isophthalic acid with isophorone diisocyanate.

(2) a mixture of a polycondensation product of bisphenol A ethyleneoxide (2 mol) adduct and terephthalic acid; and a compound obtained by urea-modifying a polyester prepolymer with isophorone diamine, wherein the polyester prepolymer is obtained by reacting a polycondensation product of bisphenol A ethyleneoxide (2 mol) adduct and isophthalic acid with isophorone diisocyanate.

(3) a mixture of a polycondensation product of bisphenol A ethyleneoxide (2 mol) adduct, bisphenol A propyleneoxide (2 mol) adduct, and terephthalic acid; and a compound obtained by urea-modifying a polyester prepolymer with isophorone diamine, wherein the polyester prepolymer is obtained by reacting a polycondensation product of bisphenol A ethyleneoxide (2 mol) adduct, of bisphenol A propyleneoxide (2 mol) adduct, and terephthalic acid with isophorone diisocyanate.

(4) a mixture of a polycondensation product of bisphenol A propyleneoxide (2 mol) adduct, and terephthalic acid; and a compound obtained by urea-modifying a polyester prepolymer with isophorone diamine, wherein the polyester prepolymer is obtained by reacting a polycondensation product of bisphenol A ethyleneoxide (2 mol) adduct, bisphenol A propyleneoxide (2 mol) adduct, and terephthalic acid with isophorone diisocyanate.

(5) a mixture of a polycondensation product of bisphenol A ethyleneoxide (2 mol) adduct, and terephthalic acid; and a compound obtained by urea-modifying a polyester prepolymer with hexamethylene diamine, wherein the polyester prepolymer is obtained by reacting a polycondensation product of bisphenol A ethyleneoxide (2 mol) adduct, and terephthalic acid with isophorone diisocyanate.

(6) a mixture of a polycondensation product of bisphenol A ethyleneoxide (2 mol) adduct, bisphenol A propyleneoxide (2 mol) adduct, and terephthalic acid; and a compound obtained by urea-modifying a polyester prepolymer with hexamethylene diamine, wherein the polyester prepolymer is obtained by reacting a polycondensation product of bisphenol A ethyleneoxide (2 mol) adduct, and terephthalic acid with isophorone diisocyanate.

(7) a mixture of a polycondensation product of bisphenol A ethyleneoxide (2 mol) adduct, and terephthalic acid; and a compound obtained by urea-modifying a polyester prepolymer with ethylene diamine, wherein the polyester prepolymer is obtained by reacting a polycondensation product of bisphenol A ethyleneoxide (2 mol) adduct, and terephthalic acid with isophorone diisocyanate.

(8) a mixture of a polycondensation product of bisphenol A ethylene oxide (2 mol) adduct, and isophthalic acid; and a compound obtained by urea-modifying a polyester prepolymer with hexamethylene diamine, wherein the polyester prepolymer is obtained by reacting a polycondensation product of bisphenol A ethyleneoxide (2 mol) adduct, and isophthalic acid with diphenylmethane diisocyanate.

(9) a mixture of a polycondensation product of bisphenol A ethyleneoxide (2 mol) adduct, bisphenol A propyleneoxide (2 mol) adduct, and terephthalic acid; and a compound obtained by urea-modifying a polyester prepolymer with hexamethylene diamine, wherein the polyester prepolymer is obtained by reacting a polycondensation product of bisphenol A ethyleneoxide (2 mol) adduct, bisphenol A propyleneoxide (2 mol) adduct, terephthalic acid, and dodecenylsuccinic anhydride with diphenylmethane diisocyanate.

(10) a mixture of a polycondensation product of bisphenol A ethyleneoxide (2 mol) adduct, and isophthalic acid; and a compound obtained by urea-modifying a polyester prepolymer with hexamethylene diamine, wherein the polyester prepolymer is obtained by reacting a polycondensation product of bisphenol A ethyleneoxide (2 mol) adduct, and isophthalic acid with toluene diisocyanate.

The urea-modified polyester is generated, for example, by the following manners (1)-(3):

(1) The solution and/or a dispersion liquid of the toner material containing the polymer reactive with the active hydrogen group-containing compound (e.g. the isocyanate group containing polyester prepolymer (A)) is emulsified and/or dispersed in the aqueous medium phase together with the active hydrogen group-containing compound (e.g. the amine (B)) so as to form oil drolets, and these two compounds are allowed to proceed the elongation reaction and/or crosslinking reaction in the aqueous medium to thereby generate the urea-modified polyester.

(2) The solution and/or a dispersion liquid of the toner material is emulsified and/or dispersed in the aqueous medium, which has been previously added with the active hydrogen group-containing compound, so as to form oil droplets, and these two compounds are allow to proceed the elongation reaction and/or crosslinking reaction in the aqueous medium phase to thereby generate the urea-modified polyester.

(3) The solution and/or a dispersion liquid of the toner material is added and mixed in the aqueous medium, the active hydrogen group-containing compound is added thereto so as to form oil drolets, and these two compounds are allow to proceed the elongation reaction and/or crosslinking reaction from the surfaces of the particles in the aqueous medium phase to thereby generate the urea-modified polyester. In the case of (3), the modified polyester is preferentially generated at the surface of the toner to be generated, and thus the concentration gradation of the modified polyester can be provided within the toner particles.

The reaction conditions for generating the binder resin by the emulsification and/or dispersion are not particularly limited and may be suitably selected depending on the combination of the active hydrogen group-containing compound and the polymer reactive with the active hydrogen group-containing compound. The reaction duration is preferably 10 minutes to 40 hours, more preferably 2 hours to 24 hours.

The method for stably forming the dispersing elements containing the polymer reactive with the active hydrogen group-containing compound (e.g. the isocyanate group containing polyester prepolymer (A)) in the aqueous medium is such that the toner solution, which is prepared by dissolving and/or dispersing the toner material containing the polymer reactive with the active hydrogen group-containing compound (e.g. the isocyanate group containing polyester prepolymer (A)), the colorant, the releasing agent, the charge controlling agent, the non-modified polyester, and the like, is added into the aqueous medium, and then dispersed by shearing force.

In emulsification and/or dispersion, the amount of the aqueous medium added is preferably 50 parts by mass to 2,000 parts by mass, particularly preferably 100 parts by mass to 1,000 parts by mass, based on 100 parts by mass of the toner material. When the amount of the aqueous medium added falls within the above range, it excels in the dispersion state of the toner material, toner particles having predetermined particle diameter can be obtained, and the production cost falls within an appropriate range.

For the aqueous medium, the following inorganic dispersant and polymer protective colloid may be used in combination, in addition to the surfactant and resin fine particles.

Examples of the inorganic dispersant having poor water solubility include tricalcium phosphate, calcium carbonate, titanium oxide, colloidal silica, and hydroxyapatite.

Examples of the polymer protective colloid include acids, (meth)acrylic monomers having a hydroxyl group, vinyl alcohols or ethers of vinyl alcohol, esters of vinyl alcohol and compounds having a carboxyl group, amide compounds or methylol compounds thereof, chlorides, homopolymers or copolymers having a nitrogen atom or alicyclic ring thereof, polyoxyethylene, and celluloses. Examples of the acids include acrylic acid, methacrylic acid, α-cyanoacrylic acid, α-cyanomethacrylic acid, itaconic acid, crotonic acid, fumaric acid, maleic acid, and maleic anhydride. Examples of the (meth)acrylic monomers having a hydroxyl group include β-hydroxyethyl acrylate, β-hydroxylethyl methacrylate, β-hydroxylpropyl acrylate, β-hydroxylpropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylolacrylamide, and N-methylolmethacrylamide.

Examples of the vinyl alcohols or ethers of vinyl alcohol include vinylmethyl ether, vinylethyl ether, and vinylpropyl ether. Examples of the esters of vinyl alcohol and compounds having a carboxyl group include vinyl acetate, vinyl propionate, and vinyl butyrate. Examples of the amide compounds or methylol compounds thereof include acryl amide, methacryl amide, diacetone acryl amide acid, and methylol compounds thereof.

Examples of the chlorides include acrylic acid chloride, methacrylic acid, and chloride. Examples of the homopolymers or copolymers having a nitrogen atom or alicyclic ring thereof include vinyl pyridine, vinyl pyrrolidone, vinyl imidazole, and ethylene imine.

Examples of the polyoxy ethylene include polyoxyethylene, polyoxypropylene, polyoxyethylene alkylamine, polyoxypropylene alkylamine, polyoxyethylene alkylamide, polyoxypropylene alkylamide, polyoxyethylene nonylphenylether, polyoxyethylene laurylphenylether, polyoxyethylene stearylphenylester, and polyoxyethylene nonylphenylester. Examples of the cellulose include methyl cellulose, hydroxyethyl cellulose, and hydroxypropyl cellulose. Examples of the polyoxyethylene include polyoxyethylene, polyoxypropylene, polyoxyethylene alkylamine, polyoxypropylene alkylamine, polyoxyethylene alkylamide, polyoxypropylene alkylamide, polyoxyethylene nonylphenylether, polyoxyethylene laurylphenylether, polyoxyethylene stearylphenylester, and polyoxyethylene nonylphenylester. Examples of the cellulose include methyl cellulose, hydroxyethyl cellulose, and hydroxypropyl cellulose.

When the dispersion stabilizer dispersible in acid or alkali such as calcium phosphate is used, calcium phosphate is removed from the particles by dissolving calcium phosphate by acid such as hydrochloric acid, and then washing with water, or alternatively by decomposing calcium phosphate by using enzyme.

(Removal of Solvent)

The organic solvent is removed from emulsified and/or slurry resulting from the emulsification and/or dispersion. The removal of organic solvent is performed, for example, by the following methods: (1) the temperature of the reaction system is gradually raised, and the organic solvent in the oil droplets are completely evaporated and removed; (2) the resulting emulsion and/or dispersion liquid is sprayed in a dry atmosphere and the water-insoluble organic solvent is completely removed from the oil droplets to form toner particles, while aqueous dispersant being evaporated and removed simultaneously. Once organic solvent is removed, toner particles are formed. The toner particles are then subjected to washing, drying, and the like, then toner particles may be classified as necessary. The classification is, for example, performed using a cyclone, decanter, or centrifugal separation thereby removing fine particles in the solution. Alternatively, the classification may be carried out after toner particles are produced in a form of powder after drying.

The toner particles thus obtained are mixed with such particles as the colorant, releasing agent, charge controlling agent, and the like, and mechanical impact is applied thereto, thereby preventing particles such as the releasing agent from falling off the surfaces of the toner particles. Examples of the method of applying mechanical impact include a method in which impact is applied to the mixture by means of a blade rotating at high speed, and a method in which impact is applied by introducing the mixture into a high-speed flow to cause particles collide with each other or to cause composite particles to collide against a proper impact board. Examples of a device employed for these method include angmill (manufactured by Hosokawa micron Co., Ltd.), modified I-type mill (manufactured by Nippon Pneumatic Mfg. Co., Ltd.) to decrease pulverization air pressure, hybridization system (manufactured by Nara Machinery Co., Ltd.), kryptron system (manufactured by Kawasaki Heavy Industries, Ltd.), and automatic mortars.

In order to take a structure containing resin particles adhered and fixed onto the surface of the toner body, resin particles may be previously allowed to exist in the aqueous medium. Alternatively, a method may be adopted in which, when a toner is produced by dissolving and/or dispersing a toner material in an organic solvent, emulsifying and/or dispersing the solution and/or dispersion liquid of the toner precursor in an aqueous medium containing a surfactant and optionally fine particles of a resin, and then removing the organic solvent, resin particles may be added to the aqueous medium before, during, or after the removal of the organic solvent.

[Materials Used for Producing Toner of the Present Invention]

(Resin Fine Particles)

The resin fine particles used in the present invention are not particularly limited as long as it can form an aqueous dispersion in an aqueous medium, and may be suitably selected from known resins according to the purpose. The resin fine particles may be of thermoplastic resins or thermosetting resins; examples thereof include vinyl resins, polyurethane resins, epoxy resins, polyester resins, polyamide resins, polyimide resins, silicone resins, phenol resins, melamine resins, urea resins, aniline resins, ionomer resins, and polycarbonate resins. These may be used alone or in combination. Among these, the resin fine particles formed of at least one selected from the vinyl resins, polyurethane resins, epoxy resins, and polyester resins are preferable by virtue of easily producing aqueous dispersion of fine spherical resin particles. The vinyl resins are polymers in which a vinyl monomer is mono- or co-polymerized. Examples of vinyl resins include styrene-(meth)acrylate ester resins, styrene-butadiene copolymers, (meth)acrylate-acrylic acid ester copolymers, styrene-acrylonitrile copolymers, styrene-maleic anhydride copolymers, and styrene-(meth)acrylate copolymers.

An anionic group such as a carboxylic acid group or a sulfonate group may be introduced into the resin. Regarding the particle diameter, it is important that the average particle diameter of the primary particles be preferably 5 nm to 50 nm, more preferably 10 nm to 25 nm, from the viewpoint of regulating the particle diameter and particle diameter distribution of the emulsified particles. The particle diameter may be measured, for example, by SEM, TEM, or a light scattering method. Preferably, a method may be adopted in which the particles are diluted to a proper concentration at which the measured value falls within the range of measurement as measured by a laser scattering method with LA-920 manufactured by HORIBA, Ltd. The particle diameter is determined in terms of volume average diameter.

The resin fine particles may be formed through known polymerization processes suitably selected according to the purpose, and are preferably produced into an aqueous dispersion of resin fine particles. Examples of preparation processes of the aqueous dispersion of resin fine particles include the following (i) to (viii).

(i) a direct preparation process of aqueous dispersion of the resin fine particles in which, in the case of the vinyl resin, a vinyl monomer as a raw material is polymerized by suspension-polymerization process, emulsification-polymerization process, seed polymerization process or dispersion-polymerization process.

(ii) a preparation process of aqueous dispersion of the resin fine particles in which, in the case of the polyaddition or condensation resin such as a polyester resin, polyurethane resin, or epoxy resin, a precursor (monomer, oligomer or the like) or solvent solution thereof is dispersed in an aqueous medium in the presence of a dispersant, and heated or added with a curing agent so as to be cured, thereby producing the aqueous dispersion of the resin fine particles.

(iii) a preparation process of aqueous dispersion of the resin fine particles in which, in the case of the polyaddition or condensation resin such as a polyester resin, polyurethane resin, or epoxy resin, a suitably selected emulsifier is dissolved in a precursor (monomer, oligomer or the like) or solvent solution thereof (preferably being liquid, or being liquidized by heating), and then water is added so as to induce phase inversion emulsification, thereby producing the aqueous dispersion of the resin fine particles.

(iv) a preparation process of aqueous dispersion of the resin fine particles, in which a resin, previously prepared by polymerization process which may be any of addition polymerization, ring-opening polymerization, polyaddition, addition condensation, or condensation polymerization, is pulverized by means of a pulverizing mill such as mechanical rotation-type, jet-type or the like, and classified to obtain resin fine particles, and then the resin fine particles are dispersed in an aqueous medium in the presence of a suitably selected dispersant, thereby producing the aqueous dispersion of the resin fine particles.

(v) a preparation process of aqueous dispersion of the resin fine particles, in which a resin, previously prepared by a polymerization process which may be any of addition polymerization, ring-opening polymerization, polyaddition, addition condensation or condensation polymerization, is dissolved in a solvent, the resultant resin solution is sprayed in the form of a mist to thereby obtain resin fine particles, and then the resulting resin fine particles are dispersed in an aqueous medium in the presence of a suitably selected dispersant, thereby producing the aqueous dispersion of the resin fine particles.

(vi) a preparation process of aqueous dispersion of the resin fine particles, in which a resin, previously prepared by a polymerization process, which may be any of addition polymerization, ring-opening polymerization, polyaddition, addition condensation or condensation polymerization, is dissolved in a solvent, the resultant resin solution is subjected to precipitation by adding a poor solvent or cooling after heating and dissolving, the solvent is removed to thereby obtain resin fine particles, and then the resulting resin fine particles are dispersed in an aqueous medium in the presence of a suitably selected dispersant, thereby producing the aqueous dispersion of the resin fine particles.

(vii) a preparation process of aqueous dispersion of the resin fine particles, in which a resin, previously prepared by a polymerization process, which may be any of addition polymerization, ring-opening polymerization, polyaddition, addition condensation or condensation polymerization, is dissolved in a solvent to thereby obtain a resin solution, the resin solution is dispersed in an aqueous medium in the presence of a suitably selected dispersant, and then the solvent is removed by heating or reduced pressure to thereby obtain the aqueous dispersion of the resin fine particles.

(viii) a preparation process of aqueous dispersion of the resin fine particles, in which a resin, previously prepared by a polymerization process, which is any of addition polymerization, ring-opening polymerization, polyaddition, addition condensation or condensation polymerization, is dissolved in a solvent to thereby obtain a resin solution, a suitably selected emulsifier is dissolved in the resin solution, and then water is added to the resin solution so as to induce phase inversion emulsification, thereby producing the aqueous dispersion of the resin fine particles.

(Effect of Resin Particles)

When the resin particle is swellable with ethyl acetate, stable percentage transfer and the contemplated upper and lower fixing temperatures can be expected. Further, in this case, a deformed toner, which has a smooth surface property of 0.950 to 0.990 in terms of circularity and of about 0.5 $m^2/g$ to 4.0 $m^2/g$ in terms of BET specific surface area and has excellent cleaning properties. When the level of swellability is excessively high, the circularity is likely to be excessively lowered. When the level of swellability is excessively small, a toner, which has a large BET specific surface area and has poor percentage transfer, is likely to be produced.

(Surfactant)

Examples of anionic surfactants used in the toner production of the present invention include alkylbenzene sulfonic acid salts, α-olefin sulfonic acid salts, phosphates, and anionic surfactants having a fluoroalkyl group. Among these, the anionic surfactants having a fluoroalkyl group are preferable. Examples of the anionic surfactants having a fluoroalkyl group include fluoroalkyl carboxylic acids having 2 to 10 carbon atoms or metal salts thereof, disodium perfluorooctanesulfonylglutamate, sodium-3-[ω-fluoroalkyl (C6 to C11) oxy]-1-alkyl (C3 to C4) sulfonate, sodium-3-[ω-fluoroalkanoyl (C6 to C8)-N-ethylamino]-1-sodium propanesulfonate, fluoroalkyl (C11 to C20) carboxylic acids or metal salts thereof, perfluoroalkyl (C7 to C13) carboxylic acids or metal salts thereof, perfluoroalkyl (C4 to C12) sulfonic acid or metal salts thereof, perfluorooctanesulfonic acid diethanol amide, N-propyl-N-(2-hydroxyethyl)perfluorooctanesulfone amide, perfluoroalkyl (C6 to C10) sulfoneamidepropyltrimethylammonium salts, perfluoroalkyl (C6 to C10)-N-ethylsulfonyl glycin salts, and monoperfluoroalkyl (C6 to C16)ethylphosphate ester.

Examples of commercially available surfactants having a fluoroalkyl group include SURFLON S-111, S-112 and S-113 (by Asahi Glass Co., Ltd.); Frorard FC-93, FC-95, FC-98 and FC-129 (by Sumitomo 3M Ltd.); UNIDYNE DS-101 and DS-102 (by Daikin Industries, Ltd.); MEGAFAC F-110, F-120, F-113, F-191, F-812 and F-833 (by Dainippon Ink and Chemicals, Inc.); ECTOP EF-102, 103, 104, 105, 112, 123A, 1238, 306A, 501, 201 and 204 (by Tohchem Products Co., Ltd.); FTERGENT F-100 and F150 (by Neos Company Limited).

Additionally, cationic surfactants and nonionic surfactants can be used.

(Binder Resin)

The binder resin contained in the toner material used in the toner production of the present invention is not particularly limited and may be suitably selected from know binder resins according to the purpose. Specific examples thereof include polyester resins, silicone resins, styrene-acrylic resins, styrene resins, acrylic resins, epoxy resins, diene resins, phenol resins, terpene resins, coumarin resins, amide imide resins, butyral resins, urethane resins, and ethylene vinyl acetate resins.

Among these compounds, polyester resins are particularly preferable because of being sharply melted upon fixing time, being capable of smoothing the image surface, having sufficient flexibility even if the molecular weight thereof is lowered. The polyester resins may be used in combination with another resin.

The polyester resin used in the present invention is a product obtained by a polyesterification reaction between one kind or two or more kinds of polyols represented by General Formula (1) and one kind or two or more kinds of polycarboxylic acids represented by General Formula (2).

$$A\text{-}(OH)m \qquad \text{General Formula (1)}$$

In General Formula (1), A represents an alkyl group having 1 to 20 carbon atoms, an alkylene group having 1 to 20 carbon atoms, or an aromatic group or heterocyclic aromatic group, which may have a substituent group; m represents an integer of 2 to 4.

$$B\text{—}(COOH)n \qquad \text{General Formula (2)}$$

In General Formula (2), B represents an alkyl group having 1 to 20 carbon atoms, an alkylene group having 1 to 20 carbon atoms, or an aromatic group or heterocyclic aromatic group, which may have a substituent group; n represents an integer of 2 to 4.

Specific examples of polyols represented by General Formula (1) include ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, sorbitol, 1,2,3,6-hexanetetrol, 1,4-sorbitan, pentaerythritol, dipentaerythritol, tripentaerythritol, 1,2,4-butanetriol, 1,2,5-pentane triol, glycerol, 2-methylpropane triol, 2-methyl-1,2,4-butane triol, trimethylol ethane, trimethylol propane, 1,3,5-trihydroxymethyl benzene, bisphenol A, bisphenol A ethylene oxide adducts, bisphenol A propylene oxide adducts, hydrogenated bisphenol A, hydrogenated bisphenol A ethylene oxide adducts, and hydrogenated bisphenol A propylene oxide adducts.

Specific examples of polycarboxylic acids represented by General Formula (2) include maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenylsuccinic acid, isooctyl succinic acid, isododecenylsuccinic acid, n-dodecylsuccinic acid, isododecylsuccinic acid, n-octenyl succinic acid, n-octyl succinic acid, isooctenyl succinic acid, isooctyl succinic acid, 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, Empol trimer acid, cyclohexanedicarboxylic acid, cyclohexenedicarboxylic acid, butanetetracarboxylic acid, diphenylsulfonetetracarboxylic acid, and ethylene glycol his (trimellitic acid).

(Active Hydrogen Group-Containing Compound)

When the toner material according to the present invention contains an active hydrogen group-containing compound and a modified polyester resin reactive with the compound, the mechanical strength of the resultant toner is increased and embedding of the resin particle and the external additive can be suppressed. When the active hydrogen group-containing compound has cationic polarity, the resin particle can also be attracted electrostatically. Further, the fluidity during the heat fixation can be regulated, and, consequently, the fixing temperature width can be broadened. The active hydrogen group-containing compound and the modified polyester resin reactive with the compound can be said to be a binder resin precursor.

The active hydrogen group-containing compound functions as an elongation initiator or crosslinking agent at the time of elongation reaction or crosslinking reaction with the polymer reactive with the active hydrogen group-containing compound in the aqueous medium. The active hydrogen group-containing compound is not particularly limited as long as it contains an active hydrogen group, and may suitably be selected according to the purpose. For example, in cases where the polymer reactive with the active hydrogen group-containing compounds is an isocyanate group-containing polyester prepolymer (A), amines (B) are preferable from the viewpoint of ability to increase molecular weight by the elongation reaction or crosslinking reaction therewith.

The active hydrogen group is not particularly limited and may be suitably selected according to the purpose; examples thereof include hydroxyl group such as an alcoholic hydroxyl group and phenolic hydroxyl group, amino group, carboxyl group and mercapto group. These may be used alone or in combination.

The amines (B) are not particularly limited and may be suitably selected according to the purpose; examples thereof include diamines (B1), polyamines of trivalent or higher (B2), amino alcohols (B3), amino mercaptans (B4), amino acids (B5), and compounds (B6) obtained by blocking amino groups of any one of (B1) to (B5). These may be used alone or in combination. Among these, diamines (B1), and mixtures of diamines (B1) and a small amount of polyamines of trivalent or higher (B2) are particularly preferable.

Examples of the diamines (B1) include aromatic diamines, alicyclic diamines and aliphatic diamines. Examples of the aromatic diamines include phenylene diamine, diethyltoluene diamine and 4,4'-diaminophenylmethane. Examples of the alicyclic diamines include 4,4'-diamino-3,3'-dimethyldicycrohexylmethane, diamine cyclohexane and isophorone diamine. Examples of the aliphatic diamines include ethylene diamine, tetramethylene diamine and hexamethylene diamine.

Examples of the polyamines of trivalent or higher (B2) include diethylene triamine and triethylene tetramine. Examples of the amino alcohols (B3) include ethanolamine and hydroxyethylaniline. Examples of the amino mercaptans (B4) include aminoethylmercaptan and aminopropylmercaptan. Examples of the amino acids (B5) include amino propionic acid and aminocaproic acid.

Examples of the compounds (B6) obtained by blocking amino groups of any one of (B1) to (B5) include ketimine compounds and oxazoline compounds, obtained from amines, and ketones such as acetone, methyl ethyl ketone and methyl isobutyl ketone.

A reaction terminator may be used to stop the elongation reaction, crosslinking reaction, or the like between the active hydrogen group-containing compound and the polymer reactive with the compound. The reaction terminator is preferably employed for controlling the molecular weight of an adhesive base material within a preferable range. Examples of the reaction terminator include monoamines such as diethylamine, dibutylamine, butylamine and laurylamine, and also block compounds thereof such as ketimine compounds.

The mixture ratio of amines (B) and the isocyanate group-containing polyester prepolymer (A), in terms of mixture equivalent ratio of isocyanate group [NCO] in the isocyanate group-containing polyester polyester (A) and amino group [NHx] in the amines (B), [NCO]/[NHx], is preferably from 1/3 to 3/1, more preferably from 1/2 to 2/1 and particularly preferably from 1/1.5 to 1.5/1. When the mixture equivalent ratio [NCO]/[NHx] is 1/3 or more, low-temperature fixability may not deteriorate, and when it is 3/1 or less, the molecular weight of urea-modified polyester may not become low, thereby not impairing the hot offset resistance.

(Polymer Reactive with the Active Hydrogen Group-Containing Compound)

The polymer reactive with the active hydrogen group-containing compound (hereinafter also referred to as "prepolymer") is not particularly limited as long as it has at least a site reactive with the active hydrogen group-containing compound, and may be suitably selected from known resins; examples thereof include polyol resins, polyacrylic resins, polyester resins, epoxy resins, and derivative resins thereof. These may be used alone or in combination.

The site reactive with the active hydrogen group-containing compound in the prepolymer is not particularly limited and may be suitably selected from known substituents; examples thereof include an isocyanate group, an epoxy group, a carboxylic acid, and an acid chloride group. These may be used alone or in combination. Among these, an isocyanate group is particularly preferable. Among the modified polyesters described above, urea-bond-forming group containing polyester resins (RMPE) are particularly preferable, in view of easiness in controlling molecular weight of polymer components, oilless-fixability of dry toner at low temperatures, in particular favorable releasability and fixability even without release-oil-coating system for fixing-heating medium.

The urea-bond-forming group is exemplified by an isocyanate group. In the case where the urea-bond-forming group of the urea-bond-forming group containing polyester resins (RMPE) is an isocyanate group, the polyester resins (RMPE) are preferably exemplified by the isocyanate group-containing polyester prepolymer (A) or the like. The skeleton of the isocyanate group-containing polyester prepolymer (A) is not particularly limited and may be suitably selected according to the purpose; examples thereof include polycondensation product of polyol (PO) and polycarboxylic acid (PC), and which is obtained by reaction between the active hydrogen group-containing polyester and a polyisocyanate (PIC). The polyol (PO) is not particularly limited and may be suitably selected according to the purpose; examples thereof include diols (DIO), polyols (TO) of trivalent or higher, mixtures of diols (DIO) and polyols (TO) of trivalent or higher, and the like. These may be used alone or in combination. Among these, diols (DIO) alone and mixtures of diols (DIO) and a small amount of polyols (TO) of trivalent or higher are preferable.

Examples of the diols (DIO) include alkylene glycols, alkylene ether glycols, alicyclic diols, alkylene oxide adducts of alicyclic diols, bisphenols, and alkylene oxide adducts of bisphenols.

The alkylene glycols having 2 to 12 carbon atoms are preferable; examples thereof include ethylene glycol, 1,2-propylene glycol, 1,3-propylene glycol, 1,4-butanediol, and 1,6-hexanediol. Examples of the alkylene ether glycols include diethylene glycol, triethylene glycol, dipropylene glycol, polyethylene glycol, polypropylene glycol, and polytetramethylene ether glycol. Examples of the alicyclic diols include 1,4-cyclohexanedimethanol and hydrogenated bisphenol A. Examples of the alkylene oxide adducts of the alicyclic diols include cycloaliphatic diols added with alkylene oxides such as ethylene oxide, propylene oxide, and butylene oxide. Examples of the bisphenols include bispheonol A, bisphenol F, and bisphenol S. The alkylene oxide adducts of bisphenols include bisphenols added with alkylene oxides such as ethylene oxide, propylene oxide, and butylene oxide. Among these, preferable are alkylene glycols having 2 to 12 carbon atoms and alkylene oxide adducts of bisphenols; particularly preferable are alkylene oxide adducts of bisphenols and mixture of alkylene oxide adducts of bisphenols and alkylene glycols having 2 to 12 carbon atoms.

The polyols (TO) of trivalent or higher are preferably those having a valency of 3 to 8 or higher; examples thereof are polyvalent aliphatic alcohols of trivalent or higher, polyphenols of trivalent or higher, and alkylene oxide adducts of polyphenols of trivalent or higher. Examples of the polyvalent aliphatic alcohols of trivalent or higher include glycerine, trimethylol ethane, trimethylol propane, pentaerythritol, and sorbitol. Examples of the polyphenols of trivalent or higher include trisphenols (for example, trisphenol PA, manufactured by HONSHU CHEMICAL INDUSTRY CO., LTD.), phenol novolac, and cresol novolac. Examples of the alkylene oxide adducts of polyphenols of trivalent or higher include polyphenols of trivalent or higher added with alkylene oxides such as ethylene oxide, propylene oxide, butylene oxide, and the like.

The mass ratio, DIO:TO, of the diol (DIO) and the polyol (TO) of trivalent or higher in the mixture thereof is preferably 100:0.01 to 100:10 and more preferably 100:0.01 to 100:1.

The polycarboxylic acid (PC) is not particularly limited and may be suitably selected according to the purpose; examples thereof include dicarboxylic acids (DIC), polycarboxylic acids (TC) of trivalent or higher, and mixtures of dicarboxylic acids (DIC) and polycarboxylic acids of trivalent or higher. These may be used alone or in combination. Among these, the dicarboxylic acid (DIC) alone or the mixtures of dicarboxylic acids (DIC) and a small amount of polycarboxylic acids of trivalent or higher are particularly preferable.

Examples of the dicarboxylic acids include alkylene dicarboxylic acids, alkenylene dicarboxylic acids, and aromatic dicarboxylic acids. Examples of the alkylene dicarboxylic acids include succinic acid, adipic acid, and sebacic acid.

The alkenylene dicarboxylic acids preferably have 4 to 20 carbon atoms; examples thereof include maleic acid, and fumaric acid. The aromatic dicarboxylic acids preferably have 8 to 20 carbon atoms; examples thereof include phthalic acid, isophthalic acid, terephthalic acid, and naphthalenedicarboxylic acid. Among these, preferable are alkenylene dicarboxylic acids having 4 to 20 carbon atoms and aromatic dicarboxylic acids having 8 to 20 carbon atoms.

The polycarboxylic acids (TO) of trivalent or higher preferably have a valency of 3 to 8 or more, and which are exemplified by aromatic polycarboxylic acids. The aromatic polycarboxylic acids preferably have 9 to 20 carbon atoms; examples thereof include trimellitic acid, and pyromellitic acid.

The polycarboxylic acids (PC) may be acid anhydrides or lower alkyl esters selected from dicarboxylic acids (DIC), polycarboxylic acids of trivalent or higher (TC) and mixtures of dicarboxylic acid (DIC) and polycarboxylic acid of trivalent or higher. Examples of the lower alkyl esters include methyl esters, ethyl esters, and isopropyl esters.

The mass ratio, DIC:TC, in mixtures of dicarboxylic acid (DIC) and polycarboxylic acid of trivalent or higher (TC) is not particularly limited and may be suitably selected according to the purpose; the mass ratio is preferably 100:0.01 to 100:10 and more preferably 100:0.01 to 100:1.

The mass ratio of polyol (PO) and polycarboxylic acid (PC) upon polycondensation reaction is not particularly limited and may be suitably selected according to the purpose; for example, the equivalent ratio, [OH]/[COOH], of hydroxyl group [OH] of polyol (PO) and carboxyl group [COOH] of polycarboxylic acid (PC) is preferably 2/1 to 1/1 and more preferably 1.5/1 to 1/1, and particularly preferably 1.3/1 to 1.02/1.

The content of polyol (PO) in the isocyanate group-containing polyester prepolymer (A) is not particularly limited and may be suitably selected according to the purpose; preferably, the content is 0.5% by mass to 40% by mass, more preferably 1% by mass to 30% by mass and particularly preferably 2% by mass to 20% by mass. In the case where the content is 0.5% by mass or more, it excels in hot offset resistance, making it possible to simultaneously satisfy both heat-resistant storage stability and low-temperature fixability. In the case where the content is 40% by mass or less, low-temperature fixability may not deteriorate.

The polyisocyanate (PIC) is not particularly limited and may be suitably selected according to the purpose; examples thereof include aliphatic polyisocyanates, alicyclic polyisocyanates, aromatic diisocyanate, aroma-aliphatic diisocyanates, isocyanurates, phenol derivatives thereof, and derivative compounds blocked with oxime, caprolactam or the like.

Examples of the aliphatic polyisocyanates include tetramethylene diisocyanate, hexamethylene diisocyanate, 2,6-diisocyanate methyl caproate, octamethylene diisocyanate, decamethylene diisocyanate, dodecamethylene diisocyanate, tetradecamethylene diisocyanate, torimethylhexane diisocyanate, and tetramethylhexane diisocyanate. Examples of the alicyclic polyisocyanates include isophorone diisocyanate, and cyclohexylmethane diisocyanate. Examples of the aromatic diisocyanates include tolylene diisocyanate, diphenylmethane diisocyanate, 1,5-naphtylene diisocyanate, diphenylene-4,4'-diisocyanate, 4,4'-diisocyanato-3,3'-dimethyldiphenyl, 3-methyldiphenylmethane-4,4'-diisocyanate, and diphenylether-4,4'-diisocyanate. Examples of the aromatic aliphatic diisocyanates include $\alpha,\alpha,\alpha',\alpha'$,-tetramethylxylylene diisocyanate. Examples of the isocyanurates include tris-isocyanatoalkyl-isocyanurate, and toriisocyanatocycloalkyl-isocyanurate. These may be used alone or in combination.

As to the mixing ratio of the polyisocyanate (PIC) and the active hydrogen group-containing polyester resin (for example, a hydroxyl group-containing polyester resin) upon reaction, the equivalent mixing ratio, [NCO]/[OH], of an isocyanate group [NCO] of the polyisocyanate (PIC) to an hydrogen group [OH] of the hydroxyl group-containing polyester resin, is 5/1 to 1/1, more preferably 4/1 to 1.2/1 and particularly preferably 3/1 to 1.5/1. The reason for this is that, when the value of the isocyanate group [NCO] is 5 or less, low-temperature fixability may not deteriorate, and when it is 1 or more, the offset resistance may not deteriorate.

The content of polyisocyanate (PIC) in the isocyanate group-containing polyester prepolymer (A) may be suitably selected according to the purpose. Preferably, the content is 0.5% by mass to 40% by mass, more preferably 1% by mass to 30% by mass, and particularly preferably 2% by mass to 20% by mass.

When the content is less than 0.5% by mass, the hot offset resistance may deteriorate, making it difficult to simultaneously satisfy the heat-resistant storage stability and the low-temperature fixability, and when the content is more than 40% by mass, the low-temperature fixability may deteriorate.

The average number of isocyanate groups contained in one molecule of the isocyanate group-containing polyester prepolymer (A) is preferably 1 or more, more preferably 1.2 to 5, and particularly preferably 1.5 to 4. The reason for this is that, when the average number of isocyanate groups is 1 or more, the molecular weight of polyester resin (RMPE) modified with the urea-bond-formation group does not become too low, thereby being excellent in hot offset resistance.

The weight average molecular weight (Mw) of the polymer reactive with the active hydrogen group-containing compound, in terms of molecular weight distribution by gel permeation chromatography (GPC) of tetrahydrofuran (THF) soluble content, is preferably 3,000 to 40,000, and more preferably 4,000 to 30,000. The reason for this is that, when the weight average molecular weight (Mw) is 3,000 or more, it excels in heat-resistant storage stability and when it is 40,000 or less, it excels in low-temperature fixability.

The molecular weight distribution by gel permeation chromatography (GPC), for example, may be measured as follows. Firstly, a column is equilibrated inside the heat chamber of 40° C. At this temperature, tetrahydrofuran (THF) as a column solvent is passed through the column at a flow rate of 1 ml/minute, and 50 μl to 200 μl of sample resin in THF is injected at a concentration of 0.05% by mass to 0.6% by mass, then the measurement is carried out. In the measurement of molecular weight of the sample, a molecular weight distribution of the sample is calculated from a relationship between logarithm values of the analytical curve made from several mono-disperse polystyrene standard samples and counted numbers. It is preferred that the standard polystyrene samples for making analytical curves are preferably ones with a molecular weight of $6\times10^2$, $2.1\times10^2$, $4\times10^2$, $1.75\times10^4$, $1.1\times10^5$, $3.9\times10^5$, $8.6\times10^5$, $2\times10^6$ and $4.48\times10^6$ (by Pressure Chemical Co., Ltd., or Tosoh Corporation) and at least approximately 10 pieces of the standard polystyrene sample are used. A refractive index (RI) detector may be used for the detector.

(Other Components)

The other components are not particularly limited and may be suitably selected according to the purpose; examples thereof include colorants, releasing agents, charge controlling agents, inorganic particles, flowability enhancers, cleaning improvers, magnetic materials, and metal soaps.

(Colorant)

The colorants are not particularly limited and may be suitably selected from known dyes and pigments according to the purpose; examples thereof include carbon blacks, nigrosine dyes, iron black, Naphthol Yellow S, Hansa Yellow (10G, 5G, G), cadmium yellow, yellow iron oxide, yellow ocher, chrome yellow, Titan Yellow, Polyazo Yellow, Oil Yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, anthracene yellow BGL, isoindolinone yellow, colcothar, red lead oxide, lead red, cadmium red, cadmium mercury red, antimony red, Permanent Red 4R, Para Red, Fiser Red, parachloroorthonitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Hello bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanine blue, phthalocyanine blue, fast sky blue, indanthrene blue (RS, BC), indigo, ultramarine blue, iron blue, anthraquinone blue, fast violet B, methylviolet lake, cobalt purple, manganese violet, dioxane violet, anthraquinone violet, chrome green, zinc green, chromium oxide, viridian green, emerald green, pigment green. B, naphthol green B, green gold, acid green lake, malachite green lake, phthalocyanine green, anthraquinone green, titanium oxide, zinc flower, and lithopone. These may be used alone or in combination.

The amount of the colorant in the toner is not particularly limited and may be suitably selected according to the purpose; preferably, it is 1% by mass to 15% by mass, and more preferably 3% by mass to 10% by mass. When it is 1% by mass or more, tinting strength of the toner may not be lowered, and when it is 15% by mass or less, dispersion failure of the pigment may not occur in the toner thereby not causing degradation of tinting strength or electric properties of the toner.

The colorants may be combined with resins to form master batches. The resins are not particularly limited and may be suitably selected from known resins according to the purpose; examples thereof include polyesters, polymers of styrene or substituted styrenes, styrene copolymers, polymethyl methacrylates, polybuthyl methacrylates, polyvinyl chlorides, polyvinyl acetates, polyethylenes, polypropylenes, epoxy resins, epoxy polyol resins, polyurethanes, polyamides, polyvinyl butyral, polyacrylic acid resins, rosin, modified rosins, terpene resins, aliphatic or alicyclic hydrocarbon resins, aromatic petroleum resins, chlorinated paraffin, and paraffin wax. These may be used alone or in combination.

Examples of polymers of styrene or substituted styrenes include polyester resins, polystyrene, poly-p-chlorostyrene, and polyvinyl toluene. Examples of styrene copolymers include styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, and styrene-maleic ester copolymers.

The master batches may be obtained by mixing or kneading a resin for the master batch and a colorant with high shear force. In order to improve interaction between the colorant and the resin, an organic solvent may be added. In addition, the "flushing process" in which a wet cake of colorant being applied directly is preferable because drying is unnecessary. In the flushing process, a water-based paste containing colorant and water is mixed or kneaded with the resin and the organic solvent so that the colorant moves towards the resin, and that water and the organic solvent are removed. The materials are preferably mixed or kneaded using a triple roll mill and other high-shear dispersing devices. The colorant can be arbitrarily contained in any of a first resin phase and a second resin phase by utilizing a difference between the affinity of the colorant for one of the resin and the affinity of the colorant for the other resin. It is well known that the colorant adversely affect chargeability of the toner when it is present on a surface of the toner. Thus, when the colorant is selectively contained in the first resin phase present in the inner layer of the toner, the chargeability of the toner (environmental safety, charge retension ability, charge amount, and the like) can be improved.

(Releasing Agent)

The releasing agents are not particularly limited and may be suitably selected according to the purpose. A releasing agent having a low melting point of 50° C. to 120° C. is preferably used. The releasing agent having a low melting point works effectively between a fixing roller and a toner interface by dispersing the releasing agents in the binder resinm, thereby exhibiting excellent hot offset resistance without applying releasing agents such as oils to the fixing rollers.

As the releasing agent, waxes are preferably used. Examples of waxes include vegetable waxes such as carnauba wax, cotton wax, wood wax, rice wax, animal waxes such as honey wax, lanolin, mineral waxes such as ozokelite, selsyn, and petroleum waxes such as paraffin, microcrystalline, petrolatum. Besides these natural waxes, synthetic hydrocarbon waxes such as Fischer-Tropsh wax, polyethylene wax, synthetic waxes such as esters, ketones, ethers. Other examples of the releasing agent include aliphatic acid amides such as 12-hydroxystearic acid amide, stearic acid amide, phthalic anhydride imide, chlorinated hydrocarbons; crystalline polymer resins having low molecular weight such as homo polymer or copolymers of polyacrylate such as poly-n-stearyl methacrylate and poly-n-lauryl methacrylate (for example, n-stearyl acrylate-ethyl methacrylate copolymer); and a crystalline polymer of which side chain has long alkyl group. These may be used alone or in combination.

The melting point of the releasing agent is not particularly limited and may be suitably selected according to the purpose; the melting point is preferably 50° C. to 120° C. and, more preferably, 60° C. to 90° C. When the melting point is 50° C. or more, the wax may not adversely affect heat-resistant storage stability; and when the melting point is 120° C. or less, it is not easily cause cold offset at fixing processes under the lower temperatures. The melt viscosity of the releasing agent is, measured at the temperature 20° C. higher than the melting point of the wax, preferably 5 cps to 1,000 cps and, more preferably, 10 cps to 100 cps. In the case where the melt viscosity is 5 cps or more it excels in releasing ability, and when the melt viscosity is 1,000 cps or less, the hot offset resistance and the low-temperature fixability may be Unproved. The amount of the releasing agent in the toner is not particularly limited and may be suitably selected according to the purpose; it is preferably 0% by mass to 40% by mass, and more preferably 3% by mass to 30% by mass. When it is 40% by mass or less, it excels in the toner flowability.

The releasing agent can be arbitrarily contained in any of a first resin phase and a second resin phase by utilizing a difference between the affinity of the releasing agent for one of the resin and the affinity of the releasing agent for the other resin. When the releasing agent is selectively contained in the second resin phase present in the outer layer of the toner, the releasing agent oozes out satisfactorily in a short heating time in the fixation and, consequently, satisfactory releasability can be realized. On the other hand, when the releasing agent is selectively contained in the first resin phase present in the inner layer, the spent of the releasing agent to other members such as the photoconductors and carriers can be suppressed. In the present invention, the arrangement of the releasing agent is sometimes freely designed and the releasing agent may be arbitrarily arranged according to various image forming processes.

(Charge Controlling Agent)

The charge controlling agent is not particularly limited and may be suitably selected from known agents according to the purpose. Examples of the charge controlling agent include nigrosine dyes, triphenylmethane dyes, chromium-containing metal complex dyes, chelate molybdate pigment, rhodamine dyes, alkoxy amine, quaternary ammonium salt (including fluorine modified quaternary ammonium salt), alkylamide, phosphorus alone or compounds thereof, tungsten alone or compounds thereof, fluorine-based active agents, salicylic acid metal salts, and metal salts of salicylic acid derivatives. These may be used alone or in combination.

The charge controlling agent may be of commercially available ones. Specific examples thereof include nigrosin dye BONTRON 03, quaternary ammonium salt BONTRON-P-51, metal-containing azo dye BONTRON S-34, oxynaphthoic acid metal complex E-82, salicylic metal complex E-84, phenolic condensate E-89 (produced by Orient Chemical Industries Ltd.), molybdenum complex with quaternary ammonium salt TP-302 and TP-415 (produced by Hodogaya Chemical Co., Ltd.), quaternary ammonium salt copy charge PSY VP2038, triphenylmethane derivatives copy blue PR, quaternary ammonium salt copy charge NEG VP2036, copy charge NX VP434 (produced by Hochst), LRA-901, boron complex LR-147 (produced by Japan Carlit Co., Ltd.), copper phthalocyanine, perylene, quinacridone, azo pigment, and high-molecular-weight-compounds having a sulfonic acid group, carboxyl group, or quaternary ammonium salt group.

The amount of the charge controlling agent in the toner is determined depending on types of binder resin, presence of additives used as needed, and a dispersion method, and therefore cannot be uniquely determined. However, the amount of charge controlling agent is preferably 0.1 parts by mass to 10 parts by mass, and more preferably 0.2 parts by mass to 5 parts by mass based on 100 parts by mass of the binder resin. When the amount is 0.1 parts by mass or more, the charge may be uncontrollable; when the amount is 10 parts by mass or less, charging ability of the toner does not become excessively significant.

(Inorganic Fine Particles)

The inorganic fine particles are preferably used as an external additive to facilitate flowability, developability and chargeability of toner particles. The inorganic fine particles are not particularly limited and may be suitably selected from known agents according to the purpose. Examples of the inorganic fine particles include silica, alumina, titanium oxide, barium titanate, magnesium titanate, calcium titanate, strontium titanate, zinc oxide, tin oxide, silica sand, clay, mica, wollastonite, diatomite, chromium oxide, cerium oxide, colcothar, antimony trioxide, magnesium oxide, zirconium oxide, barium sulfate, barium carbonate, calcium carbonate, silicon carbide, and silicon nitride. These may be used alone or in combination.

In addition to inorganic fine particles having a large particle diameter of 80 nm to 500 nm in terms of primary average particle diameter, inorganic fine particles having a small diameter can be preferably used as inorganic fine particles for assisting the fluidity, developability, and charging properties of the colored particles. In particular, hydrophobic silica and hydrophobic titanium oxide are preferred. The primary average particle diameter of the inorganic fine particles is preferably 5 nm to 50 nm, particularly preferably 10 nm to 30 nm. The BET specific surface area is preferably 20 $m^2/g$ to 500 $m^2/g$. The content of the inorganic fine particles is preferably 0.01% by mass to 5% by mass, particularly preferably 0.01% by mass to 2.0% by mass.

(Flowability Improver)

The flowability improver is an agent applying surface treatment to improve hydrophobic properties, and is capable of inhibiting the degradation of flowability or charging ability under high humidity environment. Specific examples of the flowability improver include silane coupling agents, silylation agents, silane coupling agents having a fluorinated alkyl group, organotitanate coupling agents, aluminum coupling agents, silicone oils, and modified silicone oils. It is preferable that the silica and titanium oxide be subjected to surface treatment with such a flowability improver and used as hydrophobic silica and hydrophobic titanium oxide.

(Cleaning Improver)

The cleaning improver is added to the toner to remove the residual developer on a photoconductor or a primary transfer member after transferring. Specific examples of the cleaning improver include fatty acid metal salt such as zinc stearate, calcium stearate, stearic acid, and the like, fine polymer particles formed by soap-free emulsion polymerization, such as fine polymethylmethacrylate particles, fine polyethylene particles, and the like. The fine polymer particles have preferably a narrow particle size distribution. It is preferable that the volume average particle diameter thereof is 0.01 μm to 1 μm.

(Magnetic Material)

The magnetic material is not particularly limited and may be suitably selected from known magnetic materials according to the purpose. Suitable examples thereof include iron powder, magnetite, and ferrite. Among these, one having a white color is preferable in terms of color tone.

[Full-color Image Forming Method]

The full-color image forming method according to the present invention includes a charging step of charging an electrophotographic photoconductor by a charging unit, an exposure step of forming latent electrostatic latent electrostatic image on the charged electrophotographic photoconductor by an exposing unit, a development step of forming a toner image on the electrophotographic photoconductor with the latent electrostatic image formed thereon by a developing unit including a toner, a primary transfer step of transferring the toner image, which has been formed on the electrophotographic photoconductor, onto an intermediate transfer member by a primary transfer unit, a secondary transfer step of transferring the toner image, which has been transferred onto the intermediate transfer member, onto a recording medium by a secondary transfer unit, a fixation step of fixing the toner image, which has been transferred onto the recording medium, onto the recording medium by a fixing unit including a heat and pressure fixation member, and a cleaning step of removing, by cleaning using a cleaning unit, toner remaining untransferred and adhered onto the surface of the electrophotographic photoconductor, from which the toner image has been transferred onto the intermediate transfer member by the primary transfer unit. The toner present in the development step is the toner according to the present invention. In this full-color image forming method according to the present invention, preferably, the linear velocity of transfer of the toner image onto the recording medium in the secondary transfer step, that is, the so-called printing speed, is 300 mm/sec to 1,000 mm/sec, and the time during the transfer in the nip part in the secondary transfer unit is 0.5 msec to 20 msec. In the full-color image forming method according to the present invention, the adoption of a tandem-type electrophotographic image forming process is preferred.

(Charging Step)

Figure 2:
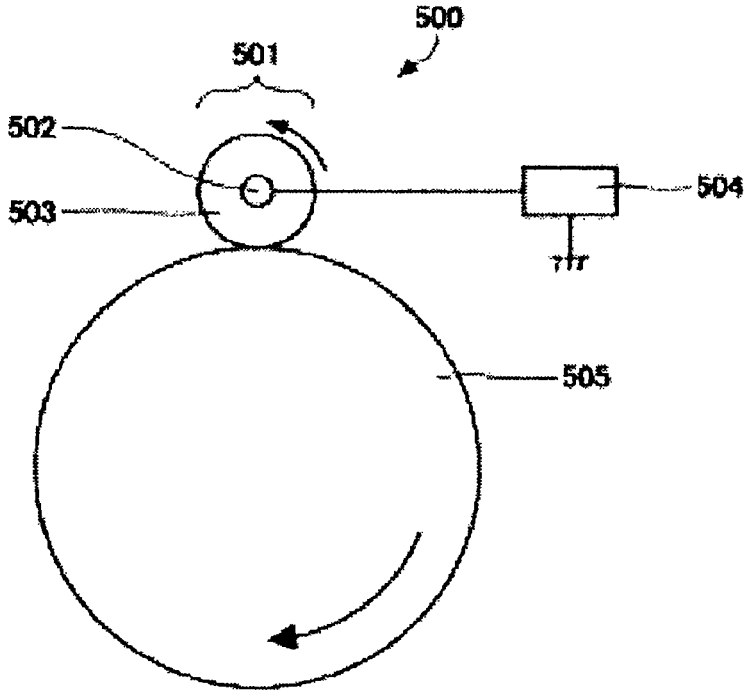
FIG. 2 is a schematic view for explaining one embodiment of a roller-type charging device according to the present invention.
Figure 3:
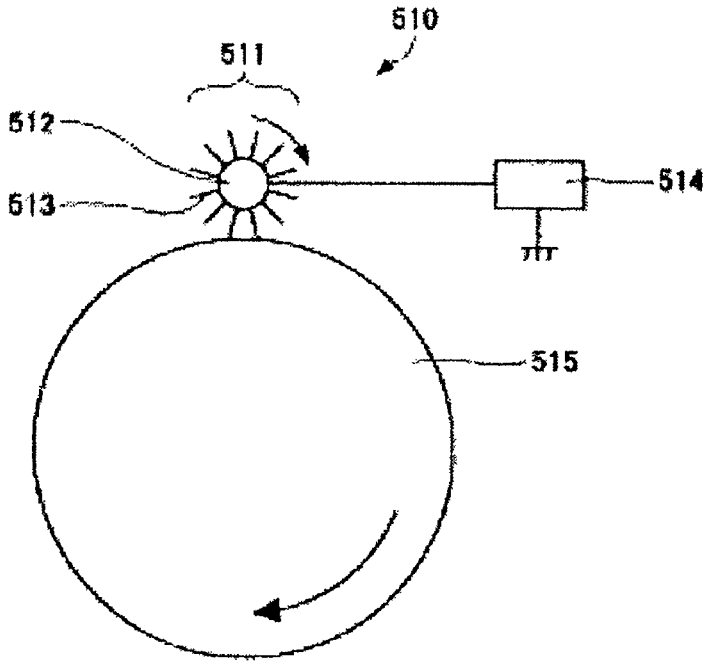
FIG. 3 is a schematic view for explaining one embodiment of a brush-type charging device used in an image forming method according to the present invention.

Charging units usable in the image forming method according to the present invention include, for example, contact charging devices shown in FIGS. 2 and 3.

<Roller Charging Device>

FIG. 2 is a schematic diagram showing an example of a roller charging device 500 which is one type of contact charging devices. The photoconductor 505 to be charged as a latent electrostatic image bearing member is rotated at a predetermined speed (process speed) in the direction shown with the arrow in the figure. The charging roller 501 serving as a charging unit, which is brought into contact with the photoconductor 505, contains a core rod 502 and a conductive rubber layer 503 formed on the outer surface of the core rod in a shape of a concentric circle. The both terminals of the core rod 502 are supported with bearings (not shown) so that the charging roller enables to rotate freely, and the charging roller is pressed to the photoconductor drum at a predetermined pressure by a pressurizing member (not shown). The charging roller 501 in FIG. 2 therefore rotates along with the rotation of the photoconductor 505. The charging roller 501 is generally formed with a diameter of 16 mm in which a core rod having a diameter of 9 mm is coated with a rubber layer 503 having a moderate resistance of approximately 100,000Ω·cm. The power supply 504 shown in the figure is electrically connected with the core rod 502 of the charging roller 501, and a predetermined bias is applied to the charging roller 501 by the power supply 504. Thus, the surface of the photoconductor 505 is uniformly charged at a predetermined polarity and potential.

<Fur Brush Charging Device>

As a charging unit for use in the present invention, the shape thereof is not specifically limited and may be, apart from a roller, a magnetic brush or a fur brush. It may be suitably selected according to a specification or configuration of an electrophotographic apparatus. When a magnetic brush is used as the charging device, the magnetic brush includes a charging member formed of various ferrite particles such as Zn—Cu ferrite, a non-magnetic conductive sleeve to support the ferrite particles, and a magnetic roller included in the non-magnetic conductive sleeve. Moreover, when the fur brush is used as the charger, a material of the fur brush is, for example, a fur treated to be conductive with, for example, carbon, copper sulfide, a metal or a metal oxide, and the fur is coiled or mounted to a metal or another core rod which is treated to be conductive, thereby obtaining the charging device.

FIG. 3 is a schematic diagram of one example of a contact brush charging device 510. The photoconductor 515 as an object to be charged and a latent electrostatic image bearing member, is rotated at a predetermined speed (process speed) in the direction shown with the arrow in the figure. The brush roller 511 having a fur brush is brought in contact with the photoconductor 515, with a predetermined nip width and a predetermined pressure with respect to elasticity of the brush part 513.

The fur brush roller 511 as the contact charging device used in the present invention has an outer diameter of 14 mm and a longitudinal length of 250 mm. In this fur brush, a tape with a pile of conductive rayon fiber REC-B (available from Unitika Ltd.), as a brush part 513, is spirally coiled around a metal core rod 512 having a diameter of 6 mm, which is also functioned as an electrode. The brush of the brush part 513 is of 300 denier/50 filament, and a density of 155 fibers per 1 square millimeter. This role brush is once inserted into a pipe having an internal diameter of 12 mm with rotating in a certain direction, and is set so as to be a concentric circle relative to the pipe. Thereafter, the role brush in the pipe is left in an atmosphere of high humidity and high temperature so as to twist the fibers of the fur.

The resistance of the contact brush charging device 510 is $1\times10^5\Omega$ at an applied voltage of 100 V. This resistance is calculated from the current obtained when the fur brush rolled is contacted with a metal drum having a diameter of 30 mm with a nip width of 3 mm, and a voltage of 100 V is applied thereon.

The resistance of the fur brush roller should be $10^4\Omega$ or more in order to prevent image defect caused by an insufficient charge at the charging nip part when the photoconductor 515 to be charged happens to have low electric strength defects such as pin holes thereon and an excessive leak current therefore runs into the defects. Moreover, it should be $10^7\Omega$ or less in order to sufficiently charge the surface of the photoconductor 515.

Examples of the material of the fur include, in addition to REC-B (available from Unitika Ltd.), REC-C, REC-M1, REC-M10 (available from Unitika Ltd.), SA-7 (available from Toray Industries, Inc.), THUNDERON (available from Nihon Sanmo Dyeing Co., Ltd.), BELTRON (available from Kanebo Gohsen, Ltd.), KURACARBO in which carbon is dispersed in rayon (available from Kuraray Co., Ltd.), and ROVAL (available from Mitsubishi Rayon Co., Ltd.). The brush is of preferably 3 to 10 denier per fiber, 10 to 100 filaments per bundle, and 80 to 600 fibers per square millimeter. The length of the fur is preferably 1 mm to 10 mm.

The fur brush roller 511 is rotated in the opposite (counter) direction to the rotation direction of the photoconductor 515 at a predetermined peripheral velocity, and comes into contact with a surface of the photoconductor with a velocity deference. The power supply 514 applies a predetermined charging voltage to the fur brush roller 511 so that the surface of the photoconductor is uniformly charged at a predetermined polarity and potential.

In contact charge of the photoconductor 515 by the fur brush roller 511 of the present embodiment, charges are mainly directly injected and the surface of the photoconductor is charged at the substantially equal voltage to the applying charging voltage to the fur brush roller 511.

The charging member used in the present invention as the charging unit is not specifically limited in its shape and can be in any shape such as a charging roller or a fur blush, as well as the fur blush roller 511. The shape can be selected according to the specification and configuration of the electrophotographic apparatus. When a charging roller is used, it generally includes a core rod and a rubber layer having a moderate resistance of about 100,000 Ω·cm coated on the core rod. When a magnetic fur blush is used, it generally includes a charging member formed of various ferrite particles such as Zn—Cu ferrite, a non magnetic conductive sleeve to support the ferrite particles, and a magnet roll included in the non-magnetic conductive sleeve.

<Magnetic Brush Charging Device>

A schematic structure of an example of a magnetic brush charging device will be explained with reference to FIG. 3. The photoconductor 515 as an object to be charged and served as a latent electrostatic image bearing member is rotated at a predetermined speed (process speed) in the direction shown with the arrow in the figure. The brush roller 511 having a magnetic brush is brought in contact with the photoconductor 515, with a predetermined nip width and a predetermined pressure with respect to elasticity of the brush part 513.

The magnetic brush as the contact charging device of the present embodiment is formed of magnetic particles. In the magnetic particles, Z—Cu ferrite particles having an average particle diameter of 25 μm and Z—Cu ferrite particles having an average particle diameter of 10 μm are mixed in a ratio of 1/0.05 so as to form ferrite particles having peaks at each average particle diameter, and a total average particle diameter of 25 μm. The ferrite particles are coated with a resin layer having a moderate resistance so as to form the magnetic particles. The contact charging member of this embodiment formed of the above-mentioned coated magnetic particles, a non-magnetic conductive sleeve which supports the coated magnetic particles, and a magnet roller which is included in the non-magnetic conductive sleeve. The coated magnetic particles are disposed on the sleeve with a thickness of 1 mm so as to form a charging nip of about 5 mm-wide with the photoconductor. The width between the non-magnetic conductive sleeve and the photoconductor is adjusted to approximately 500 μm. The magnetic roller is rotated so as to subject the non-magnetic conductive sleeve to rotate at twice in speed relative to the peripheral speed of the surface of the photoconductor, and in the opposite direction with the photoconductor. Therefore, the magnetic brush is uniformly in contact with the photoconductor.

(Development Step)

Figure 4:
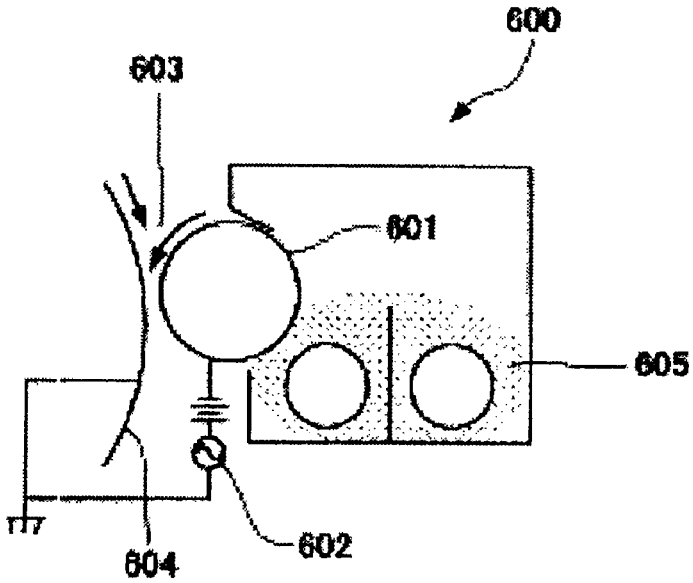
FIG. 4 is a schematic view for explaining one embodiment of a developing device used in an image forming method according to the present invention.

In the present invention, a latent electrostatic image on the photoconductor is developed preferably by applying an alternating voltage. In a developing device 600 (developing unit) shown in FIG. 4, a power supply 602 applies a vibration bias voltage as developing bias, in which a direct-current voltage and an alternating voltage are superimposed, to a developing sleeve 601 during development. The potential of background part and the potential of image part are positioned between the maximum and the minimum of the vibration bias potential. This forms an alternating field, whose direction alternately changes, at developing region 603. A toner and a carrier in the developer are intensively vibrated in this alternating field, so that the toner 605 overshoots the electrostatic force of constraint from the developing sleeve 601 and the carrier, and leaps to the photoconductor 604 served as a latent electrostatic image bearing member. The toner is then attached to the photoconductor 604 in accordance with a latent electrostatic image thereon. The toner 605 is a toner produced by the toner production method of the present invention.

The difference between the maximum and the minimum of the vibration bias voltage (peak-to-peak voltage) is preferably from 0.5 kV to 5 kV, and the frequency is preferably from 1 kHz to 10 kHz. The waveform of the vibration bias voltage may be a rectangular wave, a sine wave or a triangular wave. The direct-current voltage of the vibration bias voltage is in a range between the potential at the background and the potential at the image as mentioned above, and is preferably set closer to the potential at the background from viewpoints of inhibiting a toner deposition on the background.

When the vibration bias voltage is a rectangular wave, it is preferred that a duty ratio is 50% or less. The duty ratio is a ratio of time when the toner leaps to the photoconductor during a cycle of the vibration bias. In this way, the difference between the peak time value when the toner leaps to the photoconductor and the time average value of bias can become very large. Consequently, the movement of the toner becomes further activated hence the toner is accurately attached to the potential distribution of the latent electrostatic image and rough deposits and an image resolution can be improved. Moreover, the difference between the time peak value when the carrier having an opposite polarity of current to the toner leaps to the photoconductor and the time average value of bias can be decreased. Consequently the movement of the carrier can be restrained and the possibility of the carrier deposition on the background is largely reduced.

(Fixing Device)

Figure 5:
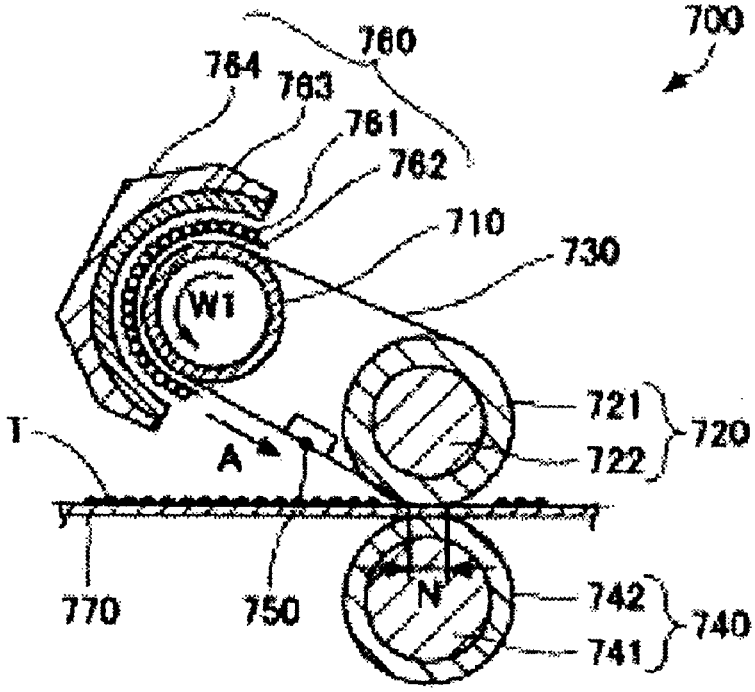
FIG. 5 is a schematic view for explaining one embodiment of a fixing device used in an image forming method according to the present invention.

As the fixing device (fixing unit) used in the image forming method of the present invention, for example, a fixing device shown in FIG. 5 can be used. The fixing device 700 shown in FIG. 5 preferably includes a heating roller 710 is heated by electromagnetic induction by means of a induction heating unit 760, a fixing roller 720 (facing rotator) disposed in parallel to this heating roller 710, a fixing belt (heat resistant belt, toner heating medium) 730, which is formed of an endless strip stretched between the heating roller 710 and the fixing roller 720 and which is heated by the heating roller 710 and rotated in an arrow direction A by any of these rollers, and a pressure roller 740 (pressing rotator) which is pressed against the fixing roller 720 through the fixing belt 730 and which is rotated in forward direction with respect to the fixing belt 730.

The heating roller 710 is made of a magnetic metal member of a hollow cylindrical shape, for example, iron, cobalt, nickel or an alloy of these metals. The heating roller 710 is 20 mm to 40 mm in an outer diameter, and 0.3 mm to 1.0 mm in thickness, to be in construction of low heat capacity and a rapid rise of temperature.

The fixing roller 720 (facing rotator) is formed of a core metal 722 made of metal, for example, stainless steel, and an elastic member 721 made of a solid or foam-like silicone rubber having a heat resistance to be coated on the core metal 722. Further, to form a contact section of a predetermined width between the pressure roller 740 and the fixing roller 720 by a compressive force provided by the pressure roller 740, the fixing roller 720 is constructed to be 20 mm to 40 mm in an outer diameter to be larger than the heating roller 710. The elastic member 721 is approximately 4 mm to 6 mm in thickness. Owing to this construction, the heat capacity of the heating roller 710 is smaller than the heat capacity of the fixing roller 720, so that the heating roller 710 is rapidly heated to make warm-up time period shorter.

The fixing belt 730 that stretched between the heating roller 710 and the fixing roller 720 is heated at a contact section W1 with the heating roller 710 to be heated by induction heating unit 760. Then, an inner surface of the belt 730 is continuously heated by the rotation of the heating roller 710 and the fixing roller 720, and as a result, the whole belt will be heated.

Figure 6:
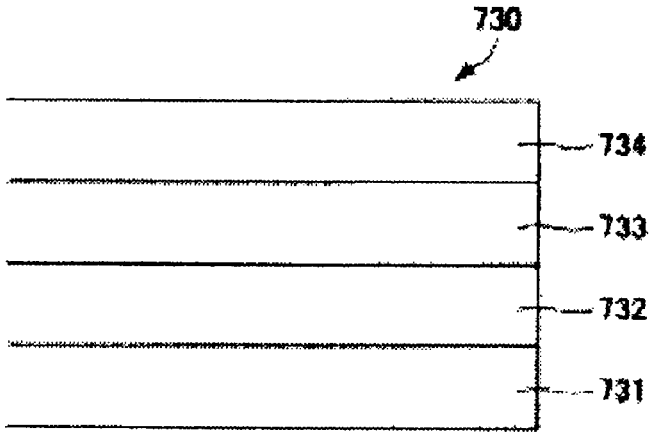
FIG. 6 is a schematic view for explaining one embodiment of a layer construction of a belt provided with a fixing device used in an image forming method according to the present invention.

FIG. 6 shows a layer structure of the fixing belt (730). The fixing belt (730) consists of the following four layers in the order from an inner layer to a surface layer.

A substrate (731): a resin layer, for example, formed of polyimide (PI)

A heat generating layer (732): a conductive material layer, for example, formed of Ni, Ag, SUS, and the like An intermediate layer (733): an elastic layer for uniform fixation A release layer (734): a resin layer, for example, formed of a fluorine resin material for obtaining releasing effect and making oilless.

The release layer 734 is preferably about 10 μm to about 300 μm in thickness, and more preferably approximately 200 μm. In this manner, in the fixing device 700 as shown in FIG. 5, since the surface layer of the fixing belt 730 sufficiently covers a toner image T formed on a recording medium 770, it becomes possible to uniformly heat and melt a toner image T. The release layer 734, i.e. a surface release layer needs to have a thickness of 10 μm at minimum in order to secure abrasion resistance over time. In addition, when the release layer 734 exceeds 300 μm in thickness, the heat capacity of the fixing belt 730 comes to be larger, resulting in a longer warm-up time period. Further, additionally, a surface temperature of the fixing belt 730 is unlikely to decrease in the toner-fixing step, a cohesion effect of melted toner at an outlet of the fixing portion cannot be obtained, and thus the so-called hot offset occurs in which a releasing property of the fixing belt 730 is lowered, and toner of a toner image (T) is adhered to the fixing belt 730. Moreover, as a base member of the fixing belt 730, the heat generating layer 732 formed of the metals may be used, or the resin layer having a heat resistance, such as a fluorine-based resin, a polyimide resin, a polyamide resin, a polyamide-imide resin, a PEEK resin, PES resin, and a PPS resin, may be used.

The pressure roller 740 is constructed of a core metal 741 of a cylindrical member made of metal having a high thermal conductivity, for example, copper or aluminum, and an elastic member 742 having a high heat resistance and toner releasing property that is located on the surface of this core metal 741. The core metal 741 may be made of SUS other than the above-described metals. The pressure roller 740 presses the fixing roller 720 through the fixing belt 730 to form a nip portion N. According to this embodiment, the pressure roller 740 is arranged to engage into the fixing roller 720 (and the fixing belt 730) by causing the hardness of the pressure roller 740 to be higher than that of the fixing roller 720, whereby the recording medium 770 is in conformity with the circumferential shape of the pressure roller 740, thus to provide the effect that the recording medium 770 is likely to come off from the surface of the fixing belt 730. This pressure roller 740 is approximately 20 mm to 40 mm in an external diameter as is the fixing roller 720. This pressure roller 740, however, is approximately 0.5 mm to 2.0 mm in thickness, to be thinner than the fixing roller 720.

The induction heating unit 760 for heating the heating roller 710 by electromagnetic induction, as shown in FIG. 5, includes an exciting coil 761 serving as a field generation unit, and a coil guide plate 762 around which this exciting coil 761 is wound. The coil guide plate 762 has a semi-cylindrical shape that is located close to the perimeter surface of the heating roller 710. The exciting coil 761, is the one in which one long exciting coil wire is wound alternately in an axial direction of the heating roller 710 along this coil guide plate 762. Further, in the exciting coil 761, an oscillation circuit is connected to a driving power source (not shown) of variable frequencies. Outside of the exciting coil 761, an exciting coil core 763 of a semi-cylindrical shape that is made of a ferromagnetic material such as ferrites is fixed to an exciting coil core support 764 to be located in the proximity of the exciting coil 761.

In FIG. 5, 750 denotes a temperature detecting member.

[Process Cartridge]

The process cartridge according to the present invention is adapted for use in an image forming apparatus, including an electrophotographic photoconductor, a charging unit configured to charge the electrophotographic photoconductor, an exposing unit configured to form a latent electrostatic image on the charged electrophotographic photoconductor, a developing unit configured to form a toner image with a toner from the latent electrostatic image formed on the electrophotographic photoconductor, a transfer unit configured to transfer the toner image formed on the electrophotographic photoconductor onto a recording medium through or without through an intermediate transfer member, a fixing unit configured to fix the toner image, which has been transferred onto the recording medium, onto the recording medium by a heat and pressure fixation member, and a cleaning unit configured to remove, by cleaning, the toner remaining untransferred and adhered on the surface of the electrophotographic photoconductor, from which the toner image has been transferred onto the intermediate transfer member or the recording medium by the transfer unit, the process cartridge including at least the electrophotographic photoconductor and the developing unit including a toner among the units constituting the image forming apparatus, the electrophotographic photoconductor and the developing unit including a toner being integrally supported and being detachably mounted on a body of the image forming apparatus. The developing unit includes the toner produced by the production process according to the present invention. The developing device and the charging device described above are suitable for use as the developing unit and the charging unit, respectively.

Figure 7:
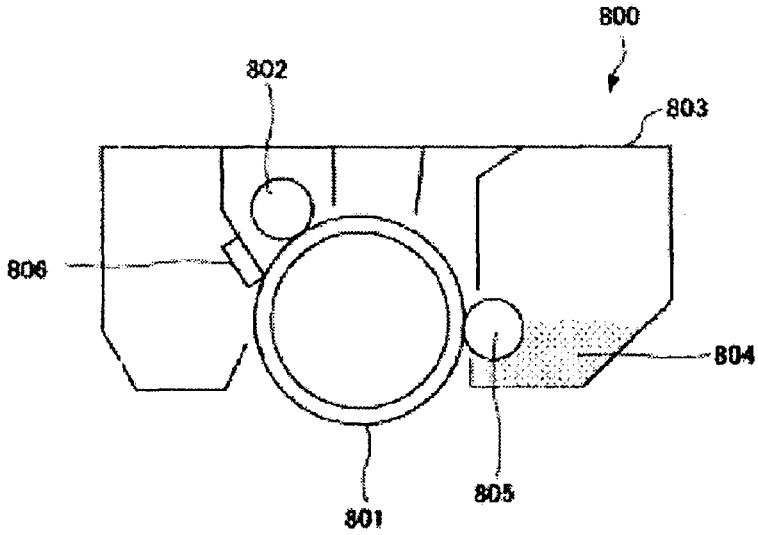
FIG. 7 is a schematic view for explaining one embodiment of a process cartridge according to the present invention.

An example of a process cartridge of the present invention is shown in FIG. 7. The process cartridge 800 shown in FIG. 7 includes a photoconductor 801, a charging unit 802, a developing unit 803, and a cleaning unit 806. In the operation of this process cartridge 800, the photoconductor 801 is rotationally driven at a specific peripheral speed. In the course of rotating, the photoconductor 801 receives from the charging unit 802 a uniform, positive or negative electrical charge of a specific potential around its periphery, and then receives image exposure light from an image exposing unit, such as slit exposure or laser beam scanning exposure, and in this way a latent electrostatic image is steadily formed on the periphery of the photoconductor 801. The electrostatic latent image thus formed is then developed with a toner by the developing unit 803, and the developed toner image is steadily transferred by a transfer unit onto a recording medium that is fed from a paper supplier to in between the photoconductor 801 and the transfer unit (not shown), in synchronization with the rotation of the photoconductor 801. The recording medium on which the image has been transferred is separated from the surface of the photoconductor 801, introduced into an image fixing unit (not shown) so as to fix the image thereon, and this product is printed out from the device as a copy or a print. The surface of the photoconductor 801 after the image transfer is cleaned by the cleaning unit 806 so as to remove the residual toner after the transfer, and is electrically neutralized and repeatedly used for image formation.

In FIG. 7, 804 denotes toner and 805 denotes a developing roller.

(Full-Color Image Forming Method)

Figure 8:
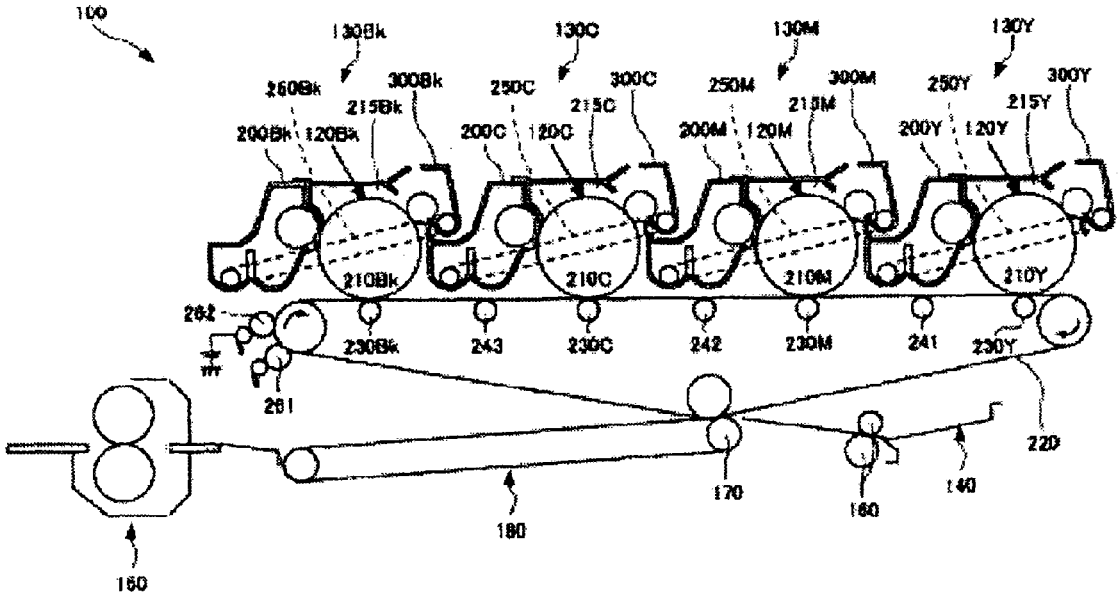
FIG. 8 is a schematic view for explaining one embodiment of a configuration of an image forming apparatus according to the present invention.
Figure 9:
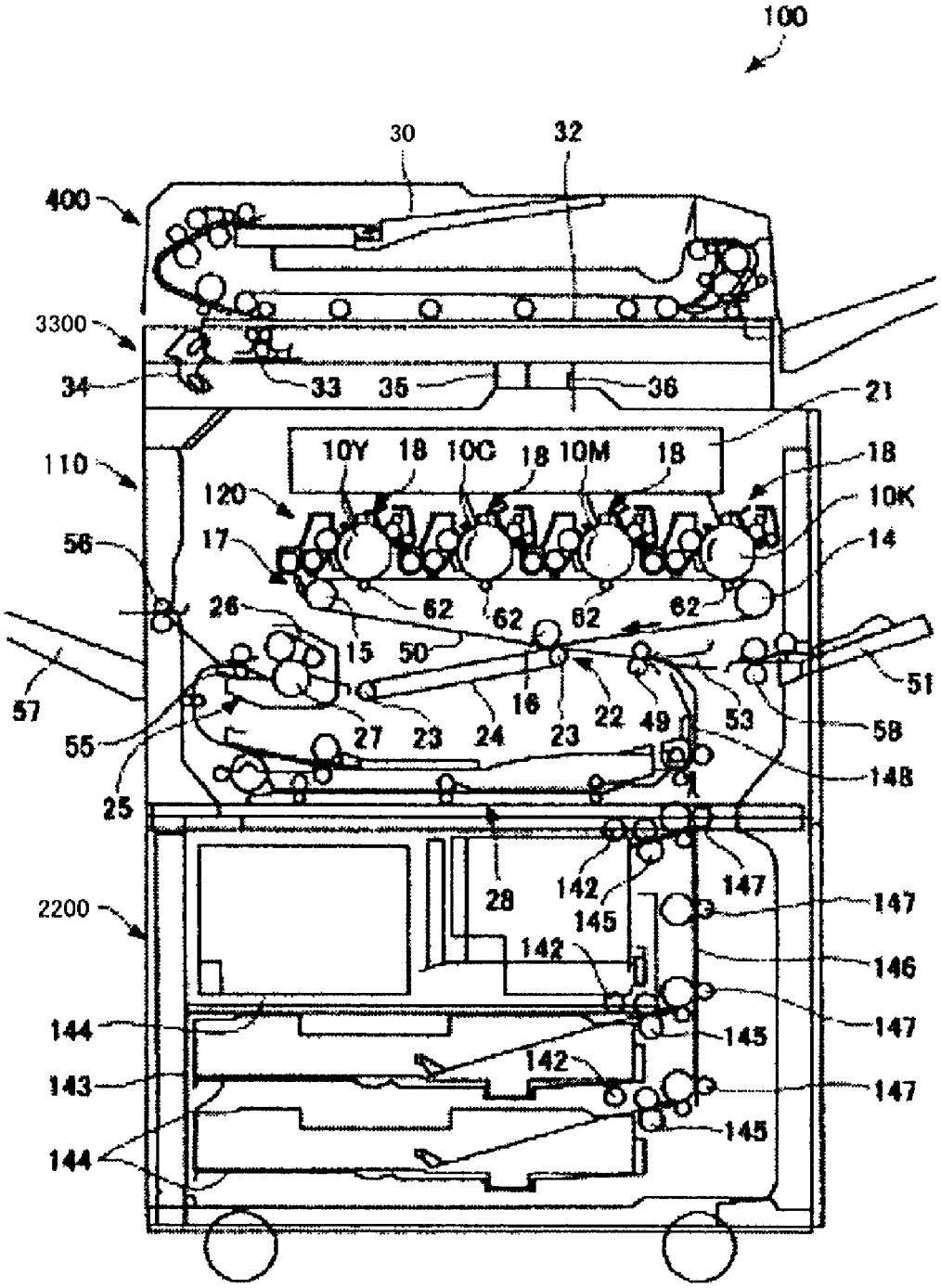
FIG. 9 is a schematic view for explaining another embodiment of a configuration of an image forming apparatus according to the present invention.

For example, a tandem-type image forming apparatus (100) shown in FIGS. 8 and 9 may be used as the full-color image forming apparatus used in the full-color image forming method according to the present invention. In FIG. 8, the image forming apparatus (100) mainly includes image writing units (120Bk, 120C, 120M, 120Y) for color image formation by an electrophotographic method, image forming units (130Bk, 130C, 130M, 130Y), and a paper feeder (140). According to image signals, image processing is performed in an image processing unit (not shown) for conversion to respective color signals of black (Bk), cyan (C), magenta (M), and yellow (Y) for image formation, and the color signals are sent to the image wiring units (120Bk, 120C, 120M, 120Y). The image writing units (120Bk, 120C, 120M, 120Y) are a laser scanning optical system that includes, for example, a laser beam source, a deflector such as a rotary polygon meter, a scanning imaging optical system, and a group of mirrors (all not shown), has four writing optical paths corresponding to the color signals, and performs image writing according to the color signals in the image forming units (130Bk, 130C, 130M, 130Y).

The image forming units (130Bk, 130C, 130M, 130Y) include photoconductors (210Bk, 210C, 210M, 210Y) respectively for black, cyan, magenta, and yellow. An OPC photoconductor is generally used in the photoconductors (210Bk, 210C, 210M, 210Y) for the respective colors. For example, chargers (215Bk, 215C, 215M, 215Y), an exposing unit for laser beams emitted from the image writing units (120Bk, 120C, 120M, 120Y), developing devices (200Bk, 200C, 200M, 200Y) for respective colors, primary transfer devices (230Bk, 230C, 230M, 230Y), cleaning devices (300Bk, 300C, 300M, 300Y), and charge-eliminating devices (not shown) are provided around the respective photoconductors (210Bk, 210C, 210M, 210Y). The developing devices (200Bk, 200C, 200M, 200Y) uses a two-component magnetic brush development system. Further, an intermediate transfer belt (220) is interposed between the photoconductors (210Bk, 210C, 210M, 210Y) and the primary transfer devices (230Bk, 230C, 230M, 230Y). Color toner images are successively transferred from respective photoconductors onto the intermediate transfer belt (220) to form superimposed toner images that are supported by the intermediate transfer belt (220).

In some cases, a pre-transfer charger (not shown) is preferably provided as a pre-transfer charging unit at a position that is outside the intermediate transfer belt (220) and after the passage of the final color through a primary transfer position and before a secondary transfer position. Before the toner images on the intermediate transfer belt (220), which have been transferred onto the photoconductors (210) in the primary transfer unit, are transferred onto a transfer paper as a recording medium, the pre-transfer charger charges toner images evenly to the same polarity.

The toner images on the intermediate transfer belt (220) transferred from the photoconductors (210Bk, 210C, 210M, 210Y) include a halftone portion and a solid image portion or a portion in which the level of superimposition of toners is different. Accordingly, in some cases, the charge amount varies from toner image to toner image. Further, due to separation discharge generated in spaces on an adjacent downstream side of the primary transfer unit in the direction of movement of the intermediate transfer belt, a variation in charge amount within toner images on the intermediate transfer belt (220) after the primary transfer sometimes occurs. The variation in charge amount within the same toner images disadvantageously lowers a transfer latitude in the secondary transfer unit that transfers the toner images on the intermediate transfer belt (220) onto the transfer paper. Accordingly, the toner images before transfer onto the transfer paper are evenly charged to the same polarity by the pretranfer charger to eliminate the variation in charge amount within the same toner images and to improve the transfer latitude in the secondary transfer unit.

Thus, according to the image forming method wherein the toner images located on the intermediate transfer belt (220) and transferred from the photoconductors (210Bk, 210C, 210M, 210Y) are evenly charged by the pre-transfer charger, even when a variation in charge amount of the toner images located on the intermediate transfer belt (220) exists, the transfer properties in the secondary transfer unit can be rendered substantially constant over each portion of the toner images located on the intermediate transfer belt (220). Accordingly, a lowering in the transfer latitude in the transfer of the toner images onto the transfer paper can be suppressed, and the toner images can be stably transferred.

In the image forming method, the amount of charge by the pre-transfer charger varies depending upon the moving speed of the intermediate transfer belt (220) as the charging object. For example, when the moving speed of the intermediate transfer belt (220) is low, the period of time, for which the same part in the toner images on the intermediate transfer belt (220) passes through a region of charging by the pre-transfer charger, increased. Therefore, in this case, the charge amount is increased. On the other hand, when the moving speed of the intermediate transfer belt (220) is high, the charge amount of the toner images on the intermediate transfer belt (220) is decreased. Accordingly, when the moving speed of the intermediate transfer belt (220) changes during the passage of the toner images on the intermediate transfer belt (220) through the position of charging by the pre-transfer charger, preferably, the pre-transfer charger is regulated according to the moving speed of the intermediate transfer belt (220) so that the charge amount of the toner images does not change during the passage of the toner images on the intermediate transfer belt (220) through the position of charging by the pre-transfer charger.

Electroconductive rollers (241), (242), (243) are provided between the primary transfer devices (230Bk, 230C, 230M, 230Y). The transfer paper is fed from a paper feeder (140), is supported on a transfer belt (180) through a resist roller pair (160). At a portion where the intermediate transfer belt (220) comes into contact with the transfer belt (500), the toner images on the intermediate transfer belt (220) are transferred by a secondary transfer roller (170) onto the transfer paper to form a color image.

The transfer paper after image formation is transferred by a secondary transfer belt (180) to a fixing device (150) where the color image is fixed to provide a fixed color image. The toner remaining untransferred on the intermediate transfer belt (220) is removed form the belt by intermediate transfer belt cleaning devices (261, 262).

The polarity of the toner on the intermediate transfer belt (220) before transfer onto the transfer paper has the same negative polarity as the polarity in the development. Accordingly, a positive transfer bias voltage is applied to the secondary transfer roller (170), and the toner is transferred onto the transfer paper. The nip pressure in this portion affects the transferability and significantly affects the fixability. The toner remaining untransferred and located on the intermediate transfer belt (220) is subjected to discharge electrification to positive polarity side, i.e., 0 to positive polarity, in a moment of the separation of the transfer paper from the intermediate transfer belt (220). Toner images formed on the transfer paper in jam or toner images in a non-image region of the transfer paper are not influenced by the secondary transfer and thus, of course, maintain negative polarity.

The thickness of the photoconductor layer, the beam spot diameter of the optical system, and the quantity of light are 30 μm, 50 μm×60 μm, and 0.47 mW, respectively. The development step is performed under such conditions that the charge (exposure side) potential V0 of the photoconductor (back) (210Bk) is −700V, potential VL after exposure is ±120V, and the development bias voltage is −470V, that is, the development potential is 350V. The visual image of the toner (black) formed on the photoconductor (black) (210Bk) is then subjected to transfer (intermediate transfer belt and transfer paper) and the fixation step and consequently is completed as an image. Regarding the transfer, all the colors are first transferred from the primary transfer devices (230Bk, 230C, 230M, 230Y) to the intermediate transfer belt (220) followed by transfer to the transfer paper by applying bias to a separate secondary transfer roller (170).

Next, the photoconductor cleaning device will be described in detail. In FIG. 8, the developing devices (200Bk, 200C, 200M, 200Y) are connected to respective cleaning devices (300Bk, 300C, 300M, 300Y) through toner transfer tubes (250Bk, 250C, 250M, 250Y) (dashed lines in FIG. 8). A screw (not shown) is provided within the toner transfer tubes (250Bk, 250C, 250M, 250Y), and the toners recovered in the cleaning devices (300Bk, 300C, 300M, 300Y) are transferred to the respective developing devices (200Bk, 200C, 200M, 200Y).

A conventional direct transfer system including a combination of four photoconductor drums with belt transfer has the following drawback. Specifically, upon abutting of the photoconductor against the transfer paper, paper dust is adhered onto the photoconductor. Therefore, the toner recovered from the photoconductor contains paper dust and thus cannot be used because, in the image formation, an image deterioration such as toner dropouts occurs. Further, in a conventional system including a combination of one photoconductor drum with intermediate transfer, the adoption of the intermediate transfer has eliminated a problem of the adherence of paper dust onto the photoconductor in the transfer onto the transfer paper. In this system, however, when recycling of the residual toner on the photoconductor is contemplated, the separation of the mixed color toners is practically impossible. The use of the mixed color toners as a black toner has been proposed. However, even when all the colors are mixed, a black color is not produced. Further, colors vary depending upon printing modes. Accordingly, in the one-photoconductor construction, recycling of the toner is impossible.

By contrast, in the full-color image forming apparatus, since the intermediate transfer belt (220) is used, the contamination with paper dust is not significant. Further, the adherence of paper dust onto the intermediate transfer belt (220) during the transfer onto the paper can also be prevented. Since each of the photoconductors (210Bk, 210C, 210M, 210Y) uses independent respective color toners, there is no need to perform contacting and separating of the photoconductor cleaning devices (300Bk, 300C, 300M, 300Y). Accordingly, only the toner can be reliably recovered.

The positively charged toner remaining untransferred on the intermediate transfer belt (220) is removed by cleaning with an electroconductive fur brush (262) to which a negative voltage has been applied. A voltage can be applied to an electroconductive fur brush (262) in the same manner as in the application of the voltage to the electroconductive fur brush (261), except that the polarity is different. The toner remaining untransferred can be almost completely removed by cleaning with the two electroconductive fur brushes (261), (262). The toner, paper dust, talc and the like, remaining unremoved by cleaning with the electroconductive fur brush (262) are negatively charged by a negative voltage of the electroconductive fur brush (262). The subsequent primary transfer of black is transfer by a positive voltage. Accordingly, the negatively charged toner and the like are attracted toward the intermediate transfer belt (220), and, thus, the transfer to the photoconductor (black) (210Bk) side can be prevented.

Next, the intermediate transfer belt (220) used in the image forming apparatus will be described. As described above, the intermediate transfer belt is preferably a resin layer having a single layer structure. If necessary, the intermediate transfer belt may additional have an elastic layer and a surface layer.

Examples the resin materials constituting the resin layer include, but not limited to, polycarbonate resins, fluorine resins (such as ETFE and PVDF); polystyrene resins, chloropolystyrene resins, poly-α-methylstyrene resins; styrene resins (monopolymers or copolymers containing styrene or styrene substituents) such as styrene-butadiene copolymers, styrene-vinyl chloride copolymers, styrene-vinyl acetate copolymers, styrene-maleic acid copolymers, styrene-acrylate copolymers (such as styrene-methyl acrylate copolymers, styrene-ethyl acrylate copolymers, styrene-butyl acrylate copolymers, styrene-octyl acrylate copolymers, and styrene-phenyl acrylate copolymers), styrene-methacrylate copolymers (such as styrene-methyl methacrylate copolymers, styrene-ethyl methacrylate copolymers and styrene-phenyl methacrylate copolymers); styrene-α-chloromethyl acrylate copolymers, styrene-acrylonitrile acrylate copolymers, methyl methacrylate resins, and butyl methacrylate resins ethyl acrylate resins, butyl acrylate resins, modified acrylic resins (such as silicone-modified acrylic resins, vinyl chloride resin-modified acrylic resins and acrylic urethane resins); vinyl chloride resins, styrene-vinyl acetate copolymers, vinyl chloride-vinyl acetate copolymers, rosin-modified maleic acid resins, phenol resins, epoxy resins, polyester resins, polyester polyurethane resins, polyethylene resins, polypropylene resins, polybutadiene resins, polyvinylidene chloride resins, ionomer resins, polyurethane resins, silicone resins, ketone resins, ethylene-ethylacrylate copolymers, xylene resins, polyvinylbutylal resins, polyamide resins and modified polyphenylene oxide resins. These resins may be used alone or in combination.

Examples of elastic materials (elastic rubbers, elastomers) constituting the elastic layer include, but not limited to, natural rubber, butyl rubber, fluorine-based rubber, acryl rubber, EPDM rubber, NBR rubber, acrylonitrile-butadiene-styrene rubber, isoprene rubber, styrene-butadiene rubber, butadiene rubber, ethylene-propylene rubber, ethylene-propylene terpolymers, chloroprene rubber, chlorosulfonated polyethylene, chlorinated polyethylene, urethane rubber, syndiotactic 1,2-polybutadiene, epichlorohydrin-based rubber, silicone rubber, fluorine rubber, polysulfide rubber, polynorbornene rubber, hydrogenated nitrile rubber, and thermoplastic elastomers (for example, polystyrene, polyolefin, polyvinyl chloride, polyurethane, polyimide, polyurea, polyester, fluorine resins). These rubbers may be used alone or in combination.

The material used for the surface layer is not particularly limited but is required to reduce toner adhesion force to the surface of the intermediate transfer belt so as to improve the secondary transfer property. The surface layer preferably contains one or two or more of polyurethane resin, polyester resin, and epoxy resin, and one or two or more of materials that reduce surface energy and enhance lubrication, for example, powders or particles such as fluorine resin, fluorine compound, carbon fluoride, titanium dioxide, and silicon carbide, or a dispersion of the materials having different particle diameters. In addition, it is possible to use a material such as fluorine rubber that is treated with heat so that a fluorine-rich layer is formed on the surface and the surface energy is reduced.

In the resin layer and elastic layer, a conductive agent for adjusting resistance is added. The conductive agent for adjusting resistance is not particularly limited and may be suitably selected according to the purpose. Examples thereof include, but not limited to, carbon black, graphite, metal powders such as aluminum and nickel; conductive metal oxides such as tin oxide titanium oxide, antimony oxide, indium oxide, potassium titanate, antimony tin oxide (ATO), and indium tin oxide (ITO). The conductive metal oxide may be coated with insulating fine particles such as barium sulfate, magnesium silicate, and calcium carbonate.

FIG. 9 shows another example of the image forming apparatus used in the image forming method of the present invention and is a copier 100 equipping an electrophotographic image forming apparatus of a tandem indirect transfer system. In FIG. 9, the copier 100 includes a copier main body 110, a paper feed table 2200 for mounting the copier main body 110, a scanner 3300, which is arranged over the copier main body 110, and an automatic document feeder (ADF) 400, which is arranged over the scanner 3300. The copier main body 110 has an endless belt intermediate transfer member 50 in the center.

The intermediate transfer member 50 is stretched around support rollers 14, 15, and 16 and rotates clockwise as shown in FIG. 9. An intermediate transfer member cleaning unit 17 for removing residual toner on the intermediate transfer member 50 is provided near the second support roller 15. A tandem image forming unit 120 has four image forming units 18 for yellow, cyan, magenta, and black, which face the intermediate transfer member 50 stretched around the first support roller 14 and the second support roller 15, and are arranged side by side in the transfer rotation direction thereof.

An exposing unit 21 is provided over the tandem image forming unit 120 as shown in FIG. 9. A second transfer unit 22 is provided across the intermediate transfer member 50 from the tandem image forming unit 120. The second transfer unit 22 has an endless second transfer belt 24 stretched around a pair of rollers 23, and is arranged so as to press against the third support roller 16 via the intermediate transfer member 50, thereby transferring an image carried on the intermediate transfer member 50 onto a sheet. A fixing unit 25 configured to fix the transferred image on the sheet is provided near the second transfer unit 22. The fixing unit 25 has an endless fixing belt 26 and a pressure roller 27 pressed against the fixing belt 26. The second transfer unit 22 includes a sheet conveyance function in which the sheet on which the image has been transferred is conveyed to the fixing unit 25. As the second transfer unit 22, a transfer roller or a non-contact charge may be provided, however, these are difficult to provide in conjunction with the sheet conveyance function. A sheet inversion unit 28 for forming images on both sides of a sheet is provided parallel to the tandem image forming unit 120 and under the second transfer unit 22 and fixing unit 25.

At first, a document is placed on a document table 30 of an automatic document feeder (ADF) 400, when a copy is made using the color electrophotographic apparatus. Alternatively, the automatic document feeder 400 is opened, the document is placed onto a contact glass 32 of the scanner 3300, and the automatic document feeder 400 is closed.

When a start switch (not shown) is pushed, a document placed on the automatic document feeder 400 is conveyed onto the contact glass 32. When the document is initially placed on the contact glass 32, the scanner 3300 is immediately driven to operate a first carriage 33 and a second carriage 34. At the first carriage 33, light is applied from a light source to the document, and reflected light from the document is further reflected toward the second carriage 34. The reflected light is further reflected by a mirror of the second carriage 34 and passes through image-forming lens 35 into a read sensor 36 to thereby read the document.

When the start switch is pushed, a drive motor (not shown) drives one of support rollers 14, 15 and 16 to rotate, causing the other two support rollers to rotate by the rotation of the driven support roller. In this way the intermediate transfer member 50 endlessly runs around the support rollers 14, 15 and 16. Simultaneously, the individual image forming units 18 respectively rotate their photoconductors 10K, 10Y, 10M and 10C to thereby form black, yellow, magenta, and cyan monochrome images on the photoconductors 10K, 10Y, 10M and 10C, respectively. With the conveyance of the intermediate transfer member 50, the monochrome images are sequentially transferred to form a composite color image on the intermediate transfer member 50.

In FIG. 9, 62 denotes a transfer charging device.

Separately, when the start switch (not shown) is pushed, one of feeder rollers 142 of the feeder table 2200 is selectively rotated, sheets are ejected from one of multiple feeder cassettes 144 in a paper bank 143 and are separated in a separation roller 145 one by one into a feeder path 146, are transported by a transport roller 147 into a feeder path 148 in the copier main body 110 and are bumped against a resist roller 49.

Alternatively, pushing the start switch (not shown) rotates a feeder roller 142 to eject sheets on a manual bypass tray 51, the sheets are separated one by one on a separation roller 58 into a manual bypass feeder path 53 and are bumped against the resist roller 49.

The resist roller 49 is rotated synchronously with the movement of the composite color image on the intermediate transfer member 50 to transport the sheet into between the intermediate transfer member 50 and the secondary transfer unit 22, and the composite color image is transferred onto the sheet by action of the secondary transfer unit 22 to thereby form a color image.

The sheet on which the image has been transferred is conveyed by the secondary transfer unit 22 into the fixing unit 25, is given heat and pressure in the fixing unit 25 to fix the transferred image, changes its direction by action of a switch claw 55, and is ejected by an ejecting roller 56 to be stacked on an output tray 57. Alternatively, the moving direction of the paper is changed by the switching claw 55, and the paper is conveyed to the sheet inversion unit 28 where it is inverted, and guided again to the transfer position in order that an image is formed also on the back surface thereof, then the paper is ejected by the ejecting roller 56 and stacked on the output tray 57.

On the other hand, in the intermediate transfer member (50) after the image transfer, the toner, which remains on the intermediate transfer member 50 after the image transfer, is removed by the intermediate transfer member cleaning device 17, and the intermediate transfer member 50 again gets ready for image formation by the tandem image forming unit 120. The resist roller 49 is generally used in a grounded state. Bias can also be applied to the resist roller 49 to remove paper dust of the paper sheet.

EXAMPLES

The present invention will be described in more detail with reference to the following Examples and Comparative Examples. However, it should be noted that the present invention is not limited by these Examples and Comparative Examples. In the Examples, "part(s)" and "%" are by mass unless otherwise specified.

[Production of Toner]

A specific example of producing a toner used for evaluation will be explained. The toner used in the present invention is not limited to these Examples.

(Preparation of Solution and/or a Dispersion Liquid of Toner Material)

Into a reaction vessel with a cooling pipe, a stirrer, and a nitrogen gas inlet tube 67 parts of bisphenol A ethyleneoxide (2 mol) adduct, 84 parts of bisphenol A propionoxide (3 mol) adduct, 274 parts of terephthalic acid, and 2 parts of dibutyltin oxide were loaded, allowing reaction for 8 hours at 230° C. under normal pressure. Subsequently, the reaction liquid was reacted for 5 hours under reduced pressure of 10 mmHg to 15 mmHg, to thereby synthesize a non-modified polyester.

The non-modified polyester thus obtained had a number-average molecular weight (Mn) of 2,100, a weight average molecular weight of 5,600, and a glass transition temperature (Tg) of 55° C.

-Preparation of Master Batch (MB)-

1,000 parts of water, 540 parts of carbon black ("Printex 35"; manufactured by Degussa; DBP oil absorption amount: 42 ml/100 g; pH 9.5), and 1,200 parts of the non-modified polyester were mixed by means of HENSCHEL MIXER (manufactured by Mitsui Mining Co., Ltd.). The mixture was kneaded at 150° C. for 30 minutes by a two-roller mill, cold-rolled, and milled by a pulverizer (manufactured by Hosokawa micron Co., Ltd.), to thereby prepare a master batch MB1.

-Synthesis of Prepolymer-

Into a reaction vessel with a cooling pipe, a stirrer, and a nitrogen gas inlet tube 682 parts of bisphenol A ethyleneoxide (2 mol) adduct, 81 parts of bisphenol A propionoxide (2 mol) adduct, 283 parts of terephthalic acid, 22 parts of trimellitic anhydride, and 2 parts of dibutyltin oxide were loaded, allowing reaction for 8 hours at 230° C. under normal pressure. Subsequently, the react on liquid was reacted for 5 hours under reduced pressure of 10 mmHg to 15 mmHg, to thereby synthesize a "intermediate polyester". The intermediate polyester thus obtained had a number-average molecular weight (Mn) of 2,100, a weight average molecular weight (Mw) of 9,600, a glass transition temperature (Tg) of 55° C., an acid value of 0.5 mgKOH/g, and a hydroxyl group value of 49 mgKOH/g.

Subsequently, into a reaction vessel with a cooling pipe, a stirrer, and a nitrogen gas inlet tube, 411 parts of the intermediate polyester, 89 parts of isophorone diisocyanate, and 500 parts of acetic ether were loaded, allowing reaction for 5 hours at 100° C. to thereby synthesize a prepolymer (i.e. a polymer reactive with the active hydrogen group-containing compound). The prepolymer thus obtained had a free isocyanate content of 1.60% and solid content concentration of 50% (150° C., after leaving for 45 minutes).

-Preparation of Toner Material Phase-

In a beaker, 100 parts of the non-modified polyester, and 130 parts of ethyl acetate were stirred and dissolved. Next, 10 parts of carnauba wax (molecular weight=1,800, acid value=2.5 mgKOH/g and penetration=1.5 mm (40° C.)) and 10 parts of the master batch were placed and a material solution was prepared by using a bead mill ("Ultra Visco Mill" by Imex Co., Ltd.) under the condition of a liquid feed rate of 1 kg/hr, disc circumferential velocity of 6 m/s, 0.5 mm zirconia beads packed to 80% by volume, and 3 passes. Subsequently, 40 parts of the prepolymer was added to the material solution, and stirred to prepare a solution and/or dispersion liquid of toner material.

(Preparation of Resin Fine Particles)

Into a reaction vessel equipped with a stirring rod and a thermometer, 683 parts of water, 16 parts of sodium salt of sulfuric acid ester of ethylene oxide adduct of methacrylic acid, Eleminol RS-30 (manufactured by Sanyo Chemical Industries Ltd.), 83 parts of styrene, 83 parts of methacrylic acid, 110 parts of butyl acrylate, and 1 part of ammonium persulfate were loaded, and then stirred at 400 rpm for 15 minutes to thereby obtain a white emulsion. The emulsion was heated to a system temperature of 75° C. and was allowed to react for 5 hours. Then, 30 parts of a 1% by volume aqueous ammonium persulfate solution was added to the reaction mixture, followed by aging at 75° C. for 5 hours, to thereby obtain an aqueous dispersion (resin fine particle dispersion liquid) of vinyl resin (a copolymer of styrene-methacrylic acid-butyl acrylate-sodium salt of sulfate ester of methacrylic acid-ethylene oxide adduct). The volume-average particle diameter of the resin fine particle dispersion liquid thus obtained, which was measured using a particle size distribution analyzer (LA-920 manufactured by Horiba, Ltd.), was 42 nm.

(Preparation of Resin Particles)

Production Example 1

Synthesis of Resin Particle 1

An aqueous dispersion liquid containing Resin Particle 1 was produced by reacting an aqueous solution, prepared by adding 5 parts of an anionic surfactant (a sodium alkyl sulfate) and 3 parts of a polymerization initiator (potassium persulfate) to 516 parts of ion-exchanged water, with a monomer solution containing 26 parts of a methacryloxy group-containing cage-type fluoroalkylsilsesquioxane (XQ1159, manufactured by Chisso Corporation), 104 parts of methyl methacrylate, and 7 parts of divinylbenzene with a high-speed emulsification polymerization apparatus (manufactured by Chisso Corporation) at 70° C. for 6 hr.

For Resin Particle 1, the volume average particle diameter as determined with a particle diameter measuring device (ELS-500SD, manufactured by Otsuka Electronics Co., Ltd.) was 110 nm, and the polydispersity index was 0.2.

Production Example 2

Synthesis of Resin Particle 2

An aqueous dispersion liquid containing Resin Particle 2 was synthesized in the same manner as in Production Example 1, except that the amount of XQ1159 and the amount of methyl methacrylate were changed to 13 parts and 117 parts, respectively. For Resin Particle 2, the volume average particle diameter and the polydispersity index were 100 nm and 0.2, respectively.

Production Example 3

Synthesis of Resin Particle 3

An aqueous dispersion liquid containing Resin Particle 3 was synthesized in the same manner as in Production Example 1, except that the amount of XQ1159 and the amount of methyl methacrylate were changed to 1 part and 129 parts, respectively. For the Resin Particle 3, the volume average particle diameter and the polydispersity index were 100 nm and 0.2, respectively.

Production Example 4

Synthesis of Resin Particle 4

An aqueous dispersion liquid containing Resin Particle 4 was synthesized in the same manner as in Production Example 1, except that the amount of the anionic surfactant (sodium alkylsulfate) was three times the amount of the anionic surfactant in Production Example 1. For Resin Particle 4, the volume average particle diameter and the polydispersity index were 60 nm and 0.2, respectively.

Production Example 5

Synthesis of Resin Particle 5

An aqueous dispersion liquid containing Resin Particle 5 was synthesized in the same manner as in Production Example 1, except that the amount of the anionic surfactant (sodium alkyl sulfate) was one-tenth of the amount of the anionic surfactant in Production Example 1. For the Resin Particle 5, the volume average particle diameter and the polydispersity index were 170 nm and 0.1, respectively.

Production Example 6

Synthesis of Resin Particle 6

An aqueous dispersion liquid containing Resin Particle 6 was synthesized in the same manner as in Production Example 1, except that XQ1159 was not added, and the amount of methyl methacrylate was changed to 130 parts. For Resin Particle 6, the volume average particle diameter and the polydispersity index were 90 nm and 0.2, respectively.

Production Example 7

Synthesis of Resin Particle 7

An aqueous dispersion liquid containing Resin Particle 7 was synthesized in the same manner as in Production Example 1, except that XQ1159 was changed to methacryl-isobutyl POSS (MA0702, manufactured by Hybrid Plastics Inc.). For Resin Particle 7, the volume average particle diameter and the polydispersity index were 90 nm and 0.2, respectively.

Production Example 8

Synthesis of Resin Particle 8

An aqueous dispersion liquid containing Resin Particle 8 was synthesized in the same manner as in Production Example 1, except that the XQ1159 was changed to methacrylethyl POSS (MA0717, manufactured by Hybrid Plastics Inc.). For the Resin Particle 8, the volume average particle diameter and the polydispersity index were 80 nm and 0.2, respectively.

Production Example 9

Synthesis of Resin Particle 9

An aqueous dispersion liquid containing Resin Particle 9 was synthesized in the same manner as in Production Example 1, except that the XQ1159 was changed to methacrylate cyclohexyl POSS (MA0703, manufactured by Hybrid Plastics Inc.).

Production Example 10

Synthesis of Resin Particle 10

An aqueous dispersion liquid containing Resin Particle 10 was synthesized in the same manner as in Production Example 1, except that XQ1159 was changed to methacrylisooctyl POSS (MA0719, manufactured by Hybrid Plastics Inc.).

Production Example 11

Synthesis of Resin Particle 11

An aqueous dispersion liquid containing Resin Particle 11 was synthesized in the same manner as in Production Example 1, except that XQ1159 was changed to methacrylphenyl POSS (MA0734, manufactured by Hybrid Plastics Inc.).

Production Example 12

Synthesis of Resin Particle 12

An aqueous dispersion liquid containing Resin Particle 12 was synthesized in the same manner as in Production Example 1, except that XQ1159 was changed to methacrylxypropylheptacyclopentyl-T8-silsesquioxane (SIM6486.6, manufactured by Gelest, Inc.).

The properties of fluorine (F) content, silicon (Si) content, and volume average particle diameter of the resin particles are shown in Table 1.

The content of F and the content of Si on a mass basis in the resin particles shown in Table 1 were calculated from the monomer composition when starting materials are charged.

The average particle diameter was determined as follows. An aqueous dispersion liquid containing resin particles (solid content 20%) was diluted with pure water to a solid content of 0.1%, and the average particle diameter was measured with a zeta potential/particle measuring system (ELS-5000SD, manufactured by Otsuka Electronics Co., Ltd.).

All of Production Examples 1 to 12 except for Production Example 6 are Examples of the resin particles of the present invention.

TABLE 1

| Resin Particle | F (wt %) | Si (wt %) | Average particle diameter (nm) |
|---|---|---|---|
| Resin Particle 1 | 6 | 4 | 110 |
| Resin Particle 2 | 3 | 2 | 100 |
| Resin Particle 3 | 0.3 | 0.2 | 100 |
| Resin Particle 4 | 6 | 4 | 60 |
| Resin Particle 5 | 6 | 4 | 170 |
| Resin Particle 6 | 0 | 0 | 90 |
| Resin Particle 7 | 0 | 0.2 | 90 |
| Resin Particle 8 | 0 | 0.3 | 80 |

Example 1

(Production of Toner a)

-Preparation of Aqueous Medium Phase- 660 parts of water, 25 parts of the fine particle dispersion liquid, and 25 parts of a 48.5% aqueous solution of sodium dodecyl diphenyl ether disulfonate ("ELEMINOL MON-7"; manufactured by Sanyo Chemical Industries, Ltd.) and 60 parts of ethyl acetate were mixed together while stirring to give a milk-white liquid (water phase). Further, 50 parts of the dispersion of Resin Particle 1 regulated to a solid content of 20% are added to the milk-white liquid. When the mixture was observed under an optical microscope, coagulates having a size of a few hundreds of μm were found. The observation under an optical microscope showed that when the aqueous medium phase was stirred with a TK homomixer (manufactured by Tokushu Kika Kogyo Co., Ltd.) at a rotation speed of 8000 rpm, the coagulates could be loosened and dispersed. Accordingly, it could be expected that, also in the step of emulsifying a toner material which is performed later, Resin Particle 1 could be dispersed and adhered on liquid droplets of the toner material components. Thus, from the viewpoint of adhering Resin Particle 1 evenly on the surface of the toner, it is important that, even when, in an early stage, coagulation occurs to a certain extent due to lack of stability, the coagulates are loosened by shear.

-Preparation of Emulsion and/or Dispersion Liquid- 150 parts of the aqueous medium phase was placed in a container and was stirred at a rotation speed of 12,000 rpm with a TK homomixer (manufactured by Tokushu Kika Kogyo Co., Ltd.). 100 parts of the solution and/or dispersion liquid of the toner material was added thereto, and the mixture was mixed for 10 min to give an emulsion and/or dispersion liquid (an emulsified slurry).

-Removal of Organic Solvent-

A flask equipped with a degassing tube, a stirrer, and a thermometer was charged with 100 parts of the emulsified slurry. The solvent was removed by stirring the emulsified slurry under conditions of stirring circumferential velocity of 20 m/min at 30° C. for 12 hr under reduced pressure to give a desolvated slurry. Thereafter, the dispersion was heated at 60° C. for 2 hr to fix Resin Particle 1 adhered on the surface of the toner.

-Washing/Drying-

The whole amount of the desolvated slurry was filtered under reduced pressure. 300 parts of ion-exchanged water was added to the filter cake followed by mixing and redispersion (at a rotation speed of 12,000 rpm for 10 min) with a TK homomixer. The dispersion was then filtered. 300 parts of ion-exchanged water was added to the filter cake, and the mixture was mixed with a TK homomixer (at a rotation speed of 12,000 rpm for 10 min). The dispersion was then filtered. The above procedure was repeated three times. The filter cake thus obtained was dried in a downwind drier at 45° C. for 48 hr. The dried product was sieved through a sieve with 75 μm-mesh opening to give Toner base particle a having a mass average particle diameter of 5.2 μm.

-External Addition Treatment- 100 parts of Toner base particle a was mixed with 0.6 parts of hydrophobic silica having an average particle diameter of 100 nm, 1.0 part of titanium oxide having an average particle diameter of 20 nm, and 0.8 parts of a fine powder of hydrophobic silica having an average particle diameter of 15 nm with a HENSCHEL MIXER to give Toner a.

Example 2

Production of Toner b

Toner b having a mass average particle diameter of 5.1 μm was produced in the same manner as in Example 1, except that Resin Particle 2 was used instead of Resin Particle 1. In the Resin Particle 2 used in Toner b, both the content of fluorine and the content of silicon in fluorosilsesquioxane are low, and the Resin Particle 2 is not compatible with the binder resin and has high swellability.

Example 3

Production of Toner c

Toner c having a mass average particle diameter of 5.3 μm was produced in the same manner as in Example 1, except that Resin Particle 3 was used instead of Resin Particle 1. In the Resin Particle 3 used in Toner c, both the content of fluorine and the content of silicon in fluorosilsesquioxane are low, and the Resin Particle 2 is not compatible with the binder resin and has high swell ability.

Example 4

Production of Toner d

Toner d having a mass average particle diameter of 5.0 μm was produced in the same manner as in Example 1, except that Resin Particle 4 was used instead of Resin Particle 1.

Example 5

Production of Toner e

Toner e having a mass average particle diameter of 5.3 μm was produced in the same manner as in Example 1, except that Resin Particle 5 was used instead of Resin Particle 1.

Comparative Example 1

Production of Toner f

Toner f having a mass average particle diameter of 4.9 μm was produced in the same manner as in Example 1, except that Resin Particle 6 was used instead of Resin Particle 1.

Example 6

Production of Toner g

Toner g having a mass average particle diameter of 5.2 μm was produced in the same manner as in Example 1, except that Resin Particle 7 was used instead of Resin Particle 1.

Example 7

Production of Toner h

Toner h having a mass average particle diameter of 4.8 μm was produced in the same manner as in Example 1, except that Resin Particle 8 was used instead of Resin Particle 1.

Example 8

Production of Toner i

Toner i having a mass average particle diameter of 4.9 μm was produced in the same manner as in Example 1, except that Resin Particle 9 was used instead of Resin Particle 1.

Example 9

Production of Toner j

Toner j having a mass average particle diameter of 5.1 μm was produced in the same manner as in Example 1, except that Resin Particle 10 was used instead of Resin Particle 1.

Example 10

Production of Toner k

Toner k having a mass average particle diameter of 5.1 μm was produced in the same manner as in Example 1, except that Resin Particle 11 was used instead of Resin Particle 1.

Example 11

Production of Toner l

Toner l having a mass average particle diameter of 5.0 μm was produced in the same manner as in Example 1, except that Resin Particle 12 was used instead of Resin Particle 1.

Comparative Example 2

Production of Toner m

Toner m having a mass average particle diameter of 5.2 μm was produced in the same manner as in Example 1, except that Resin Particle 1 was not used.

Example 12

Production of Toner n

Toner n having a mass average particle diameter of 5.3 μm was produced in the same manner as in Example 1, except that, after desolvation, the dispersion was heated at 70° C. for 6 hr.

Example 13

Production of Toner o

Toner o having a mass average particle diameter of 5.0 μm was produced in the same manner as in Example 1, except that, after desolvation, the dispersion liquid was not heated.

Example 14

Preparation of Toner Material Phase 100 parts of a styrene monomer and 30 parts of n-butyl acrylate were mixed together while stirring in a beaker, Subsequently, 10 parts of carnauba wax (molecular weight=1,800, acid value=2.5, penetration=1.5 mm (40° C.)), and 10 parts of the master batch MB1 were charged, and the mixture was subjected to three passes with a bead mill ("Ultra Visco Mill"; manufactured by Aimex Co., Ltd.) under conditions of liquid feed speed 1 kg/hr, disk peripheral velocity 6 m/s, and 0.5-mm zirconia bead packing ratio 80% by volume. Thereafter, 2 parts of azobisisobutyronitrile was added to the mixture to prepare a solution and/or dispersion liquid of the toner material.

-Preparation of Aqueous Medium Phase- 6 parts of a partially saponified polyvinyl alcohol was dissolved in 200 parts of water with heating at 50° C. The solution was then cooled to give an aqueous phase medium. Further, 10 parts of a dispersion of Resin Particle 1 having a solid content regulated to 20% was added.

-Preparation of Emulsion and/or Dispersion Liquid- 150 parts of the aqueous medium phase was placed in a container and was stirred with a TK homomixer (manufactured by Tokushu Kika Kogyo Co., Ltd.) at a rotation speed of 12,000 rpm. 75 parts of the solution and/or dispersion of the toner material were added thereto followed by mixing for 10 min to prepare an emulsion and/or dispersion liquid (an emulsified slurry).

-Polymerization Reaction-

A flask equipped with a tube for a nitrogen gas, a stirrer, and a thermometer was charged with 100 parts of the emulsified slurry. The air in the flask was replaced with a nitrogen gas. Thereafter, a polymerization reaction was allowed to proceed at 50° C. for 12 hr with stirring at a stirring peripheral velocity of 10 m/min to give a slurry. Thereafter, the dispersion was heated at 65° C. for 2 hr to fix Resin fine particle 1 adhered on the surface of the toner.

-Washing/Drying-

The whole amount of the polymer fine particle adhered slurry was filtered under reduced pressure. 300 parts of ion-exchanged water was then added to the filter cake followed by mixing and redispersion (at a rotation speed of 12,000 rpm for 10 min) with a TK homomixer. The dispersion was then filtered. 300 parts of ion-exchanged water was added to the filter cake, and the mixture was mixed with a TK homomixer (at a rotation speed of 12,000 rpm for 10 min). The dispersion was then filtered. The above procedure was repeated three times. The filter cake thus obtained was dried in a downwind drier at 45° C. for 48 hr. The dried product was sieved through a sieve with 75 μm-mesh opening to give Toner base particle a having p mass average particle diameter of 5.8 μm.

-External Addition Treatment- 100 parts of Toner base particle p was mixed with 0.6 parts of hydrophobic silica having an average particle diameter of 100 nm, 1.0 part of titanium oxide having an average particle diameter of 20 nm, and 0.8 parts of a fine powder of hydrophobic silica having an average particle diameter of 15 nm with a HENSCHEL MIXER to give Toner p.

Example 15

Production of Toner q

Toner q having a mass average particle diameter of 5.7 μm was produced in the same manner as in Example 14, except that Resin Particle 2 was used instead of Resin Particle 1.

Example 16

Production of toner r

Toner r having a mass average particle diameter of 5.8 μm was produced in the same manner as in Example 15, except that, after desolvation, the dispersion liquid was not heated.

Comparative Example 3

Production of Toner s

Toner s having a mass average particle diameter of 5.7 μm was produced in the same manner as in Example 14, except that Resin Particle 6 was used instead of Resin Particle 1.

Comparative Example 4

Production of Toner t

Toner t having a mass average particle diameter of 6.0 μm was produced in the same manner as in Example 14, except that Resin Particle 1 was not used.

Example 17

Preparation of Resin Dispersion

A reaction vessel equipped with a stirring rod and a thermometer was charged with 600 parts of water, 3 parts of sodium dodecylbenzenesulfonate, 160 parts of styrene, 40 parts of n-butyl acrylate, and 1 part of ammonium persulfate. The mixture was stirred at 400 rpm for 15 min while replacing the air in the reaction vessel by a nitrogen gas. As a result, a white emulsion was produced. The white emulsion was heated until the temperature within the system reached 75° C., and a reaction was allowed to proceed for 5 hr. Further, 30 parts of a 1% aqueous ammonium persulfate solution was added thereto, and the mixture was ripened at 75° C. for 5 hr to give an aqueous resin dispersion of a vinyl resin (styrene-n-butyl acrylate copolymer).

-Preparation of Toner Material Phase- 100 parts of water, 1 part of sodium dodecylbenzenesulfonate, 10 parts of carnauba wax (molecular weight=1,800, acid value=2.5, penetration=1.5 mm (40° C.)), and 15 parts of carbon black were charged, and the mixture was subjected to ten passes with a bead mill ("Ultra Visco Mill"; manufactured by Aimex Co., Ltd.) under conditions of liquid feed speed 1 kg/hr, disk peripheral velocity 6 m/s, and 0.5-mm zirconia bead packing ratio 80% by volume. Thereafter, 800 parts of the aqueous resin dispersion of the synthesized vinyl resin (styrene-n-butyl acrylate copolymer) was added thereto and mixed therewith to prepare a solution and/or dispersion liquid of the toner material.

-Preparation of Toner Particle Dispersion- 150 parts of the solution and/or dispersion of the toner material was placed in a vessel. The temperature of the contents in the vessel was set to 50° C. While stirring at a rotation speed of 3000 rpm with a TK homomixer (manufactured by Tokushu Kika Kogyo Co., Ltd.), 10 parts of a 10% calcium chloride solution was gradually added to the solution to give coagulates. The contents of the vessel was cooled to room temperature. While stirring at a rotation speed of 3000 rpm with a TK homomixer (manufactured by Tokushu Kika Kogyo Co., Ltd.), 7.5 parts of the dispersion of Resin Particle 1 was further gradually added to give coagulates of the toner composition. Thereafter, the dispersion was heated at 65° C. for 2 hr to fix Resin Particle 1 adhered on the surface of the toner.

-Washing/Drying-

The whole amount of the slurry after the fixation treatment was filtered under reduced pressure. 300 parts of ion-exchanged water was added to the filter cake followed by mixing and redispersion (at a rotation speed of 12,000 rpm for 10 min) with a TK homomixer. The dispersion was then filtered. 300 parts of ion-exchanged water was added to the filter cake thus obtained, and the mixture was mixed with a TK homomixer (at a rotation speed of 12,000 rpm for 10 min). The dispersion was then filtered. The above procedure was repeated three times. The filter cake thus obtained was dried in a downwind drier at 45° C. for 48 hr. The dried product was sieved through a sieve with 75 μm-mesh opening to give Toner base particle u having a mass average particle diameter of 5.0 μm.

-External Addition Treatment- 100 parts of Toner base particle o was mixed with 0.6 parts of hydrophobic silica having an average particle diameter of 100 nm, 1.0 part of titanium oxide having an average particle diameter of 20 nm, and 0.8 parts of a fine powder of hydrophobic silica having an average particle diameter of 15 nm with a HENSCHEL MIXER to give Toner u.

Example 18

Production of Toner v

Toner v having a mass average particle diameter of 5.1 μm was produced in the same manner as in Example 17, except that Resin Particle 2 was used instead of Resin Particle 1.

Example 19

Production of Toner w

Toner w having a mass average particle diameter of 4.8 μm was produced in the same manner as in Example 17, except that the dispersion liquid after the formation of toner composition coagulates was not heated and Resin Particle 1 adhered onto the toner surface was not fixed.

Comparative Example 5

Production of Toner x

Toner x having a mass average particle diameter of 55.0 μm was produced in the same manner as in Example 17, except that Resin Particle 6 was used instead of Resin Particle 1.

Comparative Example 6

Production of Toner y

Toner y having a mass average particle diameter of 4.9 μm was produced in the same manner as in Example 17, except that Resin Particle 1 was not used.

Properties of the toners produced in Examples 1 to 19 and Comparative Examples 1 to 6 are shown in Table 2.

TABLE 2

| Example | Production process | Resin particle | Circularity | BAT specific surface area ($m^2/g$) | Saturated charge quantity (C/g) |
|---|---|---|---|---|---|
| Example 1 | Dissolution suspension process | Resin particle 1 | 0.975 | 2.4 | −45 |
| Example 2 | Dissolution suspension process | Resin particle 2 | 0.968 | 2.5 | −42 |
| Example 3 | Dissolution suspension process | Resin particle 3 | 0.968 | 2.3 | −38 |
| Example 4 | Dissolution suspension process | Resin particle 4 | 0.952 | 2.9 | −47 |
| Example 5 | Dissolution suspension process | Resin particle 5 | 0.985 | 1.8 | −35 |
| Comparative Example 1 | Dissolution suspension process | Resin particle 6 | 0.970 | 2.2 | −15 |
| Example 6 | Dissolution suspension process | Resin particle 7 | 0.968 | 2.1 | −39 |
| Example 7 | Dissolution suspension process | Resin particle 8 | 0.969 | 1.9 | −35 |
| Example 8 | Dissolution suspension process | Resin particle 9 | 0.974 | 2.5 | −33 |
| Example 9 | Dissolution suspension process | Resin particle 10 | 0.971 | 2.3 | −41 |
| Example 10 | Dissolution suspension process | Resin particle 11 | 0.966 | 2.6 | −39 |
| Example 11 | Dissolution suspension process | Resin particle 12 | 0.970 | 2.1 | −35 |
| Comparative Example 2 | Dissolution suspension process | None | 0.995 | 0.45 | −10 |
| Example 12 | Dissolution suspension process | Resin particle 1 | 0.995 | 1.1 | −42 |
| Example 13 | Dissolution suspension process | Resin particle 1 | 0.978 | 5.2 | −38 |
| Example 14 | Suspension polymerization process | Resin particle 1 | 0.982 | 2.3 | −46 |
| Example 15 | Suspension polymerization process | Resin particle 2 | 0.972 | 1.8 | −42 |
| Example 16 | Suspension polymerization process | Resin particle 2 | 0.973 | 6.3 | −35 |
| Comparative Example 3 | Suspension polymerization process | Resin particle 6 | 0.980 | 2.5 | −11 |
| Comparative Example 4 | Suspension polymerization process | None | 0.980 | 0.4 | −8 |
| Example 17 | Coagulation process | Resin particle 1 | 0.942 | 3.5 | −42 |
| Example 18 | Coagulation process | Resin particle 2 | 0.953 | 3.2 | −38 |
| Example 19 | Coagulation process | Resin particle 2 | 0.943 | 6.2 | −39 |
| Comparative Example 5 | Coagulation process | Resin particle 6 | 0.980 | 3.3 | −13 |
| Comparative Example 6 | Coagulation process | None | 0.950 | 4.2 | −3 |

[Preparation of Carrier]

Next, specific examples of the preparation of carriers used in the evaluation of toners using actual equipment will be described. However, it should be noted that the carrier used in the present invention is not limited to these examples only.

-Carrier-

| | |
|---|---|
| Acrylic resin solution (solid content 50%) | 21.0 parts |
| Guanamine solution (solid content 70%) | 6.4 parts |
| Alumina particles [0.3 μm, specific resistance $10^{14}$(Ω · cm)] | 7.6 parts |
| Silicone resin solution [Solid content 23% (SR2410: manufactured by Dow Corning Toray Silicone Co., Ltd.)] | 65.0 parts |
| Aminosilane [Solid content 100% (SH6020: manufactured by Dow Corning Toray Silicone Co., Ltd.)] | 1.0 part |
| Toluene | 60 parts |
| Butyl cellosolve | 60 parts |

The materials for the carrier were dispersed with a homomixer for 10 Min to give a covering film forming solution of acrylic resin and silicone resin containing alumina particles. The covering film forming solution was coated on the surface of a fired ferrite powder [$(MgO)_{1.8}(MnO)_{49.5}(Fe_2O_3)_{48.0}$:volume average particle diameter; 25 μm] as a core material to a coating thickness of 0.15 μm with SPILA COATER (manufactured by OKADA SEIKO CO., LTD.), and the coating was dried to give a covered ferrite powder. The covered ferrite powder was allowed to stand in an electric furnace at 150° C. for one hr to perform firing. After cooling, the ferrite powder bulk was disintegrated with a sieve with an opening of 106 μm to give a carrier. Regarding the measurement of the binder resin film thickness, since the covering film covering the surface of the carrier could be observed by observing the cross section of the carrier under a transmission electron microscope, the average value of the film thickness was determined as the film thickness. Thus, Carrier A having a mass average particle diameter of 35 μm was produced.

[Preparation of Two-Component Developing Agent]

Toners a to y and Carrier A were provided. 100 parts of the carrier were mixed with 7 parts of the toner with a tubular mixer including a container that was tumbled for stirring, whereby the toner and the carrier were homogeneously mixed and the mixture was charged to give two-component developers a to y.

[Evaluation of Toner]

(Transfer Efficiency (%))

An evaluation machine, which was a modified machine of DocuColor 8000 Digital Press manufactured by Fuji Xerox Co., Ltd. and subjected to tuning so that the linear velocity and the transfer time could be adjusted, was provided. Each developer was subjected to a running test with the evaluation machine in which a solid image pattern of size A4 at a toner coverage of 0.6 mg/cm$^2$ was outputted as a test pattern. After outputting of 100,000 sheets of the test image and after outputting of 1,000,000 sheets of the test image, the transfer efficiency in the primary transfer and the transfer efficiency in the secondary transfer were determined by Formula (3) and by Formula (4), respectively. The evaluation criteria are as follows.

Primary transfer efficiency(%)=(amount of toner transferred onto intermediate transfer member/amount of toner developed on electrophotographic photoconductor)×100 (3)

Secondary transfer efficiency(%)=(amount of toner transferred onto intermediate transfer member−amount of toner remaining untransferred present on intermediate transfer member/amount of toner transferred onto intermediate transfer member)×100 (4)

The evaluation criteria are as follows.

A . . . 90% or more

B . . . 85% or more and less than 90%

C . . . 80% or more and less than 85%

D . . . Less than 80%

(Lower Limit Fixing Temperature)

A fixing device, which was a device obtained by modifying a fixing part of a full color multifunction machine Imagio NeoC600Pro manufactured by Ricoh Company, Ltd. so that the temperature and the linear velocity could be regulated, was provided. Solid images were formed at a toner coverage of 0.85±0.1 mg/cm$^2$ on transfer papers of plain paper and cardboard transfer paper (type 6000 <70W> and copying sheet <135>, manufactured by Ricoh Company, Ltd.) using the fixing device to evaluate the fixation. The temperature of a fixation roll, at which the retention of the image density after rubbing of the fixed image with a pad was 70% or more, was regarded as the lower limit fixing temperature.

The evaluation criteria are as follows.

A: Less than 120° C.

B: Less than 140° C. and 120° C. or more

C: Less than 160° C. and 140° C. or more

D: 160° C. or more (Upper Limit Fixing Temperature)

-Hot Offset Generation Temperature-

A fixing device, which was a device obtained by modifying a fixing part of a full color multifunction machine Imagio NeoC600Pro manufactured by Ricoh Company, Ltd. so that the temperature and the linear velocity could be regulated, was provided. Solid images were formed on the plain paper with the fixing device so that the toner was developed at a coverage of 0.85±0.3 mg/cm$^2$. The images were fixed with varied heating roller temperatures to measure a fixing temperature (offset generation temperature) at which hot offset was generated.

The evaluation criteria are as follows.

A: 210° C. or more

B: Less than 210° C. and 190° C. or more

C: Less than 190° C. and 170° C. or more

D: Less than 170° C.

The evaluation results of toners are shown in Table 3.

TABLE 3

| Example & Comparative Example | Transfer efficiency in early stage of transfer | Degradation in transfer | Lower limit fixing temperature | Upper limit fixing temperature |
|---|---|---|---|---|
| Example 1 | B | B | B | B |
| Example 2 | B | B | B | B |
| Example 3 | B | C | B | B |
| Example 4 | B | B | A | A |
| Example 5 | B | C | B | B |
| Comparative Example 1 | B | D | D | D |
| Example 6 | B | B | B | B |
| Example 7 | B | B | A | A |
| Example 8 | B | C | B | B |
| Example 9 | B | B | B | B |
| Example 10 | B | B | A | A |
| Example 11 | B | B | B | B |
| Comparative Example 2 | D | D | B | C |
| Example 12 | B | B | C | B |

TABLE 3-continued

| Example & Comparative Example | Transfer efficiency in early stage of transfer | Degradation in transfer | Lower limit fixing temperature | Upper limit fixing temperature |
|---|---|---|---|---|
| Example 13 | B | C | B | B |
| Example 14 | B | B | B | B |
| Example 15 | B | B | B | B |
| Example 16 | B | B | C | B |
| Comparative Example 3 | C | D | D | D |
| Comparative Example 4 | D | D | B | C |
| Example 17 | B | B | B | B |
| Example 18 | B | B | B | B |
| Example 19 | B | A | B | B |
| Comparative Example 5 | C | D | D | D |
| Comparative Example 6 | D | D | B | C |

The toner of the present invention can improve the transfer efficiency in a high-speed full color image forming method while maintaining good fixation, can eliminate image defects upon the transfer, and can output images with good reproducibility for a long period of time. Accordingly, the toner of the present invention is suitable for use in electrophotographic apparatuses involving two transfer steps of a transfer step (primary transfer) of transfer from an electrophotographic photoconductor to an intermediate transfer member and a transfer step (secondary transfer) of transfer from the intermediate transfer member to a recording medium that provides a final image.

What is claimed is:

1. A resin particle having a volume average particle diameter of 10 nm to 500 nm, obtained by a process comprising polymerizing an addition polymerizable monomer comprising a silsesquioxane (a) represented by Formula (I) or by copolymerizing the silsesquioxane (a) with an addition polymerizable monomer (b), (I)

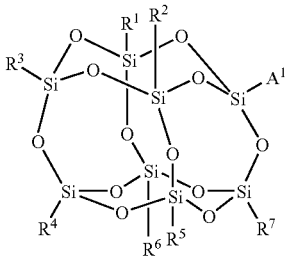

where $R^1$ to $R^7$ each independently represent a group selected from the group consisting of hydrogen, alkyl having 1 to 40 carbon atoms, substituted or unsubstituted aryl, and substituted or unsubstituted arylalkyl; any hydrogen in the alkyl group is optionally substituted by fluorine and any —$CH_2$— is optionally substituted by —O—, —CH═CH—, cycloalkylene or cycloalkenylene; any hydrogen in alkylene in the arylalkyl group is optionally substituted by fluorine and any —$CH_2$— is optionally substituted by —O— or —CH═CH—; and $A^1$ represents an addition polymerizable functional group, and wherein monomer (b) is at least one monomer selected from the group consisting of (meth)acrylic acid, styrene and derivatives thereof.

2. The resin particle according to claim 1, wherein in Formula (I), $R^1$ to $R^7$ each independently represent fluoroalkyl having 1 to 20 carbon atoms in which any methylene group is optionally substituted by oxygen; fluoroaryl having 6 to 20 carbon atoms in which at least one hydrogen is substituted by fluorine or trifluoromethyl; or fluoroarylalkyl having 7 to 20 carbon atoms in which at least one hydrogen in the aryl group is substituted by fluorine or trifluoromethyl.

3. The resin particle according to claim 1, wherein, in Formula (I), $R^1$ to $R^7$ each independently represent a functional group selected from the group consisting of ethyl, isobutyl, isooctyl, phenyl, cyclopentyl, cyclohexyl, 3,3,3-trifluoropropyl, 3,3,4,4,4-pentafluorobutyl, 3,3,4,4,5,5,6,6,6-nonafluorohexyl, tridecafluoro-1,1,2,2-tetrahydrooctyl, heptadecafluoro-1,1,2,2-tetrahydrodecyl, henicosafluoro-1,1,2,2-tetrahydrododecyl, pentacosafluoro-1,1,2,2-tetrahydrotetradecyl, (3-heptafluoroisopropoxy)propyl, pentafluorophenylpropyl, pentafluorophenyl, and α,α,α-trifluoromethylphenyl.

4. The resin particle according to claim 1, wherein, in Formula (I), $A^1$ represents a radical polymerizable functional group.

5. The resin particle according to claim 1, wherein, in Formula (I), $A^1$ includes (meth)acryl or styryl.

6. The resin particle according to claim 5, wherein, in Formula (I), $A^1$ represents a group represented by any one of Formula (II) or (III):

(II)

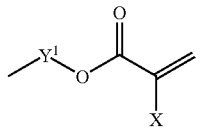

(III)

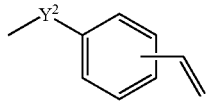

wherein in Formula (II), $Y^1$ represents alkylene having 2 to 10 carbon atoms and X represents hydrogen, alkyl having 1 to 5 carbon atoms or aryl having 6 to 10 carbon atoms, and in Formula (III), $Y^2$ represents a single bond or alkylene having 1 to 10 carbon atoms.

7. The resin particle according to claim 6, wherein in Formula (II), $Y^1$ represents alkylene having 2 to 6 carbon atoms and X represents hydrogen or alkyl having 1 to 3 carbon atoms, and in Formula (III), $Y^2$ represents a single bond or alkylene having 1 to 6 carbon atoms.

8. The resin particle according to claim 7, wherein in Formula (II), $Y^1$ represents propylene and X represents hydrogen or methyl, and in Formula (III), $Y^2$ represents a single bond or ethylene.

9. The resin particle according to claim 1, wherein the addition polymerizable monomer (b) is (meth)acrylic acid or a derivative thereof.

10. The resin particle according to claim 1, wherein the resin particle is a fine particle of a crosslinked resin comprising a styrene polymer, an acrylic acid ester polymer, or a methacrylic acid ester polymer.

11. A toner obtained by a process comprising dissolving and/or dispersing a toner material comprising at least a binder resin and a colorant in an organic solvent to prepare a solution and/or dispersion liquid of the toner material; adding the solution and/or dispersion liquid of the toner material to an aqueous medium for emulsification and/ or dispersion to prepare an emulsion and/or dispersion liquid; and removing the organic solvent from the emulsion and/or dispersion liquid, wherein a resin particle is added in the aqueous medium in the preparation of the emulsion and/or dispersion liquid or removal of the organic solvent from the emulsion and/or dispersion liquid, and wherein the resin particle has a volume average particle diameter of 10 nm to 500 nm and is obtained by polymerizing an addition polymerizable monomer comprising a silsesquioxane (a) represented by Formula (I) or by copolymerizing the silsesquioxane (a) with an addition polymerizable monomer (b), (I)

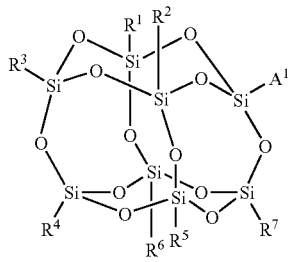

where $R^1$ to $R^7$ each independently represent a group selected from the group consisting of hydrogen, alkyl having 1 to 40 carbon atoms, substituted or unsubstituted aryl, and substituted or unsubstituted arylalkyl; any hydrogen in the alkyl group is optionally substituted by fluorine and any —$CH_2$— is optionally substituted by —O—, —CH═CH—, cycloalkylene or cycloalkenylene; any hydrogen in alkylene in the arylalkyl group is optionally substituted by fluorine and any —$CH_2$— is optionally substituted by —O— or —CH═CH—; and $A^1$ represents an addition polymerizable functional group, and wherein monomer (b) is at least one monomer selected from the group consisting of (meth)acrylic acid, styrene and derivatives thereof.

12. The toner according to claim 11, wherein the toner has an average circularity of 0.950 to 0.990.

13. The toner according to claim 11, wherein the toner has a specific surface area of 0.5 $m^2/g$ to 4.0 $m^2/g$.

14. The toner according to claim 11, wherein the binder resin contains a polyester resin.

15. The toner according to claim 11, wherein the toner material contains an active hydrogen group-containing compound and a modified polyester resin reactive with the active hydrogen group-containing compound.

16. A full-color image forming method comprising:

charging a surface of an electrophotographic photoconductor by a charging unit;

exposing the charged surface of the electrophotographic photoconductor by an exposing unit to form a latent electrostatic image on the electrophotographic photoconductor;

developing the latent electrostatic image, which has been formed on the electrophotographic photoconductor, by a developing unit including therein a toner to form a toner image;

primarily transferring the toner image, which has been formed on the electrophotographic photoconductor, onto an intermediate transfer member by a primary transfer unit;

secondarily transferring the toner image, which has been transferred onto the intermediate transfer member, onto a recording medium by a secondary transfer unit;

fixing the toner image, which has been transferred onto the recording medium, by action of heat and a fixing unit including a pressure fixing member; and removing, by cleaning unit, toner remaining untransferred and adhered onto the surface of the electrophotographic photoconductor, from which the toner image has been transferred onto the intermediate transfer member by the primary transfer unit, wherein the toner present in the development is obtained by dissolving and/or dispersing a toner material containing at least a binder resin and a colorant in an organic solvent to prepare a solution and/or dispersion liquid of the toner material; adding the solution and/or dispersion liquid of the toner material to an aqueous medium for emulsification and/ or dispersion to prepare an emulsion and/or dispersion liquid; and removing the organic solvent from the emulsion and/or dispersion liquid, wherein a resin particle is added in the aqueous medium in the preparation of the emulsion and/or dispersion liquid or removal of the organic solvent from the emulsion and/or dispersion liquid, and wherein the resin particle has a volume average particle diameter of 10 nm to 500 nm and is obtained by polymerizing an addition polymerizable monomer comprising a silsesquioxane (a) represented by Formula (I) or by copolymerizing the silsesquioxane (a) with an addition polymerizable monomer (b), (I)

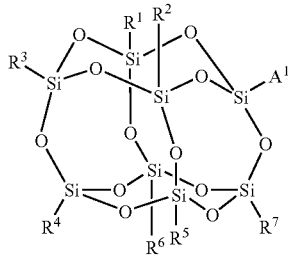

where $R^1$ to $R^7$ each independently represent a group selected from the group consisting of hydrogen, alkyl having 1 to 40 carbon atoms, substituted or unsubstituted aryl, and substituted or unsubstituted arylalkyl; any hydrogen in the alkyl group is optionally substituted by fluorine and any —$CH_2$— is optionally substituted by —O—, —CH═CH—, cycloalkylene or cycloalkenylene; any hydrogen in alkylene in the arylalkyl group is optionally substituted by fluorine and any —$CH_2$— is optionally substituted by —O— or —CH═CH—; and $A^1$ represents an addition polymerizable functional group, and wherein monomer (b) is at least one monomer selected from the group consisting of (meth)acrylic acid, styrene and derivatives thereof.

17. The full-color image forming method according to claim 16, wherein in the secondary transfer, the linear velocity of transfer of the toner image onto the recording medium is 300 mm/sec to 1,000 mm/sec, and the time during the transfer in a nip portion of the secondary transfer unit is 0.5 msec to 20 msec.

18. The full-color image forming method according to claim 16, employing a tandem-type electrophotographic image forming process.

19. The resin particle according to claim 1, wherein the addition polymerizable monomer (b) is styrene or a derivative thereof.

* * * * *